US012655561B2

(12) United States Patent
Schlack

(10) Patent No.: US 12,655,561 B2
(45) Date of Patent: Jun. 16, 2026

(54) APPARATUS FOR DOSING DETERGENT, CONTAINER FOR RECEIVING AND DOSING POWDER DETERGENT AND/OR LIQUID DETERGENT, AND CORRESPONDING SYSTEM

(71) Applicant: SMIICS GmbH, Göttingen (DE)

(72) Inventor: Stefan Schlack, Göttingen (DE)

(73) Assignee: SMIICS GmbH, Göttingen (DE)

( * ) Notice: Subject to any disclaimer, the term of this patent is extended or adjusted under 35 U.S.C. 154(b) by 402 days.

(21) Appl. No.: 17/299,551

(22) PCT Filed: Dec. 5, 2019

(86) PCT No.: PCT/EP2019/083774
§ 371 (c)(1),
(2) Date: Jun. 3, 2021

(87) PCT Pub. No.: WO2020/115184
PCT Pub. Date: Jun. 11, 2020

(65) Prior Publication Data

US 2022/0034016 A1 Feb. 3, 2022

(30) Foreign Application Priority Data

Dec. 5, 2018 (DE) ..... 10 2018 009 551.8
Feb. 13, 2019 (DE) ..... 10 2019 001 063.9
(Continued)

(51) Int. Cl.
*D06F 33/37* (2020.01)
*D06F 39/02* (2006.01)
(Continued)

(52) U.S. Cl.
CPC ..... *D06F 33/37* (2020.02); *D06F 39/026* (2013.01); *D06F 2103/04* (2020.02); *D06F 2105/42* (2020.02)

(58) Field of Classification Search
CPC ..... D06F 33/37; D06F 39/026
See application file for complete search history.

(56) References Cited

U.S. PATENT DOCUMENTS 5,542,342 A 8/1996 McNeill et al.
8,444,012 B2 5/2013 Bergdahl et al.
(Continued)

FOREIGN PATENT DOCUMENTS

CH 708908 A2 5/2015
CH 709439 A2 9/2015
(Continued)

OTHER PUBLICATIONS

Machine translation of DE102016000406A1, dated Jul. 2017. (Year: 2017).*
(Continued)

*Primary Examiner* — Michael E Barr
*Assistant Examiner* — Kevin G Lee
(74) *Attorney, Agent, or Firm* — Thomas | Horstemeyer, LLP

(57) ABSTRACT

A device (1) for dosing detergent, in particular powder detergent, is shown and described, comprising a housing (3) with at least one first receiving area (5), wherein the at least one first receiving area (5) is designed to receive a first container (9) for a detergent, a dosing device (29) for dosing the detergent, wherein the dosing device (29) has a dosing setting for dosing detergent which depends on a determined weight of laundry to be washed, wherein the first receiving region (5) has a dosing device receiving region (27) for receiving the dosing device (29), and wherein an actuating and/or driving device (39) for the dosing device (29) is arranged in the dosing device receiving region (27).

17 Claims, 28 Drawing Sheets

(30) Foreign Application Priority Data

Figure 1:
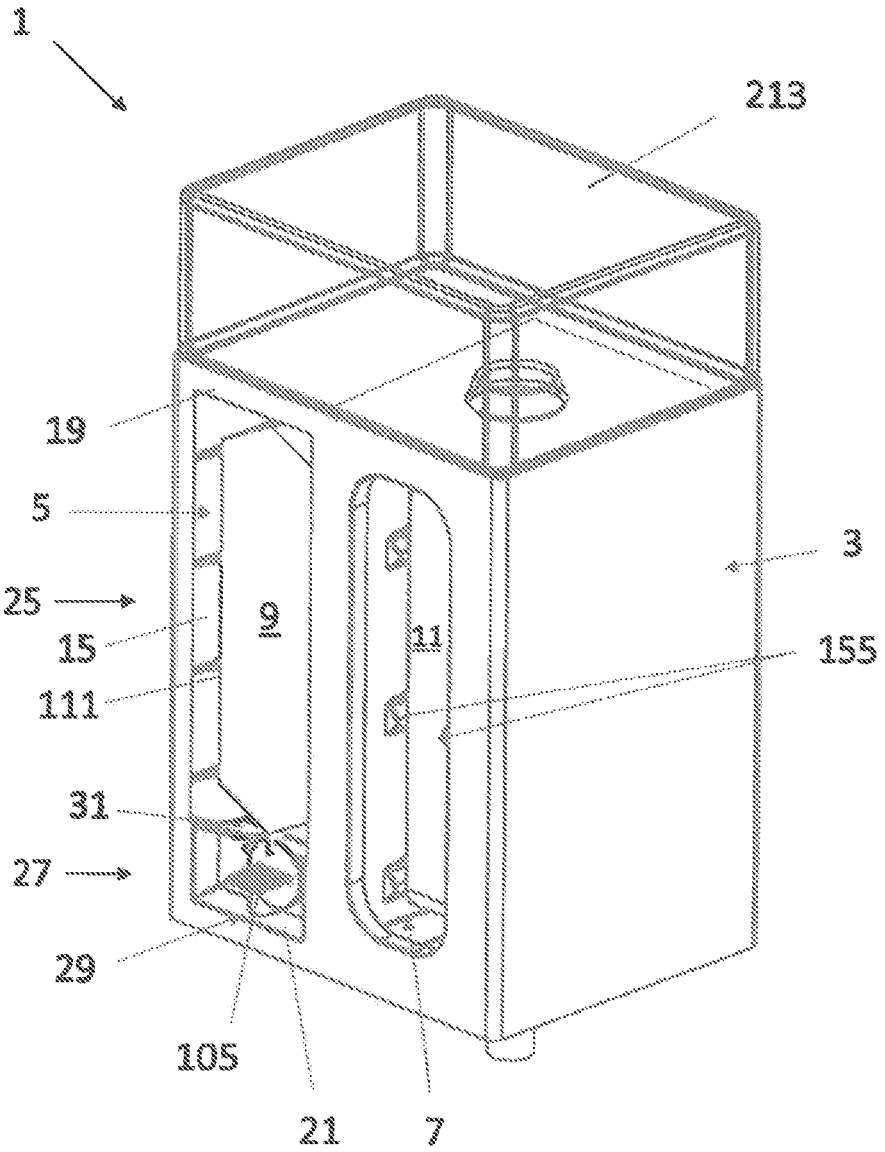

Jul. 17, 2019 (DE) ..... 10 2019 005 000.2
Oct. 21, 2019 (DE) ..... 20 2019 004 331.4

(51) Int. Cl.
*D06F 103/04* (2020.01)
*D06F 105/42* (2020.01)

(56) References Cited

U.S. PATENT DOCUMENTS

| | | | | |
|---|---|---|---|---|
| 2005/0150393 | A1 | 7/2005 | Biderman et al. | |
| 2005/0230343 | A1 | 10/2005 | Huber | |
| 2008/0110935 | A1 | 5/2008 | Huber et al. | |
| 2009/0090141 | A1* | 4/2009 | Deppermann | D06F 39/022 68/17 R |
| 2009/0188394 | A1 | 7/2009 | Sinnema et al. | |
| 2010/0161143 | A1* | 6/2010 | Smith | D06F 39/022 700/283 |
| 2013/0312202 | A1* | 11/2013 | Balinski | D06F 34/18 8/137 |
| 2020/0277725 | A1* | 9/2020 | Caputo | B65G 43/00 |

FOREIGN PATENT DOCUMENTS

| | | | | |
|---|---|---|---|---|
| CN | 101448442 | A | 6/2009 | |
| CN | 102946771 | A | 2/2013 | |
| CN | 108778068 | A | 11/2018 | |
| CN | 108852006 | A | 11/2018 | |
| DE | 2330078 | | 1/1974 | |
| DE | 2715387 | A1 | 10/1978 | |
| DE | 3528128 | A1 | 2/1987 | |
| DE | 4204736 | A1 | 10/1992 | |
| DE | 29518415 | U1 | 3/1996 | |
| DE | 4440458 | A1 | 5/1996 | |
| DE | 29611088 | U1 | 1/1997 | |
| DE | 10159162 | A1 | 6/2003 | |
| DE | 102007050920 | B3 | 12/2008 | |
| DE | 102007048199 | B3 | 1/2009 | |
| DE | 102007041603 | A1 | 3/2009 | |
| DE | 102011054155 | A1 | 4/2013 | |
| DE | 202009019111 | U1 | 7/2016 | |
| DE | 102015120710 | A1 | 6/2017 | |
| DE | 102016000406 | A1 | 7/2017 | |
| DE | 102017200748 | A1 | 7/2018 | |
| EP | 0611843 | B1 * | 5/1998 | D06F 39/026 |
| EP | 1959045 | A1 * | 8/2008 | A47L 15/4418 |
| EP | 2818085 | B1 | 7/2016 | |
| EP | 3232869 | B1 | 4/2018 | |
| GB | 2447678 | A | 9/2008 | |
| JP | S63192495 | A | 8/1988 | |
| JP | 6-70851 | A | 3/1994 | |
| JP | H7-111944 | A | 5/1995 | |
| JP | H9-192020 | A | 7/1997 | |
| JP | 200211280 | A | 1/2002 | |
| JP | 2004-89441 | A1 | 3/2004 | |
| JP | 2008505667 | A | 2/2008 | |
| JP | 2010-535551 | A | 11/2010 | |
| KR | 201996005180 | | 2/1996 | |
| KR | 970001667 | Y1 * | 3/1997 | D06F 34/14 |
| KR | 20170082056 | A | 7/2017 | |
| WO | 2009/142354 | A1 | 11/2009 | |
| WO | 2017/108451 | A1 | 6/2017 | |
| WO | 2017121638 | A1 | 7/2017 | |
| WO | 2017/211701 | A1 | 12/2017 | |
| WO | 2019/063971 | A1 | 4/2019 | |

OTHER PUBLICATIONS

Machine translation of KR-970001667-Y1, dated 1997-03-15. (Year: 1997).*

Office Action in the Appeal Trial in respect of Japanese Patent Application No. 2021-531888 mailed Aug. 27, 2024.

20231212 S15284JP (PA2021-532147) 1st OA with English Translation mailed Dec. 5, 2023.

20240905 S15284JP (JPA2021-532147) Final OA English translation mailed Sep. 3, 2024.

Office Action from Korean Patent Application No. 10-2021-7020845 dated Jan. 24, 2025.

First Office Action from Japanese Patent Application No. 2023-220711 issued Mar. 18, 2025.

* cited by examiner 253
207
216
11
203
249
209
210
155
1
53
5
53
165
7
221
171
167
169
225
163
157
202
11
173
249
215
207
251
245
217
178
207
215
163
7
11
157
169
155
171
167
161
218
226
221
7
161
167
169
155
157
D2
D3

APPARATUS FOR DOSING DETERGENT, CONTAINER FOR RECEIVING AND DOSING POWDER DETERGENT AND/OR LIQUID DETERGENT, AND CORRESPONDING SYSTEM

The present application relates to a device for dosing washing detergent, in particular powder washing detergent and/or liquid washing detergent, a container for receiving and dosing powder washing detergent, a container for receiving and dosing liquid washing detergent, as well as a system comprising a device for dosing washing detergent.

When washing, the correct dosage is important. Users often find it difficult to find the correct dosage of detergent for the laundry to be washed. The dosage level does not necessarily depend only on the degree of soiling of the laundry. Different detergents must also be used differently and the dosage depends on other factors, such as the load amount of the washing machine drum and the water hardness. For the user, however, it is difficult to estimate how many kilograms his laundry actually weighs. Usually, this is only roughly estimated, based on how full the washing machine drum is. Furthermore, it is difficult for the user to find out the hardness of the water in the pipes.

As a result, the detergent is often not dosed correctly. If the user uses too much detergent for a small load, residues of it can remain in the clothes. This can leave lye residues and residues from the detergent in the fibers of the laundry. This can cause skin irritation when this laundry is subsequently worn. This is a particular disadvantage for allergy sufferers and neurodermatitis sufferers. If there is not enough washing detergent for a full load, lime spots can form or the detergent is not distributed properly, resulting in an unsatisfactory washing result. For example, clothing, bed sheets or other laundry items may turn gray or harden if lime residues remain in the fibers. Therefore, over- or underdosing of the detergent should be avoided.

Manual dosing aids, for example cups with markings, are known from the prior art and are provided by the various washing machine manufacturers together with their product. The user can then use these to dose the amount of detergent on the basis of variables he has determined or estimated himself, such as the amount of laundry, the degree of hardness of the water and the degree of soiling.

Furthermore, automatic dosing systems firmly integrated in the washing machine are known from the state of the art. An automatic dosing system that is firmly integrated into the washing machine has many advantages, however also disadvantages. The biggest advantage is that the detergent does not have to be refilled by the user for each wash cycle and that it is not necessary to estimate again for each wash cycle which dosage is required for the respective wash load. Instead, the user can fill a large amount of washing detergent, for example an entire bottle of a commercially available detergent, into the detergent chambers of a washing machine once, and the machine automatically helps itself to the detergent sometimes more and sometimes less, depending on the load amount, type of textile, or degree of soiling of the laundry. Thus, the dosage of detergent is determined precisely and quite automatically, so that incorrect dosage is avoided. In most cases, the water and electricity consumption can also be adjusted simultaneously by the washing machine, so that the water and energy consumption is also optimized. The automatic dosing is environmentally friendly, because by avoiding overdosing of detergent, less detergent residue can get into the waste water.

The automatic dosing systems known from the prior art are usually integrated into the washing machine, so that these washing machines with integrated dosing are more expensive to purchase. Furthermore, the automatic dosing systems known from the prior art have to be cleaned, for example due to firmly installed hose lines. Furthermore, in the automatic dosing systems known from the prior art, the flow measurement must be determined, for which an expensive sensor system, for example a platinum sensor, is used. Pumps are also used for dosing. Furthermore, the known dosing systems are designed for liquid detergents, i.e., they only allow dosing of liquid detergents and dosing of powder detergents is not possible with these dosing systems.

Unlike liquid detergents, powder detergents do not contain preservatives. Powder detergents contain bleaching agents that remove bleachable stains, ensure white laundry and are also effective against germs at higher temperatures. In the case of infectious diseases, allergies or people in need of care living in the house, at least the body and bed linen, kitchen linen, cleaning cloths and towels should be washed at least 60° C. with a heavy-duty detergent. In order to avoid detergent residues, care should therefore be taken to ensure exact dosage, especially with powder detergents.

Based on the prior art, it is the task of the present invention to provide a simplified and cost-effective dosage of detergent, in particular of powder detergent and liquid detergent.

According to the invention, this task is solved by the object of the independent claims. Preferred embodiments result from the dependent claims.

According to one aspect of the invention, a device for dosing detergent, in particular powder detergent, comprising a housing having at least one first receiving area, said at least one first receiving area being designed for receiving a first container for a detergent, a dosing device for dosing the detergent, wherein the dosing device has a dosing setting for dosing detergent which depends on a determined weight of a laundry to be washed, wherein the first receiving region has a dosing device receiving region for receiving the dosing device, and wherein an actuating and/or driving device for the dosing device is arranged in the dosing device receiving region.

The device according to the invention comprises a first receiving area designed to receive a first container of powder detergent. Furthermore, a dosing device receiving area is arranged in the first receiving area of the device, i.e. a receiving area in which a dosing device can be received. Thus, the first receiving area can receive the first container of powder detergent and the dosing device at least partially. Advantageously, this enables the dosing device to interact with the first container. In particular, a correct dosing of the powder detergent can be performed by the dosing device. This is made possible by the fact that the dosing device is driven by the drive device, which is also arranged in the dosing device receiving area.

Furthermore, all components of the described device that come into contact with the detergent are, in particular, interchangeable and can be removed from the device in a simple manner. By interchangeable components is meant that the components are designed as disposable or single-use article. In particular, the first container with powder detergent, the dosing device for dosing the powder detergent are interchangeable. The first container is connectable or liquid detergent connectable to the dosing device. This is advantageous because the device for dosing detergent, in particular the first receptacle and the second receptacle described later, do not come into contact with the detergent. Thus, the device is not contaminated with detergent and a time-consuming cleaning or decalcification of the device and/or its individual components can be dispensed with.

The detergent can be introduced by the device into a container, preferably a cup, or directly into the detergent chamber of a commercial washing machine, in a correct dosage. This can be done depending on the degree of soiling of the laundry, the hardness of the water and/or the amount of laundry. With the device, the detergent can be fed from the first container into the reservoir and introduced into the detergent chambers of a washing machine in a correct dosage. This can be done manually, in which the user subsequently fills the detergent filled into the container or cup into the detergent chamber of a commercially available washing machine. However, it is also conceivable that the device for dosing detergent is or can be connected to a washing machine or is integrated into the washing machine in such a way that the filling of the detergent chambers with the detergent previously dosed by means of the device is automated It is conceivable that the device is installed directly above or adjoining or near the detergent chamber or the opened powder and liquid detergent compartment of a commercially available washing machine, so that the powder and/or liquid detergent correctly dosed by means of the device can be filled into the detergent chamber or into the powder and/or liquid detergent compartment of the washing machine.

The dosing device has a dosing setting for dosing detergent that depends on a determined weight of a laundry to be washed. In other words, the amount of detergent dosed from the first container can be made dependent on the weight of the laundry to be washed. For example, the weight of the laundry may be determined by means of a scale as described later. For example, the scale may be coupled to the device for dosing detergent in such a way that the weight is transmitted to a control unit, which may be part of the device, which in turn controls the dosing of detergent from the first container based on this transmitted weight.

The device can be designed, as described later, to automatically dose the detergent, for example, depending on the degree of soiling of the laundry, the water hardness and/or the amount of laundry.

The device for dosing detergent can be connected to the washing machine. Preferably, however, the device for dosing detergent is not connected or fixed to the washing machine, but is constructed or positioned separately from the washing machine, for example in the vicinity thereof. Thus, the device can be purchased separately from the washing machine and the device can be compatible with all washing machines available on the market. Advantageously, the dosing of detergent can thus be carried out for all washing machines available on the market.

The device for dosing detergent according to the invention thus enables correct, simplified and cost-effective dosing of detergents, in particular of powder detergents and/or liquid detergents of different types, for example mild detergent, normal detergent, fabric softener, wool detergent, detergent for black clothing, hygiene detergent or color detergent. The fact that all components of the detergent dosing device are interchangeable means that different detergents, i.e. powder detergents and/or liquid detergents from different manufacturers, can be dosed with one and the same device. Contamination of different detergents is thus avoided.

Preferably, the dosing device is connectable to the first container.

The dosing device can be connected to the first container. This means that the dosing device can be connected to the first container so that the dosing device and the first container can be inserted into and/or removed from the receiving area together. For example, the dosing device may be non-detachably connected (e.g., glued and/or welded) to the first container, so that the dosing device and the first container are firmly connected to each other. However, it is also conceivable that the dosing device and the first container are detachably connected to each other.

This enables the first container and the dosing device to be inserted into the first receiving area in a simplified manner and to be at least partially received by the first receiving area. At the same time, the dosing device can engage securely with the drive device so that the intended amount of detergent, in particular powder detergent, can be guided from the first container by means of the dosing device into a container or cup or into the detergent chamber of a washing machine. However, it is also conceivable that the dosing device and the first container are not connected to one another and are introduced into the first receiving area and/or removed again separately from one another.

Preferably, the at least one first receiving area is designed to receive a first container for a powder detergent. Preferably, the dosing device comprises a screw conveyor and a screw conveyor housing, wherein the screw conveyor, preferably in its full length, is inserted into the screw conveyor housing and/or is rotatably arranged or mounted therein, so that the screw conveyor and the screw conveyor housing extend around a common screw conveyor longitudinal axis.

The dosing device may be designed as a screw conveyor with a screw conveyor and a screw conveyor housing. The screw conveyor may be configured as a shaft, coiled around one or more helically wound flights in the form of flat plates and/or rubber lobes or wings extending transversely away from the longitudinal axis of the screw conveyor essentially in the form of a screw thread. Preferably, the screw conveyor is in the form of a rigid screw conveyor. However, it is also conceivable that the conveyor worm is designed as a flexible, in particular bendable, worm. The worm thread can either be firmly connected to the shaft, for example welded, or manufactured or fabricated in one piece with the shaft. Preferably, the conveying screw comprises a continuous, continuous screw thread extending between opposite ends of the conveying screw along the longitudinal axis of the conveying screw. This enables, in particular, the transport of powder detergent by means of the conveying screw along its longitudinal axis. The screw conveyor, in particular the screw thread, can be turned from a solid material, for example from a piece of round steel, or manufactured as a cast part or injection-molded part. The screw conveyor and/or the screw conveyor housing are essentially cylindrical in shape.

The design of the dosing device enables the powder detergent to be fed from the first container into the dosing device and to be transported along the longitudinal axis of the screw conveyor by means of the screw conveyor in the screw conveyor housing. With each rotation of the screw conveyor, a specific amount of powder can be conveyed, so that the dosing of the powder detergent can be determined by the number of (partial) revolutions. This enables precise and simplified dosing of the powder detergent, which can be carried out either automatically, for example controlled by a control or regulating unit, or manually.

Preferably, the screw conveyor housing has an inlet with an inlet opening and an outlet with an outlet opening. Preferably, the inlet and the outlet are arranged in the screw conveyor housing on opposite sides as seen transversely to the longitudinal axis of the screw conveyor.

Powder detergent may be fed from the first container into the interior of the screw conveyor housing through the inlet opening to be received by one or more helically wound flights of the screw conveyor. The device for dosing detergent may comprise a shaking device with which the first container or its contents can be set into a shaking motion. This enables the powder detergent to be guided almost completely from the first container through the inlet opening into the interior of the screw conveyor housing, in particular if the powder detergent does not slide down by itself and is to be guided into the interior of the screw conveyor housing by gravity, for example. The jogging device can preferably be arranged in or corresponding to the first receiving area.

As a result of the rotation of the screw conveyor, the powder detergent, after entering the interior of the screw conveyor housing, is conveyed by the screw conveyor essentially along the longitudinal axis of the screw conveyor and can exit through the outlet opening of the outlet. Due to the fact that the outlet is arranged on an opposite side of the inlet as viewed transversely to the longitudinal axis of the conveying screw, the powder detergent can exit the conveying screw housing when it reaches the inlet.

Preferably, the screw conveyor has a screw flank diameter, i.e. an outer diameter transverse to the longitudinal direction of the screw conveyor, which is in a range of approximately 20 to 40 mm. Particularly preferably, the screw flank diameter is approximately 25 mm. This dimensioning of the screw flank diameter favors the conveying or dosing of the powder detergent. Moisture, in particular, can greatly change the properties of the powder detergent, especially if the powder detergent (partially) clumps or sticks together. The previously described dimensioning of the screw flank diameter ensures correct conveying and dosing of the powder detergent even when moisture enters.

Preferably, the screw conveyor has a length that is in a range between approximately 60 and 120 mm. Particularly preferably, the length of the screw conveyor is between approximately 90 mm and 110 mm, further preferably approximately 106 mm. This dimensioning of the length of the conveying screw favors the conveying of the powder detergent. If the length of the conveying screw is reduced, bridging of the powder detergent can occur in the one or more helically wound flights, so that the inlet opening is blocked and no further powder detergent can be introduced through the inlet opening. Bridging can occur especially when the powder detergent is to be fed by gravity through the inlet opening into the screw conveyor housing.

Dimensioning the length and the screw flank diameter of the screw conveyor in the ranges of values as previously described enables a delivery rate of powder detergent in the range of approximately 5 to 10 g per revolution of the screw conveyor (e.g. of approximately 8.8 g per revolution). Thus, the number of revolutions (or the angle of rotation around the longitudinal axis) enables the desired amount of powder detergent to be fed through the outlet of the screw conveyor housing and thus out of the screw conveyor housing. This enables precise dosing of the powder detergent.

Preferably, the inlet opening is essentially oval-shaped and extends in the direction of the longitudinal axis. However, other shapes of the inlet opening are also conceivable. The inlet opening comprises a length in the range of from approximately 20 mm to 60 mm (e.g., of approximately 47 mm) in the direction of the screw conveyor longitudinal axis and/or a length in the range of from approximately 10 mm to 40 mm (e.g., of approximately 29 mm) transverse to the screw conveyor longitudinal axis, in particular viewed perpendicular to the screw conveyor longitudinal axis. Preferably, the outlet opening is essentially rectangular in shape and extends in the direction of the longitudinal axis. However, other shapes of the outlet opening are also conceivable. The outlet opening comprises a length in the range of approximately 20 mm to 50 mm (e.g., of approximately 30 mm) as viewed in the direction of the longitudinal axis of the screw conveyor and/or a length in the range of approximately 5 mm to 20 mm (e.g., of approximately 10 mm) as viewed transversely to the longitudinal axis, in particular perpendicular to the longitudinal axis of the screw conveyor. These dimensions of the inlet opening and outlet opening allow a particularly favorable introduction and execution of powder detergent into the screw conveyor housing.

Preferably, the screw conveyor housing extends between a first end and an opposite second end along the longitudinal axis of the screw conveyor with the outlet disposed adjoining or near the first end and with the inlet disposed adjoining or near to the second end.

The inlet and outlet are preferably longitudinally spaced from each other. By the arrangement of the inlet adjoining or near the second end and the arrangement of the outlet adjoining or near the first end of the screw conveyor housing, the powder detergent can be received by the one or more helical flights after entering the interior of the screw conveyor housing through the inlet opening in the inlet and conveyed by the rotation of the screw conveyor to the second end of the screw conveyor housing and exit through the outlet opening. Thus, a predetermined or predeterminable amount of powder detergent can be conveyed per revolution so that a dosage can be adjusted (or controlled or regulated) based on the number of revolutions (or the angle of rotation around the longitudinal axis).

The first end of the screw conveyor housing is preferably open and the second end of the screw conveyor housing is preferably closed. Thus, the screw conveyor can be fully inserted into the screw conveyor housing through the first end. An insertion element or removal element may be provided at the second end, extending away from the second end. The insertion element or removal element may be configured as a tab comprising a surface that is approximately the size of a thumb. In particular, the insertion element or removal element may comprise a length of approximately 3 to 4 cm and/or a width of approximately 2 to 3 cm. On opposite sides, the insertion element or removal element may comprise a haptic corrugation structure. Preferably, the corrugated structure is made of a soft, rubberized material. However, it can also be made of the same material as the insertion element or removal element.

By means of the insertion element, the dosing device can be held and/or specifically inserted into the dosing device receptacle. Furthermore, the insertion element can also be used to easily remove the dosing device again, in particular when the first container is empty and needs to be replaced.

Preferably, the inlet comprises a flange having a peripheral wall at least partially surrounding the inlet opening and extending (preferably essentially radially) away from the screw conveyor housing, the flange being configured for connecting the dosing device to the first container and/or for inserting the dosing device into the dosing device receiving region.

The peripheral wall of the inlet in the screw conveyor housing is designed to engage with the first container, in particular with an outlet in the first container. This enables the powder detergent from the first container to be introduced into the screw conveyor housing in a particularly reliable manner. The peripheral wall can be manufactured in one piece with the screw conveyor housing, or can be manufactured as a casting or injection-molded part that can be connected to the screw conveyor housing.

The peripheral wall may extend away from the edge of the inlet opening in the screw conveyor housing essentially at an angle different from 0° or 180°, in particular transversely. Thus, like the inlet opening, the peripheral wall can be essentially oval-shaped and extend in the same direction as the longitudinal axis of the screw conveyor. However, other shapes for the peripheral wall are also conceivable. In particular, the peripheral wall has essentially the same shape as the inlet opening. The peripheral wall may have a periphery in the range of approximately 100 mm to 130 mm (e.g., of approximately 122 mm). The peripheral wall may extend along a first peripheral wall central longitudinal axis, which may have a length in the range of approximately 30 mm to 60 mm (e.g., of approximately 47 mm). Further, the peripheral wall may extend along a second peripheral wall central longitudinal axis that is oriented perpendicular to the first peripheral wall central longitudinal axis and/or may have a length in the range of approximately 20 mm to 40 mm (e.g., of approximately 29 mm). Other lengths are also conceivable. Preferably, the length of the first peripheral wall center longitudinal axis is greater than the length of the second peripheral wall center longitudinal axis. The previously described lengths of the first and second peripheral wall center longitudinal axes are particularly favorable for introducing the powder washing detergent into the screw conveyor housing and/or for connecting the dosing device to the first container.

Preferably, the peripheral wall comprises a first abutment surface and an opposing second abutment surface, the first and second abutment surfaces being oriented parallel to each other.

The first and second abutment surfaces may be disposed on opposite sides of the second peripheral wall central longitudinal axis. These abutment surfaces allow for particularly easy insertion of the dosing device into the dosing device receiving area. In particular, during insertion into the dosing device receiving region, the abutment surfaces can slide along lateral guide members in the first receiving region and can abut the lateral guide members after being received into the dosing device receiving region. The first abutment surface and the second abutment surface may have a essentially parabolic cross-sectional area. The configuration of the two abutment surfaces and the lateral guide members, and their interaction when the first container is inserted into the first receiving area, enables the first container to be received in a correct position by the first receiving area so that the powder detergent can be fed out of the outlet of the dosing device at the correct dosage.

Preferably, a coupling device extends from a drive end of the screw conveyor in the direction of the longitudinal axis, the coupling device being designed to interact in a coupling manner with the actuating and/or drive device, in particular to engage.

The coupling device may be configured as a essentially cylindrical cavity and/or as a receiving, such that after insertion and reception of the dosing device into the dosing device receiving area, a coupling element in the dosing device receiving area may be simultaneously received in the (preferably essentially cylindrical) cavity. Preferably, the inner wall of the (cylindrical) cavity has an inner profile that can be engaged with an outer profile of the outer wall of the coupling element. For example, the outer profile of the coupling element may have at least one material elevation that can engage or interact with at least one material recess in the inner profile of the cylindrical cavity. The coupling element may be configured as a drive shaft, such that insertion of the coupling element into the cylindrical cavity enables the dosing device to be driven and thus the screw conveyor to rotate. Preferably, the transmission ratio of the rotational speed is adjustable or variable. This enables a change in the speed of the powder detergent conveyed through the conveying screw housing and thus a change in the dosing of the powder detergent.

Preferably, the screw conveyor housing comprises an outer wall having a plurality of ribs, the ribs preferably extending essentially axially at least partially between the first end and the second end, and/or the ribs extending essentially in radial direction, away from the outer wall The ribs are preferably formed as longitudinal ribs between the first and second ends and/or peripherally surround the outer wall at regular or symmetrical intervals. The ribs may extend away from the outer wall such that each of the ribs has an outer edge that extends in a straight line that is essentially parallel to the screw conveyor longitudinal axis of the screw conveyor housing and/or is essentially a constant distance from the outer wall of the screw conveyor housing. However, the ribs may also comprise a conically shaped region, for example, which preferably adjoins the first end of the screw conveyor housing. In this conically shaped region, the outer edge of the ribs tapers towards the first end of the screw conveyor housing.

Preferably, two more of the ribs limit the outlet opening on or at opposite sides in the peripheral direction of the outer wall. In other words, two of the ribs are disposed adjoining or near the outlet opening and extend away from the edge of the outlet opening. Preferably, two further ribs are provided limiting the outlet opening on opposite sides in the axial direction of the outer wall. These further ribs extend between the two ribs limiting the outlet opening on opposite sides in the peripheral direction and are arranged adjoining or near to the outlet opening, extending away from the edge thereof. Thus, the outlet opening may be surrounded by ribs on all sides.

The ribs at the outlet, in particular at the outlet opening, advantageously prevent contact of the escaping powder detergent with the housing of the powder detergent dosing device. By preventing the powder from contacting the housing of the device, the housing requires less frequent cleaning. In addition, the powder is prevented from contaminating and/or not being dispensed at the housing and thus cannot be used for washing. However, the ribs can further serve as a stand for the dosing device, especially when the dosing device is not inserted in the dosing device receiving area of the first receiving area. This enables easy connection of the first container to the dosing device and subsequent easy filling of the first container with powder detergent.

Preferably, the first receiving area comprises a rear wall, two spaced side walls oriented at an angle different from 0° or 180°, in particular essentially transverse to the rear wall, an upper and a lower limitation oriented at an angle different from 0° or 180°, in particular essentially transverse to the side walls, and an open front side opposite the rear wall so that the first receiving area is formed between the side walls and/or the upper and lower limitations. The first receiving area preferably comprises a container receiving area for receiving the first container, wherein the container receiving area is preferably arranged above the dosing device receiving area.

The container receiving area may thus be adjoining to the upper limitation and/or the dosing device receiving area may be adjoining to the lower limitation. The open front thus enables the first container together with the dosing device to be inserted into the first receiving area by a essentially perpendicular movement to the rear wall, such that the first container is received by the container receiving area and the dosing device is received by the dosing device receiving area. Preferably, the first container is connected to the dosing device such that, in a condition inserted into the first receiving region, the first container is positioned above or above the dosing device relative to the lower limitation and/or is spaced further from the lower limitation than the dosing device. This enables the powder to be guided from the first container into the dosing device, for example, due to gravity.

Preferably, a first guide member and a second guide member are disposed between the container receiving area and the dosing device receiving area, wherein the guide members extend essentially from the open front to the rear wall and/or wherein the guide members extend away from the side walls.

The guide elements can run essentially continuously from the front to the rear wall. They allow a particularly simple insertion of the first container and the dosing device in the interconnected state into the first receiving area, so that the first container is arranged and/or received above the guide elements and the dosing device is arranged and received below the guide elements. For proper insertion of the first container and the dosing device, the peripheral wall may be inserted between the guide members such that the first and second bearing surfaces slide essentially along the guide members. In other words, the first support surface slides along the first guide member and the second support surface slides along the second guide member until the dosing device is fully received by the dosing device receptacle. In the state inserted into the dosing device receiving area of the first receiving area, the lateral contact surfaces of the peripheral wall of the dosing device then rest against the two guide elements. This makes it particularly easy to receive the first container and/or the dosing device and to arrange them stably in the first receiving area.

Preferably, the guide members are oriented essentially in a plane parallel to the upper limitation and/or the lower limitation, with the guide members preferably inclined toward the front out of the plane toward the container receiving area.

As a result, the guide elements each comprise, adjoining or near to the open front face, an insertion slope which enables assistance for the correct insertion of the dosing device. In particular, during insertion, two of the ribs disposed on the outer wall of the screw conveyor housing can slide essentially along the underside of the guide elements, while the two lateral abutment surfaces slide between the guide elements as previously described. In the condition inserted into the dosing device receiving portion of the first receiving portion, the lateral abutment surfaces of the peripheral wall of the dosing device and two of the ribs then abut the two guide elements. In particular, the abutment surfaces may abut the edges of the guide members extending away from the side walls, and the two ribs may abut the underside of the two guide members facing the lower limitation.

When the screw conveyor or screw conveyor housing is inserted into the dosing device receicing area, the screw conveyor can click into place, e.g. as soon as the end position has been reached. This way, the user knows that the screw conveyor has been installed correctly or that the (cylindrical) cavity has been correctly connected to the coupling element or the drive shaft. The insertion chamfers can help to bring the first container into the correct position and/or furthermore simplify the clicking in of the screw conveyor.

Preferably, the dosing device comprises a closure or flap element, wherein the closure or flap element is designed to be opened automatically or manually, wherein preferably the closure or flap element is designed to close the dosing device and/or the first container airtight.

Preferably, the lower limitation has a receptacle for the screw housing extending from the open front to the rear wall.

The screw housing receptacle may extend between the two side walls about a receptacle longitudinal axis oriented essentially parallel to the two side walls. A receptacle outlet opening may be disposed on the receptacle longitudinal axis, particularly adjoining or near to the rear rear wall, the receptacle outlet opening having essentially the same shape and dimension as the screw conveyor housing outlet opening. The receiving has a cross-section transverse to the longitudinal axis of the receptacle that is essentially concave in shape. In other words, the receptacle is embedded as a essentially concave portion in the lower limitation. The lower limitation may thus have a surface having a first horizontal surface portion adjacent or contiguous to a first of the side walls and a second horizontal surface portion adjacent or contiguous to the second of the side walls, the receptacle being disposed as a essentially concave surface portion between the first and second surface portions.

The receiving device for the screw housing enables the dosing device to be held particularly securely and firmly in the dosing device receptacle. After insertion and reception of the dosing device, the screw conveyor housing lies firmly in the receptacle for the screw housing, with two of the ribs resting firmly on the first and second horizontal surface sections. At the same time, the outlet opening in the screw conveyor housing is disposed above or adjacent or contiguous to the receptacle outlet opening. Thus, the powder detergent can be conveyed from the conveying screw housing through the outlet opening in the conveying screw housing and the receptacle outlet opening in the receptacle in the dosing device receptacle, and can be fed into a container or cup or into the detergent chamber of a washing machine without the powder detergent coming into contact with the housing.

Preferably, the drive shaft is formed in or on the rear wall, with the drive shaft and the receptacle extending in a plane transverse to the lower limitation.

The coupling element or drive shaft is preferably arranged in or on the rear wall. The distance between the lower limitation and the coupling element or the drive shaft, as viewed in a plane transverse to the longitudinal direction of the receptacle, may correspond to the distance between the first cylindrical cavity and the peripheral wall of the screw conveyor, as viewed in a plane transverse to the longitudinal direction of the screw conveyor. By inserting the dosing device into the receptacle for the screw conveyor housing as previously described, the coupling element or drive shaft can automatically engage the (cylindrical) cavity in the screw conveyor housing. In this way, the screw conveyor can be driven.

Preferably, the one or more side walls of the container receiving area comprise a plurality of ribs which extend away from the one or more side walls.

The plurality of ribs preferably extends essentially parallel to the upper and/or lower limitation. Preferably, the plurality of ribs extends essentially from the open front to the rear wall. However, it is also conceivable that the ribs are arranged transversely to the upper or lower limitation and/or that the ribs do not extend continuously from the front side to the rear wall.

The plurality of ribs is preferably arranged in pairs on the two side walls. In other words, two ribs each extend in a plane transverse to the side walls and/or parallel to the upper or lower limitation. In this way, numerous pairs of ribs can be arranged on the side walls in the container receiving area, preferably between the guide elements and the upper limitation. Preferably, the ribs of a pair of ribs are each spaced between approximately 40 and 50 mm apart, and further preferably the ribs of a pair of ribs are each spaced approximately 50 mm apart. It is also conceivable that not all ribs of the rib pairs have the same distance from each other, but can have a different distance from each other, preferably between approximately 40 and 50 mm.

The ribs enable optimal alignment of the first container received in the first receiving area, so that the powder detergent can be fed and/or dosed from an outlet in the first container through the inlet opening of the screw conveyor housing. At the same time, this prevents powder detergent from remaining in the first container and from being used for washing. Thus, the ribs allow a plurality of differently shaped first containers to be easily and safely picked up, and thereby brought into a certain desired shape so that the powder can shift in the direction of the outlet. The first container is thereby held in a position, in particular in an upright position, in which it does not collapse.

According to another aspect of the invention, there is provided a container for receiving and dosing powder detergent, the container comprising a housing having an interior space for receiving powder detergent, and an outlet in communication with the interior space connectable to an inlet of a dosing means, the dosing means having an outlet such that actuation of the dosing means delivers a dose of the powder detergent through the outlet. Preferably, the container is designed to be inserted into and at least partially received by a detergent dosing device.

Preferably, the container for holding and dosing powder detergent and/or the dosing device are interchangeable and designed as a disposable article and/or the container for holding and dosing powder detergent is available prefilled with powder detergent. The container can be supplied filled with the powder detergent factory, i.e., the container can be filled with powder detergent at the factory so that the container can be supplied to the consumer already filled with powder detergent.

The container can be designed to be inserted as a first container into the first receiving area of the previously described device for dosing detergent and to be at least partially received therein. Thus, all previously described features of the device described in connection with the first container and/or the dosing device also apply to the container described below (hereinafter further referred to as first container) for receiving and dosing powder detergent.

The first container can have a dosing device to which the first container can be connected and can thus be connected so that the correct amount of powder detergent can be dispensed and thus dosed with the first container and the dosing device. However, it is also conceivable that the first container and the dosing device are two separate elements. By the first container having an outlet with an outlet opening, powder detergent accommodated in the first container can exit or be dispensed from the first container. By the outlet being connectable to the inlet of a dosing device, the powder detergent exiting the first container can be introduced through the inlet of the dosing device. By actuating the dosing device, the powder detergent can then exit from a second outlet in the dosing device and be used for washing in the predetermined or predeterminable dosage.

Thus, with the first container described, a correct dosing of the powder detergent can be carried out by means of the dosing device. The dosing device can be driven by an actuating and/or drive device. However, it is also conceivable that the dosing device is driven manually. This enables the detergent to be dosed correctly and in a simplified manner.

Furthermore, the first container can have a dosing device to which the first container can be connected and can thus be connected so that the correct amount of powder detergent can be dispensed and dosed with the first container and the dosing device. For this purpose, the first container connected to the dosing device can also be inserted and received in the first receiving area, in particular in the container receiving area and the dosing device receiving area of the previously described device for dosing detergent. However, it is also conceivable that the first container and the dosing device are two separate elements, each of which is inserted and received separately in the first receiving area, in particular in the container receiving area and in the dosing device receiving area.

Thus, a correct dosing of the powder detergent from the first container can be performed by means of the dosing device. The dosing device can thereby be driven by an actuating and/or driving device, which is arranged, for example, in a dosing device receiving area in the previously described device. However, it is also conceivable that the dosing device is driven manually. The powder detergent can be filled from the first container into a container, for example a cup, so that the powder detergent can be introduced in a correct dosage into a detergent chamber of a washing machine. This enables laundry to be washed with a correctly dosed amount of detergent.

Preferably, the dosing device comprises a screw conveyor and a screw conveyor housing, wherein the screw conveyor, preferably in its full length, is insertable into the screw conveyor housing and is rotatably arranged so that the screw conveyor and the screw conveyor housing extend around a common screw conveyor longitudinal axis, and wherein the inlet of the dosing device is arranged in or at the screw conveyor housing.

Thus, the design of the dosing device enables the powder detergent to be fed from the first container into the dosing device and to be transported along the longitudinal axis of the screw conveyor by means of the screw conveyor in the screw conveyor housing. A specific amount of powder can be conveyed with each rotation of the screw conveyor, so that the dosage of the powder detergent can be determined by the number of revolutions. This enables precise and simplified dosing of the powder detergent, which can be carried out automatically, for example controlled by a control or regulating unit, or manually by an operator.

The first container is connectable to a dosing device comprising a screw conveyor and a screw conveyor housing. The screw conveyor and the screw conveyor housing can thereby have all the features previously described in the context of the device for dosing detergent, so that the dosing device can be received in the first receiving area or in the dosing device receiving area of the device as previously described.

It is conceivable that the dosing device comprises a plate, which is preferably designed as a stand plate and is arranged on the screw conveyor housing. This stand plate serves to better position the first container and/or to protect it from falling over, in particular when the first container for holding powder detergent is positioned outside the device for dosing detergent. The plate may be firmly connected to the screw conveyor housing, or the plate may be connectable to the screw conveyor housing. Thus, after the powder detergent has been received, the plate may be removed from the screw conveyor housing so that the first container and/or the dosing device may be received by the first receptacle of the detergent dosing device. It is further conceivable that the screw conveyor housing comprises an enclosure, wherein the enclosure comprises at least one flat surface that serves as a standing plate so that the first container can be better positioned and protected from falling over. Preferably, the outlet of the first container is firmly connected to the inlet in the screw conveyor housing, in particular screwed and/or glued.

The first container can be connected to the screw conveyor housing so that powder detergent can be introduced from the first container into the screw conveyor housing and/or discharged from it, in the correct dosage. The outlet of the first container can be firmly connected (e.g., glued) to the inlet of the screw conveyor housing. To this end, for example, the outlet of the first container may have a peripheral wall similar to the peripheral wall of the flange disposed on the screw screw housing. In particular, the peripheral wall of the container outlet may have a cross-sectional profile similar to the cross-sectional profile of the peripheral wall of the flange, but with the periphery of the peripheral wall of the container outlet being slightly larger or slightly smaller than the periphery of the peripheral wall of the flange. Thus, the peripheral walls can be brought into an overlap and/or firmly joined (e.g., glued and/or welded) to each other.

However, it is also conceivable that the outlet of the first container is bolted to the inlet in the screw conveyor housing. Thus, the peripheral wall of the flange on the screw conveyor housing can comprise a first drive profile and the peripheral wall of the container outlet can comprise a second drive profile. Preferably, the first container and the dosing device can be positively connected to each other in a rotationally fixed manner via the two drive profiles. For example, the outer contour of the peripheral wall of the flange on the screw conveyor housing can have a drive profile and the inner contour of the peripheral wall of the container outlet can have a corresponding drive profile, so that the peripheral walls can be connected to one another in a form-fitting, rotationally fixed manner, in particular. Any structure that enables a connection between the first container and the dosing device can serve as a drive profile. The drive profile can be correspondingly polygonal, star-shaped, slot-shaped, etc.!

Preferably, the screw conveyor housing is integrated into the first container.

By integrating the screw conveyor housing into the first container, the first container and the screw conveyor housing can be integrally or one-piece connected to each other, so that the first container and the dosing device are in particular firmly and non-detachably connected to each other. It is conceivable that in particular the peripheral wall of the container outlet and the peripheral wall of the flange on the screw conveyor housing are integrally formed with one another.

Preferably, the first container has at least partially a tapered portion, wherein the periphery of the first container preferably decreases essentially conically in the tapered portion toward the outlet.

The first container may have a cross-section in a plane through the longitudinal axis of the screw conveyor housing as viewed in the state connected to the first container, the tapered portion being laterally limited by a first side edge and a second side edge. When "connected to the first container" means that the dosing device or screw conveyor housing is connected to the screw conveyor and the first container. The first side edge may extend essentially transversely, preferably at an angle less than 90°, more preferably at an angle of approximately 45°, with respect to the longitudinal axis of the screw conveyor housing (as viewed in the connected condition). The second lateral edge may extend essentially transversely, preferably at an angle less than approximately 90°, particularly preferably at an angle of approximately 45°, to the longitudinal conveying screw axis of the conveying screw housing. It is also conceivable that both side edges extend essentially transversely, preferably at an angle less than approximately 90°, particularly preferably at an angle of approximately 45°, to the screw conveyor longitudinal axis of the screw conveyor housing. This arrangement of the side edges relative to the longitudinal conveying screw axis of the conveying screw housing (as seen in the connected state) makes it particularly easy to empty the powder detergent from the first container.

Preferably, the second side edge forms an angle of approximately 45° with the first side edge. Due to this design, the periphery of the first container is successively reduced in the tapering section towards the outlet. This enables for a particularly efficient discharge of the powder detergent contained in the first container from the outlet and its subsequent introduction into the inlet of the screw conveyor housing.

Preferably, the first container at least partially comprises a first essentially symmetrical portion, wherein the periphery of the first container remains the same within the first essentially symmetrical portion, and wherein preferably the first essentially symmetrical portion is spaced further from the outlet than the tapered portion.

The first container may have a cross-section in a plane through the screw conveyor longitudinal axis of the screw conveyor housing as viewed in the connected condition with the first container, wherein the first essentially symmetrical section is laterally limited by a first side edge and a second side edge oriented essentially parallel to each other and thus essentially transverse, preferably at an angle of approximately 90°, to the screw conveyor longitudinal axis of the screw conveyor housing (as viewed in the connected condition). The first side edge of the first essentially symmetrical section may be coplanar with the first side edge of the tapering section, and/or the second side edge of the first essentially symmetrical section may be oriented transversely to the second side edge of the tapering section. However, it is also conceivable that the second side edge of the first essentially symmetrical section extends in the same plane as the second side edge of the tapering section, such that another tapering section is formed instead of the symmetrical section.

Preferably, the distance between the first and second side edges of the symmetrical section is at most approximately 140 mm and/or the length of the two side edges is at most approximately 155 mm. Particularly preferably, the distance between the first and second side edges of the symmetrical section is greater than 100 mm and less than 140 mm, and further preferably, the distance between the first and second side edges of the symmetrical section is 125 mm. This enables for approximately 1.35 kg of powder detergent to be contained in the first container. Furthermore, the first container can hold a powder detergent having a detergent density that is between 0.3 kg/L (L denotes liter) and 0.8 kg/L, more preferably the detergent density is between 0.6 kg/L and 0.8 kg/L. Due to the design of the first container, which enables a receiving of approximately 1.35 kg of powder detergent, approximately 4.5 L of a detergent with a detergent density of approximately 0.3 kg/L can be received. Furthermore, approximately 2.25 L of detergent with a detergent density of approximately 0.6 kg/L can be taken up and approximately 1.69 L of detergent with a detergent density of approximately 0.8 kg/L. It is also conceivable that the length of the first side edge is longer than the length of the second side edge. Thus, the length of the first side edge may be a maximum of approximately 155 mm and/or the length of the second side edge may be a maximum of approximately 125 mm.

This embodiment further enables a particularly efficient discharge of the powder detergent received in the first container from the outlet and subsequent introduction into the inlet of the screw conveyor housing. At the same time, the symmetrical section enables alternative configurations of an inlet for receiving powder detergent into the first container.

Preferably, the first container has a second essentially symmetrical portion adjoining or near to the outlet, wherein the periphery of the first container remains the same within the second essentially symmetrical portion and essentially corresponds to the periphery of the outlet and/or an outlet opening in the outlet.

The first container may have a cross-section in a plane through the screw conveyor longitudinal axis of the screw conveyor housing as viewed in the connected condition with the first container, the second essentially symmetrical section being laterally limited by a first side edge and a second side edge oriented essentially parallel to each other and thus essentially transverse, preferably at an angle of approximately 90°, to the screw conveyor longitudinal axis of the screw conveyor housing (as viewed in the connected condition). The first side edge of the second essentially symmetrical section may be coplanar with the first side edge of the tapered section and with the first side edge of the first essentially symmetrical section, and/or the second side edge of the second essentially symmetrical section may be oriented transversely to the second side edge of the tapered section and parallel to the second side edge of the first essentially symmetrical section.

Preferably, the distance between the first and second side edges of the second symmetrical section is in the range of approximately 20 mm to 60 mm (e.g., approximately 50 mm) and/or the length of each of the two side edges is in the range of approximately 10 mm to 110 mm (e.g., approximately 15 mm or 90 mm each).

Preferably, the second essentially symmetrical section is connected to the outlet such that further preferably the diameter of the outlet or the passage of the outlet opening corresponds to the distance between the first and second side edges of the second symmetrical section.

This embodiment further enables a particularly efficient discharge of the powder detergent received in the first container from the outlet and subsequent introduction into the inlet of the screw conveyor housing.

However, it is also conceivable for the first container to have another essentially symmetrical section in place of the tapered section. In this case, the first side edges of the three sections may extend in a plane and the second side edges may extend in a plane, the two planes being essentially parallel to each other.

Preferably, the first container has an inlet opening, the inlet opening preferably being located essentially opposite the outlet and/or an outlet opening in the outlet.

Preferably, the inlet opening may be disposed in the first essentially symmetrical section. Further preferably, the inlet opening may be disposed adjoining or near to a side edge extending between the first and second side edges of the first essentially symmetrical portion. Preferably, the inlet opening is disposed at a first free end of the first container opposite a second free end of the first container, the outlet and the outlet opening being disposed at the second free end. The tapered portion may be disposed between the inlet or inlet opening and the outlet or outlet opening.

Powder detergent can be received in the first container through the inlet opening. Due to the arrangement of the inlet opening opposite to the outlet, the powder detergent can be guided towards the outlet and the outlet opening and can be guided from the first container into the dosing device. This enables for proper dosing of the powder detergent. Preferably, the inlet opening can be closed by means of a closure element, further preferably by means of a zipper or zipper.

However, it is also conceivable that the first container has no inlet opening and is integrally or firmly connected to the dosing device. The first container and the dosing device can be integrally connected to each other as a unit and filled with powder detergent.

Preferably, the inlet opening extends adjoining or near the first free end between the first and second side edges of the first essentially symmetrical portion. Preferably, the inlet opening is closable by a closure member. Thus, the first container is advantageously reusable and/or powder detergent can be refilled after it has been completely emptied and/or the first container can be resealed after a transfer of powder detergent. However, it is also conceivable that the first container is not reusable and does not have a closure element, since the inlet or the inlet opening is welded after the powder detergent has been received. It is also conceivable that the first container does not have an inlet or inlet opening, however that the powder detergent is first received into the first container through the outlet or outlet opening, and the outlet is then connected to the dosing device. In particular, after receiving the powder washing detergent, the outlet may be connected to the inlet of the dosing device by means of a connecting element, for example an adhesive element in the form of an adhesive strip, or a clip. In this case, one and the same opening serves to receive the powder washing detergent into the first container and to remove the powder washing detergent from the first container.

Thus, the first container with powder detergent can be supplied already connected to the dosing device and is designed as a disposable article. It is also conceivable that the dosing device, which is connectable to the first container, is designed as a reusable article. In particular, if the dosing device and the first container are integrally formed with each other or are bonded or screwed together, the dosing device can be designed as a disposable or single-use-article.

The closure element can be designed as a zipper that is easy to open and close. However, it is also conceivable that instead of the zipper or in addition to the zipper, a rail is arranged at the first free end of the first container. This rail can be used to connect the first container to an upper region of the first receiving region. It is also conceivable that one or more magnetic holders, one or more Velcro fasteners, one or more buttons, and/or one or more adhesive strips or other types of fasteners can be used to connect the first container to the upper region of the receiving region. It is further conceivable that the first container comprises a first screw element and the upper region of the first receiving region comprises a second screw element, such that the first container is connectable to the upper region of the receiving region by means of the screw elements.

A tab may be disposed adjoining or near to the closure element. The tab may have an inner opening. The inner opening may be configured as a carrying handle, so that the first container can be carried or held from one location to another location in a simplified manner. However, the inner opening may also serve to be hooked or hooked into a hook, for example, thereby providing additional stability, particularly when filling the first container. Preferably, the closure element, preferably the zipper, is designed to be inserted into a groove in a first receiving area of a device for dosing detergent.

The closure element or zipper may be designed to be (at least partially) inserted into a groove. Preferably, the closure element or zipper is designed to be inserted into a groove arranged in the first receiving area, in particular on the inner side of the upper limitation facing the lower limitation. The groove may extend in essentially the same plane as the drive shaft in the dosing device receiving area, and as the screw conveyor longitudinal axis of the screw conveyor housing when inserted into the device. Preferably, the groove extends at least partially in the upper limitation. Further preferably, the groove extends from a region adjoining or near the open front to a region adjoining or near the rear wall. This enables for easy insertion of the first container and/or dosing device into the first receiving area of the detergent dosing device, with the dosing device being received by the receiving means in the lower limitation and the cylindrical cavity of the dosing device being able to engage with the drive shaft in the drive device. At the same time, the closure element or zipper can be inserted into the groove, providing additional support for the first container, in addition to the lateral ribs.

The first container may be formed of various materials and may comprise, for example, paper, plastic, or other flexible materials for holding powdered materials such as powder detergent. Further, the first container may be formed as a bag or pouch. However, it is also conceivable that the first container is formed of a non-flexible material and is thus dimensionally stable, and may comprise, for example, a metal such as aluminum or a plastic. For example, the first container may also be formed as a cardboard box, such as a Tetra Pak. In particular, when the first container is formed of a non-flexible material, instead of having closed side walls and a plurality of ribs which extend away from the side walls, the second receiving portion may have two open sides disposed on opposite sides of the receiving longitudinal axis.

The first container can have a capacity volume of approximately 1.25 dm3 to 2.5 dm3. This capacity enables up to 3 kg of powder detergent to be accommodated, where 1 kg of powder detergent corresponds approximately to a volume of 1.25 dm3. Thus, the holding volume of 1.25 dm3 to 2.5 dm3 enables convenient filling and/or decanting of powder detergent.

Preferably, the housing of the device for dosing detergent comprises at least one second receiving area, wherein the at least one, second receiving area is designed to receive a second container for a liquid detergent.

Preferably, the first receiving area is connectable to the second receiving area or the first receiving area is connected to the second receiving area. It is also conceivable that the first and second receiving portions are integrally connected to each other. Thus, the device for dosing detergent agent can comprise at least one first container for a powder washing detergent and at least one second container, so that the device can be designed for dosing powder washing detergent and/or liquid washing detergent. This enables a particularly simple changeover between powder and liquid detergent. Furthermore, the fact that several first containers and several second containers can be provided means that different detergents can be used in a simple manner, for example mild detergent, normal detergent, fabric softener, wool detergent, detergent for black clothing, hygiene detergent or color detergent.

It is conceivable that the data of the scale described later are sent to all connected recording areas (dosing device). This can take place depending on which "start button"/activation button (can be stored differently) the user of the device presses, whereby the respective dosing device (different detergents) is then set in motion.

The various holding areas can be of modular design, so that several holding areas can be combined with each other, e.g. a holding area for powder heavy-duty detergent, a holding area for powder fine detergent, and a holding area for liquid wool detergent, etc.

The coupling of the different recording areas with each other can be done, for example, via WLAN, Bluetooth, or cable etc.! The connection via Bluetooth or WLAN could be carried out automatically by the device if two recording areas are adjoining or near or next to each other or close to each other. The recording areas may be configured to be able to communicate with each other and with connected/connected devices once connected to each other. This coupling should make it so that only one connection is needed from the device (can be multiple recording areas) to the scale and/or to the smartphone or tablet or computer. In other words it is not necessary to connect each recording area to the smartphone via WLAN or Bluetooth, however only to connect to the overall device. This saves setup time. It is also conceivable that the scale automatically connects to the device via WLAN or Bluetooth without the user having to do this manually/separately.

The first receiving area and the second receiving area may be connectable to each other. In other words, it may be provided that the receiving areas can be connected to each other and disconnected from each other again. Thus, the device for dosing detergent can be enlarged or reduced in a particularly simple manner in which a plurality of first receiving areas and/or a plurality of second receiving areas can be interconnected. This can be done, for example, by means of a click mechanism which can be arranged on the outer walls, for example the lateral outer walls, of the receiving areas. In this way, a plurality of receiving areas can be interconnected or combined depending on the desired number of detergents to be used.

Preferably, the second receiving area has a rear wall, two spaced side walls oriented at an angle different from 0° or 180°, in particular essentially transverse to the rear wall, a lower limitation oriented at an angle different from 0° or 180°, in particular transverse to the side walls, and an open upper opposite the lower limitation, the second receiving area for receiving the second container being formed between the side walls.

The second receiving area may comprise an open top. In other words, the top surface may be completely open. This enables the second container to be inserted into the second receiving area by a essentially perpendicular movement to the lower limitation, such that the second container can be received by the second receiving area. However, it is also conceivable that the second receiving area has an upper limitation in which a through-hole or opening is arranged through which the second container can be inserted into the second receiving area by an essentially perpendicular movement to the lower limitation.

The second receiving area can have a front side opposite the rear wall, which can preferably comprise a window element, for example a window element made of glass or plastic, or a flap or closure flap. This enables an easy control of the filling level of the second container through the front side. However, it is also conceivable that the front side is formed as a front wall which, like the rear wall, is closed and has no opening. The open front side of the first receiving area can also be closed by means of a flap or closure cap, preferably in a manner analogous to the closure flap of the second receiving area. In this way, the first receiving area can be protected from dust or dirt after the first container has been inserted and received by closing the closure flap.

Preferably, the at least one, second receiving area is designed to receive a lifting system for dosing liquid detergent.

By means of the lifting system, a pressure can be exerted on the second container for a liquid detergent, for example with the aid of a pump mechanism, so that the liquid detergent can be dosed correctly. However, it is also conceivable that a pressure can be exerted on the second container by means of a rotating mechanism or another mechanism, so that the liquid detergent can be dosed correctly and in a particularly easy-to-implement manner. The second receiving area is designed in such a way that it can also receive the lifting system in addition to the second container.

Preferably, the lifting system is connected or connectable to the second container.

The lifting system can be firmly connected to the second container. In other words, the lifting system can be integrated into the second container and offered or supplied integrated in this way. However, it is also conceivable that the lifting system and the second container are two separate elements that can be combined or connected with each other so that a dosing of the detergent can be performed from the second container. For example, the lifting system may be connected or connectable to an opening of the second container, for example to the inlet or outlet of the second container. Like the second container, the lifting system may be interchangeable and may be a disposable or single-use-article.

Preferably, the lifting system is connected or connectable to the outlet of the second container. Thus, by actuating the lifting system, the detergent can be pumped from the second container and precisely dosed. Preferably, the lifting system is connected or connectable to a container or cup or to the detergent chamber of a commercially available washing machine, for example via a hose system. Thus, the correctly dosed detergent can be filled into the container or cup or directly into the detergent chamber of a commercial washing machine.

Preferably, the container or cup or detergent chamber is arranged below the lifting system connectable or connected to the second container in the direction of gravity. Preferably, the lifting system is arranged or positioned between the container or cup or detergent chamber and the second container in the direction of gravity. Thus, the detergent can be easily guided from the second container in the direction of the lifting system by gravity and pumped from the second container into the container or cup or detergent chamber, so that the detergent can be guided into the container or cup or detergent chamber in a particularly simple manner.

Preferably, the lifting system has a piston and a rotary plate.

It is conceivable that the lifting system can dose the liquid detergent by means of a piston pump. Thus, the lifting system can comprise a rotary plate which is driven by means of a motor and can exert a pressure on a piston. The piston may be connectable or connected to the second container such that the piston may be deflected or moved by the rotary plate. Preferably, the rotary plate is arranged above the piston in the direction of gravity so that the motor can drive the rotary plate and set it into a rotational movement. This rotatory movement sets the piston into a translatory movement. Thus, the piston can be pushed downwards in the direction of gravity towards the second container so that the detergent can be pumped out of the second container and dosed correctly. Thus, by deflecting or moving the piston, the liquid detergent can be easily pumped from the second container and properly dispensed. One revolution of the motor can result in multiple stroke movements. In other words, one revolution of the motor can result in multiple combined rotational and translational movements of the rotating plate and piston.

Preferably, the rotating plate is designed as an eccentric or as a control disk, which is mounted on a shaft and whose center lies outside the shaft axis. Preferably, the piston is arranged below the eccentric in the direction of gravity and outside, preferably above or below in the direction of gravity, the shaft axis. In this way, the rotational movement of the eccentric can be advantageously converted into the translational movement of the piston or into the piston stroke.

Preferably, the second receiving area has a lifting system receiving area.

The stroke system receiving area is designed to accommodate the motor and/or the rotating plate and/or the piston. It is conceivable that the motor and/or the rotating plate and/or the piston are firmly connected to the lifting system receiving area. These can be arranged, for example, on the rear wall of the second receptacle area and/or on its side walls. The second container can then be inserted and inserted into the second receiving area in such a way that the rotary plate and/or the piston can interact or interact with the second container in the lifting system receiving area. Thus, by means of the rotary plate and the piston, the detergent can be pumped from the second container and dosed correctly firmly connected to the second container, and are interchangeable together with the second container. Thus, the motor and/or the rotating plate and/or the piston can be inserted together with the second container into the lifting system receiving area, so that the detergent can be pumped and dosed from the second container.

Preferably, the lifting system is designed to dispense a fill of approximately 5 ml of liquid detergent in approximately 0.4 seconds. Particularly preferably, the lifting system is operated at a frequency of 2.5 Hz. In other words, approximately 2.5 fillings per second are thus dosed with the lifting system. Depending on the detergent manufacturer or the type of detergent, the hardness of the water, the load of the washing machine drum or the drum size, or the degree of soiling of the laundry, from 20 ml to 340 ml (0.4 sec per stroke) can be dosed by means of the lifting system. This requires approximately 4 to 68 strokes, which take place in a time period of approximately 1.6 to approximately 27.2 seconds.

Further preferably, the stroke system is designed to dispense a fill of approximately 10 ml of liquid detergent in approximately 0.8 seconds. This requires approximately 2 to 32 strokes, which take place in a time period of approximately 1.6 to approximately 27.2 seconds.

Preferably, the lifting system has a sensor.

The sensor may be firmly connected to the lifting system receiving area. By means of the sensor, the level of the liquid detergent in the second container can be determined when the second container is inserted into the second pick-up area. The sensor may be connected to application software, such as a mobile app as described later, in such a way that new liquid detergent can be automatically ordered on the Internet based on the level of the liquid detergent.

It is also conceivable that the fill level of the liquid detergent is determined using the initial volume or weight of the detergent, which corresponds, for example, to the volume or weight of the commercial detergent container that has not yet been opened (and contains detergent). The data on the volume or weight of the commercial detergent container not yet opened (and containing detergent) may, for example, be stored in and taken from a database or an app. The device may comprise a processor which, based on the initial volume or weight of the detergent container (which has detergent) and the number of doses, can determine or calculate the consumption of the detergent. Based on these determined or calculated values, detergent can be automatically reordered by the system. For this purpose, the system can have a memory unit in which the washing frequencies are stored. This enables an order to be triggered, taking delivery times into account. In this way, the user no longer needs to pay attention to how much detergent he still has. This is automatically delivered without the user having to specifically place an order and without the user having to buy the detergent in the supermarket.

Preferably, the lifting system has a dosage setting for dosing detergent, which depends on a determined weight of a laundry to be washed.

In other words, the amount of detergent dosed from the second container can be made dependent on the weight of the laundry to be washed. The weight of the laundry can be determined, for example, by means of a scale as described later. For example, the scale may be coupled to the device for dosing detergent in such a way that the weight is transmitted to a control unit, which may be part of the device, which in turn controls the dosing of detergent from the second container based on this transmitted weight.

Preferably, a plurality of clamping elements is arranged adjoining or near to the side walls of the second receiving area, which clamping elements extend at least partially between the front side, which is opposite the rear wall, and the rear wall of the second receiving area. Preferably, the clamping elements are designed as clamps. In each case, two of the clamps can be arranged opposite one another and in a plane parallel to the lower limitation of the second receiving area.

Particularly preferably, at least two clamping elements, preferably three clamping elements, are arranged adjoining or near to one of the two side walls of the second receiving area and at least two clamping elements, preferably three clamping elements, are arranged adjoining or near to the other of the two side walls of the second receiving area. In other words, the second receiving area preferably comprises up to six clamping elements, two of the six clamping elements being arranged opposite each other as a pair of clamping elements in a plane parallel to the lower limitation of the second receiving area. Preferably, the second receiving area comprises up to three clamping element pairs. However, it is also conceivable that the second receiving area has more than three clamping elements adjoining or near to the two side walls, so that the second receiving area has more than six clamping elements and thus more than three pairs of clamping elements.

The clamping elements or the pairs of clamping elements enable dosing of the liquid detergent inside the second container or from the inside of the second container. The clamping elements or the pairs of clamping elements allow the desired or correct dosage of the liquid detergent to be clamped inside the second container. This is advantageous because expensive peristaltic pumps, flow sensors, etc. can be dispensed with. It is also conceivable that the second receptacle area has four clamping elements and correspondingly two pairs of clamping elements.

At this point, it should be noted that, in an analogous manner, the dosing of the powder detergent inside the first container can be performed by means of a plurality of clamping elements or by means of pairs of clamping elements, as will be described in connection with the second container and the dosing of the liquid detergent below. In other words, the dosing of the powder detergent inside the first container may not be carried out by means of the screw conveyor and the screw conveyor housing, however clamping elements or clamps may be provided adjoining or near to the side walls of the first receiving area for the dosing of the powder detergent, by means of which the powder detergent may be correctly dosed.

By inserting the second container through the open top into the second receiving area, the second container is received by the second receiving area such that the second container can be held and/or clamped laterally by the up to three pairs of clamping elements. The pairs of clamping elements clamp the liquid detergent inside the second container. Due to the fact that the pairs of clamping elements are arranged displaceably on the side walls of the second receptacle, the liquid detergent can be dosed by displacing the clamping elements or pairs of clamping elements. Thereby, the up to three clamping element pairs can assume at least one position, in particular a first position and a second position. In the first position, the up to three pairs of clamping elements can be laterally adjacent to the second container and/or contact the second container such that the pairs of clamping elements can exert a pressure on the side walls of the second container, in particular on two opposite side walls of the second container. In the second position, the up to three pairs of clamping elements cannot be adjoining to the container and/or cannot contact the second container such that the pairs of clamping elements cannot exert pressure on the side walls of the second container.

The first position and the second position of the at least one pair of clamping elements allow the position of the clamping elements to be changed or moved relative to the side walls of the second receiving area. Thus, the position of the clamping elements may also be changeable relative to the side walls of the second container when the second container is received in the second receiving area. The arrangement of the pairs of clamping elements prevents the second container and/or the liquid detergent inside the second container from coming into contact with the side walls of the second receiving region when the second container is received in the second receiving region. This reduces fouling of the side walls of the second receiving portion by insertion of the second container, as well as contamination of the liquid detergent inside the second container.

A first of the pairs of clamping elements may be arranged such that the clamping elements of the first pair of clamping elements have a first distance from the lower limitation. A second of the pairs of clamping elements may be arranged such that the clamping elements of the second pair of clamping elements have a second distance to the lower limitation that is greater than the first distance to the lower limitation. The first pair of clamping elements may thus be arranged as a lower pair of clamping elements adjoining or near to the lower limitation in the second receiving region. The second pair of clamping elements may be arranged as an upper pair of clamping elements adjoining or near to the open top. Further, a third of the pairs of clamping elements may be disposed as a middle pair of clamping elements between the first pair of clamping elements and the second pair of clamping elements and have a third distance from the lower limitation that is greater than the first distance and less than the second distance.

The first, lower pair of clamping elements may have a first distance from the lower limitation that is between 10 mm and 30 mm, preferably approximately 20 mm. The second, upper pair of clamping elements may have a second distance from the lower limitation that is between 160 mm and 240 mm, preferably approximately 180 mm. Preferably, the distance between the first, lower clamping element pair and the second, upper pair of clamping elements may be between 140 mm and 220 mm, preferably approximately 160 mm. The third, middle pair of clamping elements may be arranged between the first, lower pair of clamping elements and the second, upper pair of clamping elements so that it is displaceable in a range between 10 mm and 30 mm, preferably approximately 20 mm, and a range between 160 mm and 240 mm, preferably approximately 180 mm, from the lower limitation.

The first, lower pair of clamping elements can, when the second container is received in the second receiving region, exert a pressure on or clamp the side walls of the second container such that the second container is sealed and no liquid detergent can escape from the second container, for example through an outlet opening in the second container, when the second container is received in the second receiving region. The first, lower pair of clamping elements can thus seal the second container in a sterile manner so that no bacteria or germs can enter the second container, for example through the outlet opening in the second container. The second, upper pair of clamping elements can apply pressure to, or clamp, the side walls of the second container such that the second container is sealed and no liquid detergent can escape from the second container and/or from a liquid detergent reservoir connectable to the second container, for example through an inlet opening in the second container, when the second container is received in the second receiving region. The second, upper pair of clamping elements can thus sterilely seal the second container so that no bacteria, germs or contamination can enter the second container, for example through an inlet opening in the second container.

The first, lower pair of clamping elements and the second, upper pair of clamping elements close off the area inside the second container and store the liquid detergent so that an unintentional leakage of the liquid detergent from the second container can be prevented. The third, middle pair of clamping elements is provided for dosing the liquid detergent inside the second container between the first, lower pair of clamping elements and the second, upper pair of clamping elements.

Preferably, the first, lower pair of clamping elements and the second, upper pair of clamping elements are arranged such that the two pairs of clamping elements limit an area of the second container which delimits a liquid detergent amount of approximately 180 ml to 250 ml in the second container. This makes it possible to dispense a liquid detergent amount of up to approximately 250 ml. However, it would also be conceivable that the first, lower pair of clamping elements and the second, upper pair of clamping elements are arranged such that the two pairs of clamping elements limit an area of the second container that limits a liquid detergent amount of more than 250 ml, preferably of more than 250 ml and up to approximately 500 ml or more than 500 ml and up to 750 ml, in the second container. Thus, an amount of liquid detergent suitable for more than one washing machine load could also be provided or dispensed. Thus, multiple washing machine loads could be washed in sequence.

Preferably, the distance of the clamping elements is variable relative to the lower limitation and/or relative to the open top.

Preferably, the third, middle pair of clamping elements is height-adjustable. In other words, the third distance to the lower limit is variable. This enables precise dosing of the desired amount of liquid detergent. It is further conceivable that the first, lower pair of clamping elements and the second, upper pair of clamping elements are also height-adjustable, so that the first and second distance to the lower limitation are variable. This enables the two pairs of clamping elements to be adapted to the size or volume of the second container, so that second containers of different sizes can be received by the second receiving area and can be held or limited laterally by the first, lower pair of clamping elements and by the second, upper pair of clamping elements, so that the liquid detergent can be correctly dosed inside the second container.

Provided that the second receiving area has four clamping elements and correspondingly two pairs of clamping elements, one of these pairs of clamping elements would correspond to the second, upper pair of clamping elements as previously described.

Preferably, each of the clamping members comprises a first clamping member surface and a second clamping member surface, the clamping member surfaces being disposed on opposite sides of a longitudinal clamping member axis.

The first clamping element surface and the second clamping element surface may be disposed essentially parallel to each other and may each extend between a first end and a second end. The first clamping element surface may extend in a first plane and the second clamping element surface may extend in a second plane, wherein the first plane and the second plane are aligned parallel to each other and/or wherein the longitudinal clamping element axis is disposed in a plane between the first plane and the second plane. The width of the two clamping element surfaces, i.e., the width of the two clamping element surfaces at an angle different from 0° or 180°, in particular essentially transverse to the longitudinal clamping element axis, tapers from the first end toward the second end. Further, each of the clamping elements may comprise a connecting plate disposed at an angle different from 0° or 180°, in particular essentially transverse to the longitudinal axis of the clamping element. The first clamping element surface may be connectable to the connecting plate by means of the first end, and the second clamping element surface may be connectable to the connecting plate by means of the first end. The connecting plate is configured to connect the individual clamping elements to the second receiving area. In particular, the connecting plate may be connectable to the rear wall of the second receiving area such that the clamping elements extend essentially transversely to the rear wall at an angle different from 0° or 180°, in particular essentially transversely away such that the second ends of the clamping element surfaces are spaced from the rear wall. Preferably, the connecting plate of each of the individual clamping elements is connected to the rear wall adjoining or near to one of the side walls of the second receptacle area so that the clamping elements extend along the side walls between the front wall and the rear wall. This enables the second container to be held between the individual clamping elements of the pairs of clamping elements after being received in the second receiving area, and enables the liquid detergent to be dispensed inside the second container. Due to the fact that the width of the two clamping element surfaces tapers towards the second end in each case, the individual clamping elements can be brought from the first position into the second position particularly easily. However, it is also conceivable that the individual clamping elements are not connected to the rear wall by means of a connecting plate, however that the clamping elements are arranged or connectable displaceably to the rear wall and/or to the side walls of the second receiving area by means of a carriage or by means of a rail or guide rail element.

Preferably, the two clamping element surfaces are connected by means of a third clamping element surface, the third clamping element surface having a essentially conically shaped cross-section essentially transverse to the longitudinal clamping element axis.

The third clamping element surface may extend from a first side edge of the first clamping element surface to a first side edge of the second clamping element surface. The first side edges of the first and second clamping element surfaces may extend in the same plane which extends at an angle different from 0° or 180°, preferably at an angle of 90°, particularly transverse to the longitudinal clamping element axis. The third clamping element surface may be arranged at an angle of 90° to the first clamping element surface and to the second clamping element surface and/or at an angle of 90° to the connecting plate and/or at an angle of 90° to the rear wall of the second receiving area when the connecting plate is connected to the rear wall. Each of the clamping elements of each pair of clamping elements may thus have a third clamping element surface, the third clamping element surfaces of the two clamping elements of each pair of clamping elements being aligned parallel to each other when the clamping elements are connected to the rear wall by means of the connecting plate. Preferably, the connecting plate comprises at least one through-hole so that the clamping elements can be connected to the rear wall by means of a connecting element, for example a screw. However, it is also conceivable that the connecting plate is arranged adjoining or near to the first end of the clamping element surfaces, for example at second side edges opposite the first side edges of the clamping element surfaces, so that the clamping elements can be connected to the side walls.

Preferably, the third clamping element surface may have a essentially conically shaped or triangularly shaped cross-section at an angle different from 0° or 180°, in particular essentially transverse to the longitudinal clamping element axis. The third clamping element surface may have a clamping element edge extending essentially in the direction of the longitudinal clamping element axis, and due to the essentially conically shaped cross-section between the first side edge of the first clamping element surface and the first side edge of the second clamping element surface. Preferably, the clamping element edge extends in the same plane as the longitudinal clamping element axis. Due to the design of the clamping element edge of the individual clamping elements, the liquid detergent in the second container can be dispensed particularly well when the second container is received in the second receiving area and pressure is exerted on the side walls of the second container by means of the clamping elements or the clamping element edge.

It is also conceivable that the third clamping element surface comprises more than one clamping element edge, preferably two clamping element edges extending essentially in the direction of the longitudinal clamping element axis like the previously described clamping element edge and extending between the first side edge of the first clamping element surface and the first side edge of the second clamping element surface. The clamping element edges each extend in a plane that is essentially transverse or at an angle other than 0° or 180°, preferably at an angle of 90°, to the plane of the longitudinal clamping element axis.

Each of the clamping elements may have an open configuration opposite the third clamping element surface and transverse to the longitudinal clamping element axis. In other words, each of the clamping elements comprises an internal cavity limited by the three clamping element surfaces and having an open side. In the state of the clamping element connected to the second receiving area, for example when the clamping element is connected to the rear wall by means of the connecting plate, the open side of the inner cavity faces one of the two side walls of the second receiving area. By this embodiment, the clamping elements have a reduced weight and are moreover suitable to clamp the second container and/or to dispense the liquid detergent inside the second container. However, it is also conceivable that the clamping element has a fourth clamping element surface opposite the third clamping element surface as viewed transversely to the longitudinal axis of the clamping element, which fourth clamping element surface extends between a second side edge of the first clamping element surface and a second side edge of the second clamping element surface.

Preferably, at least one of the clamping element surfaces, preferably the third clamping element surface, is configured as a bearing surface, preferably as a rubberized bearing surface.

The support surfaces enable a particularly tight closure of the second container. The support surfaces may be configured as rubberized support surfaces and may comprise an elastomer or a thermoplastic or a thermoset or be formed from such a material. The support surface may comprise a soft plastic or a solid plastic or may be formed from a soft plastic or from a solid plastic.

In particular, when the first, lower pair of clamping elements and the second, upper pair of clamping elements have assumed the second position, the rubberized contact surface enables an improved seal so that no germs or bacteria can penetrate into the interior of the second container and the liquid detergent is accommodated in a sterile manner in the interior of the second container. Furthermore, it is ensured that the interior of the device, in particular the interior of the second receptacle, for example the side walls, do not come into contact with the liquid detergent. Thus, cleaning of the device, in particular cleaning of the interior of the device, can be dispensed with.

Preferably, one or more (preferably each of the) clamping elements has at least one spring element.

The at least one spring element may be configured as a tension spring or a rubber band arranged adjoining or near to the first end of the first clamping element surface or adjoining or near to the first end of the second clamping element surface. However, it is also conceivable that a first spring element is arranged adjoining or near to the first end of the first clamping element surface and a second spring element is arranged adjoining or near to the first end of the second clamping element surface. The spring element can be used to adjust the contact pressure of the clamping elements in the first state. This enables a particularly tight closing or sealing of the second container, in particular by the first, lower clamping element pair and by the second, upper pair of clamping elements. In each case, the clamping element edge can be pressed particularly tightly against the side walls of the second container so that the liquid detergent is accommodated in the second container in a sterile manner. In particular, each of the clamping elements of each pair of clamping elements may comprise a spring element. This spring support on both sides of the second container ensures a good and sterile seal.

Spring support on both sides enables flat pressing or uniform surface pressing, which enables sealing. The flat pressure or uniform surface pressure can exert pressure on the contact surfaces of the clamping elements. Thus, tightness or sealing of the second container is ensured at all times by means of the clamping elements and the spring support provided thereon.

Preferably, the lower limitation of the second receiving area has a through-hole.

The through-hole is configured to allow an outlet of the second container to pass through the through-hole. In particular, when the second container is inserted and received into the second exception region through the open top, an outlet at a lower end of the second container can be passed through the through-hole so that the outlet of the second container is passed through the through-hole when received into the second receiving region and protrudes below the second exception region. This enables the outlet to be connected to the container or cup so that a correctly dosed amount of liquid detergent can be discharged by means of the second container and filled into the container, preferably into a cup. However, it is also conceivable that the outlet is directly connected or connectable to the detergent chamber of a washing machine so that the correctly dosed amount of liquid detergent can be filled directly into the detergent chamber of the washing machine. Thus, the cup or container by means of which the liquid detergent is filled into the detergent chamber of the washing machine can be dispensed with. Accordingly, it is conceivable that the outlet of the first container is directly connected or connectable to the detergent chamber of a washing machine, so that the correctly dosed powder detergent amount can be filled directly into the detergent chamber of the washing machine.

However, it is also conceivable that the correctly dosed amounts of liquid detergent and powder detergent are fed into a container or cup or directly into the detergent chamber of a washing machine. The feeding into the detergent chamber can take place simultaneously or can be staggered, both automatically or manually by the user. This enables, for example, the simultaneous use of a powder detergent by means of a first container received in the first receiving area and the use of a liquid detergent, for example a fabric softener, by means of a second container received in the second receiving area.

Preferably, the first container comprises a housing and the second container comprises a housing, wherein the housing of the first container and/or the housing of the second container at least partially comprises or is formed from a flexible material, wherein, preferably, the housing of the first container and/or the housing of the second container comprises or is formed from an aluminum composite foil.

Preferably, the first container comprises a housing and the second container comprises a casing, wherein the housing of the first container and/or the housing of the second container at least partially comprises or is formed from a dimensionally stable material.

Preferably, the first container and/or the second container and/or the dosing device comprise a bioplastic or bioplastic or a bio-based plastic, preferably rock paper and/or wood.

According to another aspect of the invention, a container for holding and dispensing liquid detergent is provided, the container comprising a housing having an interior space for holding liquid detergent, an inlet in communication with the interior space, and an outlet in communication with the interior space. Further, the inlet is connectable to an outlet of a liquid detergent reservoir and a dosage of the liquid detergent is dispensable through the outlet of the container.

Preferably, the container for holding and dispensing liquid detergent is interchangeable and designed as a disposable article and/or the container is available pre-filled with the liquid detergent. The container can be deliverable factory-filled with the liquid detergent, i.e., the container can be factory-filled with liquid detergent so that the container is deliverable to the consumer already filled with liquid detergent. Further preferably, the liquid detergent reservoir is also interchangeable and designed as a disposable article and/or the liquid detergent reservoir is deliverable pre-filled with the liquid detergent. The liquid detergent reservoir can be supplied filled with the liquid detergent at the factory, i.e., the liquid detergent reservoir can be filled with liquid detergent at the factory, so that the liquid detergent reservoir can be supplied to the consumer already filled with liquid detergent.

The liquid detergent reservoir can be interchangeable, i.e. the liquid detergent reservoir can be designed as a disposable or single-use article, just as the first container for powder detergent, the dosing device for dosing the powder detergent and the second container for a liquid detergent can be designed as interchangeable components. However, it is also conceivable that the respective components previously described as interchangeable are formed as reusable or recyclable components. The liquid detergent reservoir is connectable to the second container in such a way that the device for dosing detergent, in particular the second receiving area, does not come into contact with the liquid detergent. Thus, the device, in particular the second receiving area, is not contaminated with liquid detergent, so that the device needs to be cleaned less often.

Preferably, the container is designed to be inserted into and received by a detergent dispensing device as a second container.

The container can be designed to be inserted as a second container into the second receiving area of the previously described device for dosing detergent and to be at least partially received therein. Thus, all previously described features of the device described in connection with the second container also apply to the second container for receiving and dosing liquid detergent described below. In particular, the second container described below can be inserted and received in the second receiving area of the previously described device so as to enable precise dosing of the liquid detergent by means of the clamping elements of the individual pairs of clamping elements.

Preferably, the inlet of the second container comprises an inlet opening preferably disposed essentially opposite the outlet of the second container as viewed in a direction of a longitudinal container axis and/or essentially opposite an outlet opening in the outlet of the second container as viewed in the direction of the longitudinal container axis. The second container may comprise an inlet having an inlet opening and an outlet having an outlet opening, the outlet being disposed on a side opposite the inlet. When the second container is inserted into the second receiving portion by a essentially vertical movement through the open top, the second container is received by the second receiving portion such that the outlet is disposed in a lower portion of the second receiving portion, adjoining or near to the first, lower pair of clamping members and adjoining or near to the lower limitation. Thus, the outlet can be passed through the through-hole in the lower limitation of the second receiving region. At the same time, the inlet is disposed in an upper region of the second receiving region, adjoining or near to the open top and adjoining or near to the second, upper pair of clamping elements. By allowing the inlet to be connectable to an outlet of a liquid detergent reservoir, liquid detergent can be fed from the liquid detergent reservoir into the interior of the second container and, by means of the clamping elements of each pair of clamping elements, the liquid detergent can be dosed in the correct amount and exit the second container through the outlet. This enables a predetermined or predeterminable dosage of the liquid detergent and a correct dosage of the liquid detergent by means of the clamping elements. firmly connected, preferably screwed or glued, to the outlet of the liquid detergent reservoir.

The second container may be firmly connected to the liquid detergent reservoir. Thus, the second container and the liquid detergent reservoir may be configured as a firmly interconnected unit. Preferably, the liquid detergent reservoir may be integrated into the container such that the liquid detergent reservoir is integrally formed with the second container. This enables the second container and the liquid detergent reservoir to be inserted and received in the receiving area as an interconnected unit. By having the outlet of the liquid detergent reservoir connected to the inlet of the second container, once the second container is received in the second receiving area, the liquid detergent can be fed from the liquid detergent reservoir to the interior of the second container and dosed in the desired amount by means of the clamping elements and fed via the outlet to a container or cup or detergent chamber of a washing machine. This enables the liquid detergent reservoir and the second container to be provided as a unit, and the user no longer needs to manually assemble the liquid detergent reservoir and the second container. Thus, the second container may be connected to the liquid detergent reservoir to form a combination container or combination bag. In this condition, the combination container can be manufactured filled with liquid detergent. In other words, the second container and the liquid detergent reservoir may be filled with liquid detergent. In this regard, it is conceivable that only the liquid detergent reservoir is filled with liquid detergent and the second container or the dosing section is arranged or attached to the liquid detergent reservoir in a folded manner. The liquid detergent reservoir filled with liquid detergent, for example a bottle of a commercially available detergent, may be separated from the second container by a separating element, for example a clamp. The use of a clamp as a separating element prevents the liquid detergent from flowing from the liquid detergent reservoir into the second container and from escaping from the outlet of the container when the second container is opened.

However, it is also conceivable that the liquid detergent reservoir and the second container are two separate elements that are provided separately from one another. Thus, the inlet of the second container can first be connected to the outlet of the liquid detergent reservoir, for example by means of a screw connection or by means of a plug-in connection or by means of an adhesive connection or by means of a clamp connection, so that the second container and the liquid detergent reservoir can then be inserted together through the open top into the second receiving area.

The second container may be formed of various materials and may comprise, for example, plastic or other flexible materials, such as a sheet material, which are suitable for holding a liquid detergent. Further, the second container may be configured as a bag or pouch. Like the second container, the liquid detergent reservoir may be formed of a flexible material. However, it is also conceivable that the liquid detergent reservoir is formed of a non-flexible material and is thus dimensionally stable, wherein the liquid detergent reservoir may comprise, for example, a metal such as aluminum or a plastic.

For example, the liquid detergent reservoir may also be formed as a carton, such as a Tetra Pak. It is also conceivable that the liquid detergent reservoir is formed by a plastic container, for example a bottle of a commercially available detergent. Preferably, the liquid detergent reservoir and the second container are made of the same material, in particular when the liquid detergent reservoir and the second container are made as one unit and not as two separate elements.

Preferably, the second container is connected or connectable to a dosing device or the second container comprises a dosing device, wherein preferably the dosing device is a lifting system, wherein the lifting system is designed to dose the liquid detergent from the interior of the second container.

Preferably, the second container comprises a essentially horizontal plate disposed adjoining or near to the inlet opening and/or adjoining or near to the inlet of the second container. Preferably, the plate is connectable to the second container, or the plate is firmly connected to the second container, or the plate is integral with the second container.

The plate or suspension tab may be firmly or detachably connected to the upper portion of the second container. The plate may be integrally formed with the second container. Preferably, the plate has a surface shape that essentially corresponds to the surface shape of a cross-section of the second container at an angle different from 0° or 180°, preferably at an angle of 90°, in particular as viewed transversely to the longitudinal container axis of the second container. In this case, the surface shape of the plate can be, for example, rectangular or square or circular or oval. However, other shapes are also conceivable. The distance of two opposite sides of the surface shape of the cross-section of the plate is preferably equal to or greater than the distance of two opposite side surfaces of the second container when it is inserted and received in the second receiving area, or when it is filled with a liquid detergent, or when a liquid detergent is received inside the second container.

The plate facilitates insertion of the second container into the second receiving area and subsequent holding or positioning of the second container in the second receiving area. When the second container is received in the second receiving area, the plate rests against the edges or edge surfaces of the open top so that the plate covers the open top. In addition, the plate enables precise insertion of the second container into the second receiving area so that the clamping elements of each pair of clamping elements can apply pressure to the side walls of the second container. This enables a correct dosage of liquid detergent.

As an alternative to the plate, a positioning and holding device or suspension device may be provided which essentially serves a similar purpose to the plate. Preferably, the positioning and retaining device is formed as a clamp or a C-clamp or a C-retaining element having a C-shape. This C-clamp may be arranged between the second container and the liquid detergent reservoir, preferably at the point where the second container is connected to the liquid detergent reservoir in the case of the combination container. For example, the C-clamp may be attached, preferably glued, to the bottom of the liquid detergent reservoir or to the top of the second container. It is also conceivable that the positioning and holding device comprises an adhesive element, for example an adhesive strip, and/or a velcro element instead of the C-clamp or the C-holding element.

The combination container can be positioned and held by means of the positioning and holding device on one of the side walls of the second receiving area, preferably in an upper region of the second receiving area. The positioning and holding device prevents the combination container, when inserted into the second receiving area, from sliding downwardly toward the lower limitation during emptying of the liquid detergent. Thus, it is ensured that the second container can empty completely. The positioning and holding device is designed to hold the second container and/or the liquid detergent reservoir in position.

Preferably, the plate has a through-hole, wherein the plate preferably comprises a first flange having a first peripheral wall, wherein the first peripheral wall at least partially surrounds the through-hole and extends at an angle different from 0° or 180°, in particular essentially transversely away from a first side of the plate. Preferably, the first flange is configured to connect the plate to the outlet and/or an outlet opening of the liquid detergent reservoir.

The first peripheral wall of the first flange of the plate is designed to engage with the liquid detergent reservoir, in particular the outlet of the liquid detergent reservoir. This enables the second container to be liquid detergent connected to the liquid detergent reservoir, so that the liquid detergent can be reliably introduced from the liquid detergent reservoir into the second container. The first flange or first peripheral wall may be integrally fabricated with the plate, or may be fabricated as a molded or injection-molded part that can be connected to the plate. The outer wall of the first flange may be essentially round in shape, and the outer wall of the outlet of the liquid detergent reservoir may be essentially round in shape. However, other shapes are also conceivable, such as an oval shape.

The first flange may be connectable to the outlet of the liquid detergent reservoir, for example, by a push-fit connection. Accordingly, the inner diameter of the first flange or the first peripheral wall may be essentially equal to the outer diameter of the outlet of the liquid detergent reservoir, or the inner diameter of the first flange or the first peripheral wall may be slightly larger than the outer diameter of the outlet of the liquid detergent reservoir. In this way, the outlet of the liquid detergent reservoir can be easily connected to the first flange so that liquid detergent can be reliably introduced into the second container. However, it is also conceivable that the first flange can be connected to the outlet of the liquid detergent reservoir by a screw connection. Thus, the first peripheral wall of the first flange may comprise a first thread, for example on the inner side or on the outer side of the first peripheral wall seen relative to the through-hole, which may be screwed to a second thread of the outlet of the liquid detergent reservoir, for example on the outer side or on the inner side of a peripheral wall of the outlet.

Thus, the second container can be connected to the liquid detergent reservoir by simply plugging or screwing it on. However, it is also conceivable that the second container is bonded to the outlet of the liquid detergent reservoir by means of the first flange or that the second container is integrally formed with the liquid detergent reservoir, for example as a combination container. A tank may be provided as the liquid detergent reservoir, which may be adapted to the dimensions of the detergent dispensing device. For example, the tank may have a cross-section in the plane of one of its lateral faces in which the outlet and the outlet opening are arranged, essentially corresponding to the cross-section of the device for dosing detergent, viewed at an angle different from 0° or 180°, in particular transversely, with respect to the longitudinal axis of the device or with respect to the longitudinal axis of the second receiving region. However, it is also conceivable that the liquid detergent reservoir is a bottle or container in which liquid detergent is accommodated which can be purchased, for example, in a supermarket. In this case, the bottle opening or the opening of the container can be screwed to the first flange as an outlet in a simple manner, wherein, for example, the external thread of the bottle opening or the opening of the container can be screwed to the first thread, for example on the inside of the first flange or the first peripheral wall.

Preferably, the plate comprise a second flange having a second peripheral wall, the second peripheral wall at least partially surrounding the through-hole and extending essentially transversely away from a second side of the plate opposite the first side. Preferably, the second flange is configured to connect the plate to the inlet and/or to the inlet port of the container.

As previously described, the plate may be firmly connected to the second container, in particular a second side of the plate opposite to the first side having the first flange and the first peripheral wall may be firmly connected to the second container, so that the second container is connectable to the liquid detergent reservoir by means of the plate. However, it is also conceivable that the plate is a separate element connectable by means of the first flange to the outlet of the liquid detergent reservoir, and connectable by means of a second flange to the inlet of the second container.

The second flange comprises a second peripheral wall and is disposed on the second side of the plate such that the second flange and the second peripheral wall at least partially surround the through-hole. The second flange and the second peripheral wall may be configured essentially like the first flange and the first peripheral wall. Preferably, the first flange and the second flange surround the same flange central longitudinal axis which extends at an angle different from 0° or 180°, in particular transversely to the plane of the plate and/or through the through-hole. Thus, the plate may be connectable to the liquid detergent reservoir by means of the first flange and to the inlet of the second container by means of the second flange, wherein a liquid detergent reservoir central longitudinal axis of the liquid detergent reservoir and the container longitudinal axis of the second container are in the same straight line with the flange central longitudinal axis when the liquid detergent reservoir, the plate and the second container are connected together. The liquid detergent reservoir central longitudinal axis extends through the outlet such that the outlet opening is disposed approximately the liquid detergent reservoir central longitudinal axis. The reservoir longitudinal axis extends through the inlet such that the inlet opening is disposed approximately the reservoir longitudinal axis. The outlet opening and/or the outlet of the second container may also be arranged approximately the longitudinal container axis. However, it is also conceivable that the outlet opening and/or the outlet do not extend approximately the longitudinal container axis, however about a longitudinal axis extending in a plane parallel to the longitudinal container axis.

It is also conceivable that the inlet of the second container can be connected directly to the outlet of the liquid detergent reservoir. In this way, the plate can be dispensed with. Preferably, the outlet of the liquid detergent reservoir can be connectable to the inlet of the second container by means of a plug-in connection or by means of a screw connection. However, the inlet of the second container may also be bonded to the outlet of the liquid detergent reservoir, or integrally connected to each other. Preferably, the inlet of the second container comprises the first thread, for example on the inside or outside of the inlet as seen relative to the inlet opening, wherein the first thread can be screwed to the second thread on the outlet of the liquid detergent reservoir, for example on the inside or outside thereof as seen relative to the outlet opening. Preferably, the liquid detergent reservoir comprises a housing having a top surface and a bottom surface, the top surface and the bottom surface being disposed at opposite ends relative to the liquid detergent reservoir central longitudinal axis. The outlet of the liquid detergent reservoir is arranged at the bottom side, wherein the bottom side extends in a essentially horizontal plane or in a plane at an angle different from 0° or 180°, in particular at an angle of 90°, as viewed transversely to the liquid detergent reservoir central longitudinal axis. By this embodiment, the underside can assume the function of the plate.

The liquid detergent reservoir may also comprise an inlet having an inlet opening, preferably arranged opposite the outlet or outlet opening. Thus, a liquid detergent may be introduced and/or replenished into the liquid detergent reservoir through the inlet. However, it is also conceivable that the liquid detergent reservoir does not comprise an inlet or an inlet opening, in particular when the combination container is manufactured filled with liquid detergent.

Preferably, the outlet of the container is configured for insertion into a through-hole in the lower limitation of the second receiving area.

The outlet of the second container may be configured as an elongated member, for example, the outlet may be tubular and the outlet may extend between a first end and an opposite second end along a longitudinal outlet axis. The first end is disposed adjoining or near to the second container and the second end is spaced from the second container. The outlet comprises an outer diameter that is less than the inner diameter of the through-hole in the lower limitation of the second receptacle. Thus, the outlet of the second container can pass through the through-hole in the lower limitation of the second receiving area when the second container is inserted into the second receiving area. This enables that, when the second container is inserted into the second receiving area, the outlet can be connected to the container or cup or directly to the detergent chamber of a washing machine, so that a correctly dosed amount of liquid detergent can exit from the second container and be filled into the container or cup or into the detergent chamber. Thus, it is also conceivable that in this way the liquid detergent and the powder detergent are introduced or dosed directly into the detergent chamber or chambers of the washing machine, so that a container or cup by means of which the dosed detergent is filled into the detergent chamber of the washing machine can be dispensed with. The first end of the outlet may be firmly connected to the second container, for example, the first end of the outlet may be integrally formed with the second container or may be bonded to the second container. The second end of the outlet may, in the state of the second container received in the second receiving region, lie in a plane that is below the plane of the lower limitation. However, it is also conceivable that the second end lies in the same plane as that of the lower limitation, or in a plane adjoining or near the plane of the lower limitation, for example above the plane of the lower limitation.

Preferably, the second container has at least partially a tapered portion, wherein the periphery of the second container in the tapered portion decreases toward the outlet, preferably essentially conically.

The second container may extend between an inlet end and an opposite outlet end along the longitudinal axis of the container. Adjoining or near to the inlet end are the inlet opening and the inlet. Adjoining or near to the outlet end are disposed the outlet and the outlet opening. The second container may comprise a first side wall and an opposing second side wall extending essentially parallel to the plane of the longitudinal axis of the container between the inlet end and the outlet end. In the lower region adjacent the outlet end, the container has a tapered portion. In the tapered section, the distance between the first side wall and the second side wall decreases toward the outlet, preferably essentially conically. This enables nearly all of the liquid detergent to pass from the second container through the outlet, leaving a minimal amount of liquid detergent in the second container.

Preferably, the second container comprises at least partially a essentially symmetrical portion, wherein the periphery of the second container remains the same within the essentially symmetrical portion, and wherein the essentially symmetrical portion is spaced further from the outlet than the tapered portion.

In the essentially symmetrical section, the first side wall and the second side wall each extend in a plane parallel to the plane of the longitudinal axis of the container. The essentially symmetrical section may extend between the inlet end and the tapered section. When the second container is inserted or received in the second receiving section, the clamping elements of each pair of clamping elements abut the side walls in the essentially symmetrical section and can apply pressure to the side walls. This enables for dosing of the liquid detergent. Preferably, the first, lower pair of clamping elements is arranged on the side walls of the second receiving section such that it can apply pressure in an area of the second container that is within the essentially symmetrical section and is adjoining or near to the tapered section.

Preferably, the second container comprises at least one first magnet, wherein the at least one first magnet is preferably disposed on an outer wall of the tapered portion, and wherein the at least one first magnet is connectable to at least one second magnet adjoining or near to the through-hole in the lower limitation of the second receiving portion.

The at least one first magnet may be arranged adjoining or near to the outlet, preferably on an outer wall of the outlet. The at least one second magnet may be arranged adjoining or near to the through-hole in the lower limitation, preferably on an inner wall of the through-hole. The at least one first magnet may at least partially surround the outer wall of the outlet, preferably the at least one first magnet may completely surround the outer wall of the outlet. The at least one second magnet can at least partially surround the inner wall of the through-hole, preferably the at least one second magnet can completely surround the inner wall of the outlet. Preferably, the at least one first magnet and the at least one second magnet are arranged such that they can cooperate when the second container is received in the second receiving region. In this way, the second container is brought or held in a suitable position so that the liquid detergent can be guided almost completely out of the second container through the outlet and/or so that the individual clamping elements enable or ensure optimum dosing of the liquid detergent. Alternatively, it is also conceivable that instead of the at least one first magnet, a metal element (or a metal plate or a metal strip) is provided which interacts with the second magnet. It is further conceivable that instead of the at least one second magnet, a metal element (or a metal plate or a metal strip) is provided which interacts with the first magnet. Due to the magnets, the second container is always in the correct position so that the liquid detergent can be guided out of the outlet without liquid detergent reaching the housing of the second receptacle.

Preferably, the device is designed for automatic dosing of detergent, in particular powder detergent and/or liquid detergent.

The dosing of detergent by means of the device for dosing detergent can be automated. The device can comprise a control or regulating unit with which the dosing of powder detergent in the at least one first container in the at least one first receiving area and/or with which the dosing of liquid detergent in the at least one second container in the at least one second receiving area can be carried out. The control unit can, for example, be connected to an application software, for example an app, so that the dosing of detergent can be initiated by means of the control unit via app.

However, it is also conceivable that the dosing of powder detergent in the at least one first container in the at least one first receiving area and/or with the dosing of liquid detergent in the at least one second container in the at least one second receiving area can be carried out manually. It may be provided that the device comprises an actuator, for example a push button, such that the dosing can be performed manually by pressing a button. Thus, the device may further be actuatable both automatically and manually.

Preferably, the dosage setting for dosing the detergent can be controlled or regulated as a function of the weight of a wash and/or the type of a wash and/or the volume of a wash and/or the degree of soiling of a wash and/or the drum size of a washing machine and/or the degree of hardness of a tap water available for washing the wash.

The dosage of the detergent may depend on or be controllable or adjustable by various amounts specific to the laundry. Thus, the dosage may depend on various variables, such as the type of laundry, the volume, the weight and/or the degree of soiling.

The weight and/or volume of the laundry can be determined, for example, via user software, such as an app. In this way, the exact amount of detergent can be dosed as a function of the weight and volume determined in this way and thus the amount of laundry. It is conceivable that the weight and/or volume determination can be determined via the same app with which the control or regulating unit of the device for dosing detergent can also be controlled or regulated. The use can, for example, place the laundry on the floor or on a table so that the laundry can be viewed from all sides, i.e. at an angle of 360°. For example, if the app installed on a device with a camera, such as a smartphone, a tablet or a laptop, the app can detect the size of the laundry or the pile of laundry using the camera and determine the weight or volume of the laundry using via an installed algorithm. This enables simplified and automated dosing of the detergent based on the weight and/or volume of the laundry, with no need for another scale element.

Preferably, the type, volume, weight and/or degree of soiling of the laundry can be controlled or determined via application software, for example a mobile app, based on augmented reality (AR).

The weight and/or volume determination, however also the determination of the degree of soiling of the laundry can be based on augmented reality. Via AR, software can span a digital network with individual measuring points over the laundry. The shape and color of the laundry enables the software to delineate the laundry from the floor or table and thus set the measurement points the bottom and to of the sides. In this way, a three-dimensional measurement of the linen is obtained. If necessary, the measuring points can be fixed by hand. The set points can be color-coded.

Preferably, the degree of hardness of the water and/or the type of washing machine can be selected via app. The degree of hardness and the type of washing machine can be stored in a database so that the drum size can be determined, for example by means of a processor. However, it is also conceivable that the degree of hardness of the water and or the type of washing machine are preset or can be preset in the app. The location, which can be determined by a smart phone with GPS, for example, enables the system to determine the hardness of the water.

The degree of soiling can (unless one uses an app/smartphone camera to detect the degree of soiling or a sensor/camera in the laundry basket) be set manually on the device. Preferably, the device comprises at least three, further preferably at least four buttons by means of which a light degree of soiling, normal degree of soiling heavy degree of soiling or very heavy degree of soiling can be set. However, it is also conceivable that the degree of soiling can be determined via the degree of turbidilty the water in the washing machine. In this case, the washing machine can be connected to the app or the device. Preferably, the washing powder is detected or scanned via the app. The device can thus determine the dosage based on the dosage amounts stored in the app for each detergent. This can be done according to the dosage instructions or information on one of the outer sides of the detergent packaging, which can also be stored in the app. Alternatively, a selection of the detergent can be made manually in the app so that the dosage amounts can be accessed. It would also be conceivable to manually enter the amounts according to the dosing instructions on the detergent packages. A manual input is advantageous if detergent powder is manually filled or transferred into the first container.

Preferably, the app can be designed to determine the volume of the laundry to be washed using a 3D camera. This 3D camera can be integrated in a smart device, for example a smart phone, or coupled with it. It is conceivable that the type of laundry can be selected in the app. For example, it can be selected, for example manually, whether the laundry comprises predominantly cotton or another material.

Preferably, the device can be designed or comprise means to determine the weight of the material of the laundry to be washed, for example cotton. Together with the determined values of volume or weight of the laundry, which are stored in the app, the weight of the laundry can then be finally determined.

Preferably, the volume is determined via AR (augmented reality). The app can be designed to span a digital network with individual measuring points over the laundry. The shape and color of the laundry enables the software to delineate the laundry from the floor or table and thus set the measuring points the bottom and top of the sides. In this way, a three-dimensional measurement of the linen is obtained. It is also conceivable that the measuring points are fixed manually, for example by clicking. The set points can be color-coded.

Preferably, the application software comprises a warning system configured to alert, for example, to a separation of laundry and/or to the attainment of an optimal or maximum wash load.

Furthermore, it is conceivable that the app can recognize or determine what type of laundry is involved. Thus, the app can recognize which material the laundry is made of, for example woven cotton, velvet, printed cotton, satin, and/or silk, etc., and depending on the material of the laundry, control one of the at least one first and at least one second receiving chambers with the suitable container of detergent. Thus, depending on the material of the laundry, the suitable detergent can be selected in an automated manner. It is also conceivable that, depending on the material of the fabric of the laundry, the dosage of the detergent can take place. Furthermore, the app can also draw attention to a separation of laundry if it is recognized that different materials are involved that should not be washed together. This can prevent garments from being washed together whose materials require different detergents. It is also conceivable that a suitable washing program can be selected in the washing machine depending on the detected material or type of laundry.

The degree of soiling of the laundry can also be done via the camera of the smartphone, tablet and/or laptop. Alternatively, the user can manually select the degree of soiling in the app. It is conceivable that the app has three degrees, for example strong, medium and light, as a selection option, so that the dosage of the detergent can also take place depending on the manually entered degree of soiling. However, other subdivisions of the degree of soiling are also conceivable.

The degree of soiling can also be set, for example, by pressing a button on the device or in the app. Preferably, the device has three to four buttons in order to be able to set light soiling, normally heavy soiling, or very heavy soiling.

It is conceivable that various materials and degrees of soiling of textiles are stored in a database, which may be coupled to the device or the app. The device can comprise an image recognition means, which compares an image of the laundry with the database. The app can be designed so that, for example, only a partial area of the laundry is detected or seen, for example the upper area of the laundry. For example, the last item of laundry thrown into the laundry basket can always be captured or checked by the camera. The app can then determine an average degree of soiling across all the items in the basket. If a laundry item is particularly dirty, the device or the system comprising the device could send a message via app or emit an acoustic warning signal if the laundry item would not become clean with the dosage determined by an average value.

Preferably, the app is trained or trainable tor image recognition. In this case, adaptive algorithms can break down the images into small components and search for patterns in the data. The patterns can be soiling and different textiles as well as the position of the textile's in the laundry basket. The position of the textiles can mean, for example, the way the garment is placed in a laundry basket. The images that can be recognized or detected by means of the app can be enabled or marked or can be marked. In this way, the app can compare or match the captured image with the database to determine a degree of soiling. Once the image recognition app is trained, it does its job much faster and much more accurately than humans. It is conceivable that image recognition could be done using a software tool from one of the major providers such as Google, lBM, Microsoft, Clarifai and Cloud Sight.

Preferably, the dosage setting for dosing the detergent can be controlled or regulated as a function of the hardness of a tap water available for washing the laundry.

The water in the pipes differs depending on where you live. The more lime, calcium and magnesium there is in the water, the higher the so-called "degree of hardness" of the water. The detergent can therefore be dosed depending on the hardness of the water. It is conceivable that the control or regulating unit of the device for dosing can take values about the degree of hardness of the water from a database or directly from the Internet by means of user software, for example the app described above or another app, so that the dosing can be carried out as a function of the degree of hardness of the water. In the database, the degrees of hardness of the water could be stored depending on the geographical data of the respective location of the device for dosing detergent. Thereby, the degrees of hardness could be broken down into the categories soft, medium and hard. In Germany, for example, the water is soft if the value of the hardness level is less than 8.4 dH (dH=German hardness). Between 8.4 and 14 dH, it has a medium degree of hardness, and at a concentration of more than 14 dH, the water is hard. With hard water, a detergent has to fight against more lime and must therefore be dosed higher than with soft water. Thus, after determining the exact location of the device, for example via GPS, the degree of hardness of the water could be determined in a simplified and automated way, so that the dosage of detergent can be done depending on the degree of hardness. This makes it possible to optimally adjust the dosage of detergent by means of the device to the degree of hardness.

However, it is also conceivable that the degree of hardness can be set manually in the app by allowing the user to choose between three degrees of hardness, for example soft. medium and hard, as described previously. Thus, a measuring strip could also be provided by means of which the degree of hardness of the water can be determined, so that the user can enter the determined degree of hardness in the app.

Preferably, the at least one first container and/or the at least one second container comprise a code, for example an RFID (radio-frequency identification) tag or a barcode. The device for dosing detergent may comprise a detector or reader, for example an RFID reader or a barcode reader. Preferably, the detergent dispensing device comprises at; east one first reader and/or at least one second reader. Preferably, the at least one first receiving area comprises a first reader and the at least one second receiving area comprises a second reader. The readers can each be arranged on the inner sides of the side walls or the rear walls of the receiving areas. In this way, the respective code can be read out automatically after insertion of a first container with a first code into the first receiving area and/or after insertion of a second container with a code into the second receiving area. It is also conceivable that the respective codes are read out using an app and/or a smartphone camera. For example, the code can contain information about the type of detergent, so that the type of detergent, for example mild detergent or color detergent, can be detected by means of the code, which can then be transmitted or communicated to the control and regulating unit of the device. The control and regulation unit is in communication with the at least one first reader and/or with the at least one second reader. Thus, the device can control the correct detergent depending on the type or material and use it for dosing in an automated manner. Alternatively, however, a manual assignment of the individual pick-up areas with the type of detergent is also possible via app.

Preferably, the dosage setting for dosing the detergent can be controlled or regulated via application software, for example a mobile app. Preferably, the dosing setting for dosing the detergent can be controlled or regulated via Bluetooth or Wireless Local Area Network (LAN).

The dosing can now be controlled via mobile app, which can be the same app as described above. However, it is also conceivable that the dosing is controlled or set in motion by means of an actuator, for example a pushbutton on the device for dosing detergent. It is conceivable that after determining the degree of soiling, the water hardness and/or the weight of the laundry, the dosing can be set in motion by means of an app. For this purpose, the app is in communication with the control and regulating unit of the device for dosing detergent. Thus, also alternatively, the dosing can be automated, i.e., after all values have been determined, i.e., degree of soiling, water hardness and/or weight, the dosing of the detergent into the provided container or cup or into the detergent chamber of the washing machine is automatically carried out by sending a corresponding signal to the control and regulating unit. After all required values are available, the control and regulation unit automatically initiates the dosing.

Preferably, the application software is designed to manually or automatically order detergents online.

The device for dosing detergent may comprise means by which the number of doses can be detected and thus in turn the detergent consumption can be determined. For example, the device may comprise at least a first sensor configured to detect or count the rotations of the screw conveyor about the first screw conveyor longitudinal axis. Preferably, the first sensor is disposed adjoining or near to the screw conveyor housing. The first sensor may also be arranged within the at least one first receiving area. In this way, consumption of the powder detergent of the at least one first receptacle may be detected. The device may also comprise at least one second sensor configured to detect or count the activity of the clamping elements disposed in the second receiving area. Preferably, the second sensor is disposed adjoining or near to the clamping elements, and further preferably, the second sensor is disposed adjoining or near to at least one of the clamping elements. The second sensor may also be disposed within the at least one second receiving region. Thus, the consumption of the liquid detergent of the at least one second receptacle can be detected. The at least one first sensor and/or the at least one second sensor may be in communication with the app. Thus, information about the detergent consumption may be transmitted and recorded in the app. This enables that as soon as the app is in communication with the internet, that new detergent can be automatically ordered on the internet. It is also conceivable that the user of the app receives an alert after a certain minimum amount of detergent has been reached so that he or she can manually, at the push of a button, order new detergent on the Internet or buy new detergent at the supermarket. This can be done taking into account the washing frequency and/or delivery time of the detergent.

It is also conceivable that the app is designed to make suggestions about a suitable detergent. For example, after the camera has captured all the data about the type or material of the laundry, such as silk, wool, or black laundry, the app can make a suggestion about the detergent to use. Thus, the user can manually select one of the different recording areas in the app, depending on which recording area contains which type of detergent and with which detergent he or she wants to wash the laundry. However, it is also conceivable that the appropriate detergent is used automatically depending on the type or material of the laundry. For this purpose, the data determined by the camera about the type or material is matched with the data transmitted by the readers to the app about the type of detergent in the individual receptacle areas present first and second containers with detergent, so that a suitable detergent is automatically selected by controlling the respective associated receptacle area and/or container with liquid or powder detergent.

The app or the database that can be accessed by the app can also store structural features or characteristics of different washing machines depending on the type and/or manufacturer, so that these values can be accessed. For example, the app can access data such as drum size, laundry programs, etc. in this way. Thus, the app can be designed to issue a warning if the weight or volume of laundry determined by means of the camera or by means of a scale is unsuitable for the drum size. For example, when determining the laundry volume and/or weight, a signal can be given to the user if the scanned laundry is too much for the washing machine. In this way, the user has the option of adjusting the laundry volume so that his laundry can be washed cleanly and dirt can be reliably removed. It is also conceivable that the app is designed to suggest the best laundry program of the respective washing machine model depending on the determined type or material of the laundry. In combination with a laundry basket and a scale, the device or a system comprising the device can be designed to inform the user when the optimal or maximum load of the washing machine has been reached. In this way, washing can be done very efficiently.

Preferably, application software, for example a mobile app, is used to automatically indicate the fill level of the powder detergent in the first container and/or the fill level of the liquid detergent in the second container, for example by means of a signal tone or a signal light.

Preferably, the first container, for example after emptying the powder detergent or after reaching a certain fill level, and/or the second container, for example after emptying the liquid detergent or after reaching a certain fill level, can be ordered automatically on the Internet.

Preferably, the weight of the laundry can be determined by a scale, for example a hanging scale or a platform scale.

The weight or volume can also be determined alternatively to the camera via AR by means of a scale or a weighing element, preferably a hanging scale or a platform scale. It is conceivable that the scale is integrated in the washing machine. Thus, the scale may be integrated adjoining or near to the laundry drum within the washing machine and configured to be in communication with the control unit and/or the app. In this way, the weight can be reliably determined in a simple manner when the user loads the laundry into the laundry drum. By the fact that the value of the weight can be transmitted to the control and regulation unit and/or the app, the detergent dosage can be carried out depending on the weight. It is also conceivable that the app issues a warning as soon as the maximum weight for the respective laundry drum is reached. In this way, the user can easily remove laundry items from the laundry drum again, and thus adjust the weight or volume of the laundry to the drum size. The scale can also be positioned underneath the washing machine, for example integrated into the feet or as a weighing mat, or as load cells placed under the standard washing machine feet or positioned in another location. After the laundry has been loaded into the laundry drum, the weight of the laundry can be easily determined in relation to the known dead weight of the washing machine. It is further conceivable that the feet of the washing machine are replaced by feet having a weighing device or scale to determine the weight of the laundry in the laundry drum. Preferably, the feet can be screwed into the bottom of the washing machine. It is further conceivable that the washing machine comprises a washing machine base or a washing machine subframe, which has a weighing device or scale.

There may be a problem that users place objects, for example, a laundry basket, detergent, washing powder, or a dryer, etc., on the washing machine, which negatively influences the measurement by means of the previously described scale. To avoid these negative influences, the scale can go to TARA after a wash cycle and removal of the old laundry. By TARE or the TARE weight is meant the difference between the gross or total weight and the net or clean weight of the items to be weighed. The scale may be configured to detect the opening and closing of the washing machine door or the removal of the old laundry from the machine. Thus, it can be determined that a wash program has been completed. After that, the scale can set itself to TARE after a certain time. Alternatively, the user presses a button before loading the new laundry, then the scale goes to TARA. This would make no difference what is written on the machine.

It is also conceivable that individual cradle elements or load cells are connected to the feet of a washing machine, e.g. by clicking them on. The feet of the washing machine do not have to be replaced.

Preferably, the scale is connected or connectable to a laundry basket, preferably the scale is connected or connectable to the bottom of the laundry basket as a platform scale.

It is also conceivable that the scale is arranged outside the washing machine and/or outside the laundry drum. For example, the scale or measuring system may be arranged adjoining or near to or on any laundry basket. Thus, the laundry basket may be placed on the scale so that the weight of the laundry may be determined. The scale or the measuring system may also be integrated in any laundry basket. It is conceivable that the weight of the laundry can be determined by means of a scale in different ways The weight or mass of the laundry can be determined using a hanging scale. The laundry basket can be attached to or picked up by the hanging scale. Fastening means or receiving means can be provided for this purpose, for example a suspension means. These suspension means can be connected or are connected to a weight measuring device, so that the weight of the laundry basket and/or the weight or mass of the laundry picked up by the laundry basket can be reliably determined. In particular, this is possible at the locations of the suspension points, i.e., at the locations where the suspension means are attached or connected to the hanging scale. Preferably, the laundry basket can be lifted, and further preferably, the laundry basket can be lifted within the suspension means. The user can easily fill the laundry basket outside the suspension scale and then suspend it in the suspension means of the scale for weight determination. It is also conceivable that, as an alternative to the laundry basket, another container, such as a bag or pouch, can be connected or connected to the hanging scale. In this way, the laundry can be filled into the bag or pouch. Preferably, the bag or pouch comprise a shape or volume that is adapted to the shape or volume of a laundry basket. The fact that the weight measuring device is in communication with the app and/or the control unit of the device means that the detergent can be dosed as a function of the weight of the laundry to be washed.

Alternatively, the weight force or the mass or volume of the laundry can also be determined by means of a strain gauge arranged in the handle of a laundry basket or connectable or connected to the handle of a laundry basket. In this way, the weight can be precisely determined in a particularly simple manner as soon as the laundry basket filled with laundry is lifted. The determined value can then be entered into the app by the user, for example, so that detergent can be dosed as a function of the weight of the laundry to be washed. It is also conceivable that the value of the weight of the laundry to be washed is automatically transmitted to the app and/or the control and regulation unit of the device for dosing detergent.

Another conceivable alternative is to use a platform scale with an adjustable surface so that the weight of the laundry basket and the laundry to be washed in the laundry basket can be determined easily. The determined value can then be entered into the app by the user, for example, so that the dosage of detergent can be carried out as a function of the weight of the laundry to be washed. It is also conceivable that the value of the weight of the laundry to be washed is automatically transmitted to the app and/or the control and regulation unit of the device for dosing detergent. In this context, it is conceivable that the scale also calculates the amount of removed laundry to thus determine the weight of the removed laundry. By amount of removed laundry may be meant the amount by which the amount of laundry in a laundry basket is reduced when the user removes laundry items from the laundry basket. This is advantageous if the laundry has to be sorted frequently.

Preferably, the scale comprises at least one weighing cell, a display element and/or a control element, which are preferably integrated in a box.

The scale can be integrated into the bottom of a laundry basket. The scale may also be connectable or connected to the bottom of a laundry hamper. The scale may comprise a plurality of hardware elements, such as at least one weighing element or load cell, a microcontroller, and/or a display element, such as an LCD display. All elements of the scale may be integrated into a box, or a box may comprise all elements of the scale. For example, this box may be placed in the laundry basket so that the box is in contact with the bottom of the laundry basket and/or may be arranged adjoining or near to the laundry basket bottom. Thus, the weight of the laundry can be easily determined as soon as the laundry is filled into the laundry basket. The user can then use the display element to check the weight of the laundry and adjust it as desired. The microcontroller can be in communication with the app and/or the control or regulating unit of the device for dosing detergent. In this way, the exact value of the weight of the laundry can be transmitted in a simple manner, so that the dosing of detergent can be carried out as a function of the weight or volume or mass of the laundry. It is conceivable that the device or the system comprising the device is configured to inform the user when the optimum or maximum load of the washing machine has been reached.

Preferably, the scale further comprises a camera element and/or a support plate.

The scale may comprise a carrier plate. The carrier plate may be connected or connectable to the box. Preferably, the carrier plate is arranged on an outer side of the box opposite to the outer side of the box where the connecting elements are arranged. Thus, the support plate is arranged on a side of the box opposite the laundry basket bottom when the scale or the box is connected to or inserted into the laundry basket. The support plate may be configured as a laundry support plate. Thus, the laundry may be in contact with the laundry support plate when the laundry is placed in the laundry basket. The laundry support plate is connected to the weighing cell. This enables precise measurement of the weight of the laundry.

The scale may comprise a camera element. The camera element may be connected or connectable to the box. However, it is also conceivable that the camera element may be arranged within the laundry basket, for example on the side walls thereof. The camera element or the camera enables that it can be detected whether an incorrect laundry item has been placed in the laundry basket. By the fact that the camera element can be in communication with the app, an appropriate warning signal can be issued. This prevents inappropriate mixing of laundry items, for example colored laundry and white laundry, which should be washed separately.

It is also conceivable that the camera element is designed to detect or recognize the degree of soiling of the laundry. In that the camera element is in communication with the app and/or the device for dosing detergent, the dosing of the detergent can take place automatically as a function of the degree of soiling detected by the camera element. However, it is also conceivable that the degree of soiling, for example heavy, medium or light soiling, can be entered manually by the user in the app. Other subdivisions of the degree of soiling are also conceivable.

Preferably, the second container is a hose or the second container is configured as a hose.

Preferably, the liquid detergent inside the second container can be dispensed by means of a peristaltic pump.

Preferably, the second container and/or the hose and/or the peristaltic pump can be inserted into the second receiving area of the device and can be received by the second receiving area.

Preferably, the hose and/or the peristaltic pump are interchangeable and designed as a disposable or single-use article.

Preferably, the first container and/or the second container and/or the dosing device and/or the screw conveyor and/or the hose and/or the peristaltic pump and/or the lifting system are made of a bioplastic or bioplastic or a bio-based plastic. Preferably, the first container and/or the second container and/or the dosing device and/or the screw conveyor and/or the hose and/or the peristaltic pump and/or the lifting system comprise a bioplastic or bioplastic or a bio-based plastic. For example, the bioplastic may comprise rock paper and/or wood.

Another aspect of the invention relates to a system comprising a device for dosing detergent, in particular liquid detergent and/or powder detergent, at least one first container for receiving and dosing powder detergent and at least one second container for receiving and dosing liquid detergent.

Both the device for dosing detergent and the containers for holding and dosing powder detergent or liquid detergent may comprise any of the previously described features, as well as the advantages associated with those features. In particular, the weight determination of the laundry in this system can be performed using any of the previously described means for weight determination.

Another aspect of the invention relates to a computer-implemented method for controlling a device for dosing detergent, in particular powder detergent, the method comprising: dosing the detergent, for example powder detergent, from the first container by means of the dosing device, and dosing the liquid detergent from the second container by means of a further dosing device.

Preferably, the method further comprises: determining the level in the first container designed to hold a detergent, such as a powder detergent, and determining the level in the second container designed to hold a liquid detergent.

Preferably, the method further comprises: identifying the detergent, such as powder detergent, and/or the liquid detergent and reordering the detergent and/or the liquid detergent based on the determined fill level.

Another aspect of the invention relates to a method for dosing detergent by means of a previously described device for dosing detergent, comprising the step of: dosing the detergent by means of the dosing device, wherein the dosing device has a dosing setting for dosing detergent that depends on a determined weight of a laundry to be washed.

Preferably, the method of dosing detergent comprises a step of determining or ascertaining the weight of the laundry by scale, such as a hanging scale or a platform scale.

Further preferably, the dosage setting for dosing detergent depends on a hardness level of a tap water available for washing the laundry and/or on a degree of soiling of the laundry to be washed and/or on a drum size of a washing machine. The water hardness and/or the degree of soiling and/or the drum size may be necessary, in addition to the weight, for the correct dosage of detergent. Thus, an improved dosage of detergent is made possible.

The step of determining or ascertaining the degree of soiling can comprise the determination or ascertainment via a turbidity sensor in the washing machine. It is also conceivable to determine or ascertain by means of a camera in the laundry basket or by means of a camera in a smartphone, which is coupled or can be coupled to an app. Also conceivable is a manual setting of the degree of soiling in the app or a manual setting of the degree of soiling by means of the dispenser, for example by means of an input field or an input key on the dispenser.

Preferably, the weight of the laundry is determined by means of a scale connected or connectable to a laundry basket. Further preferably, the scale is connected or connectable to the bottom of the laundry basket as a platform scale.

Figure 2:
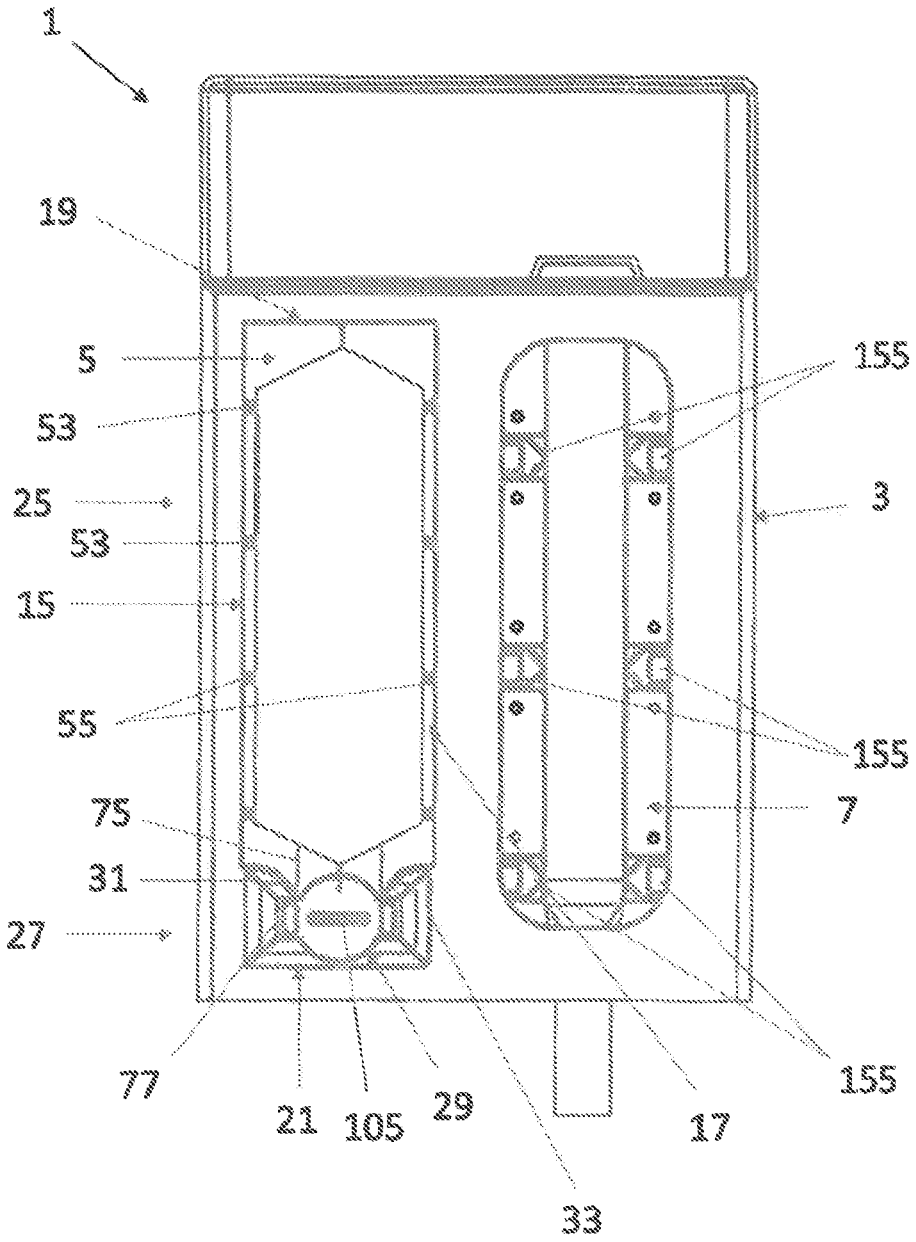
Figure 3:
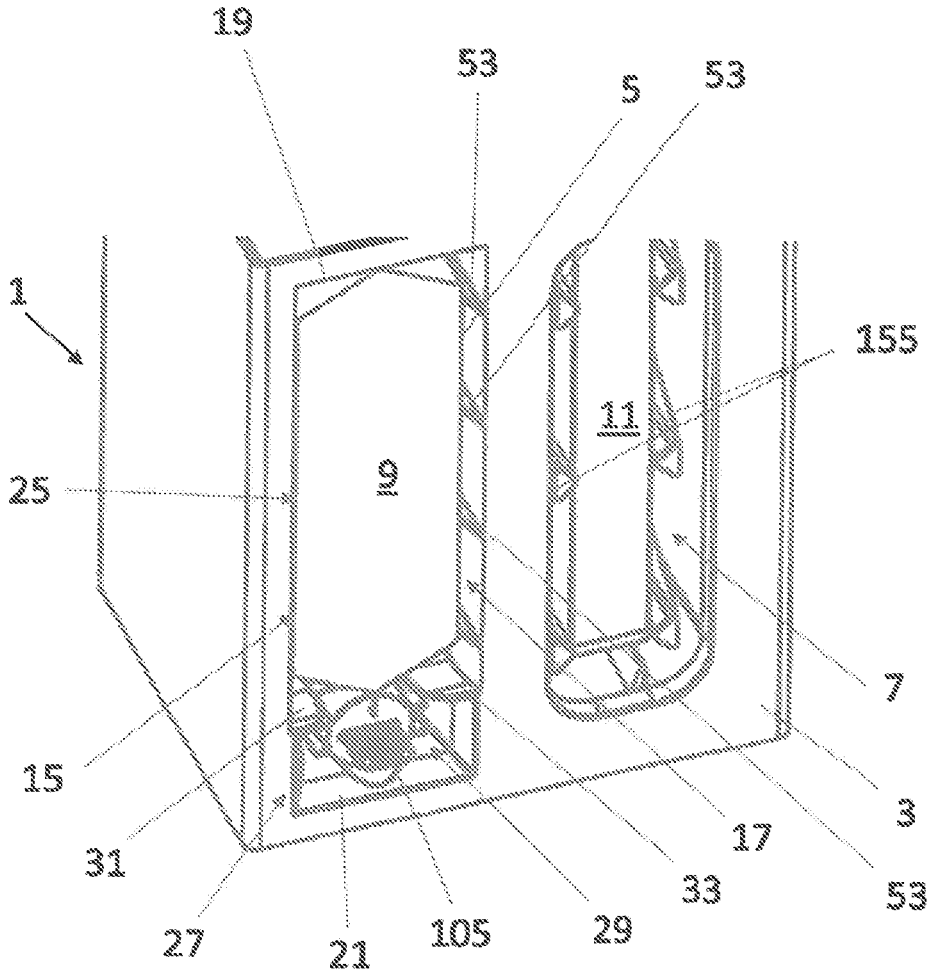
Figure 4:
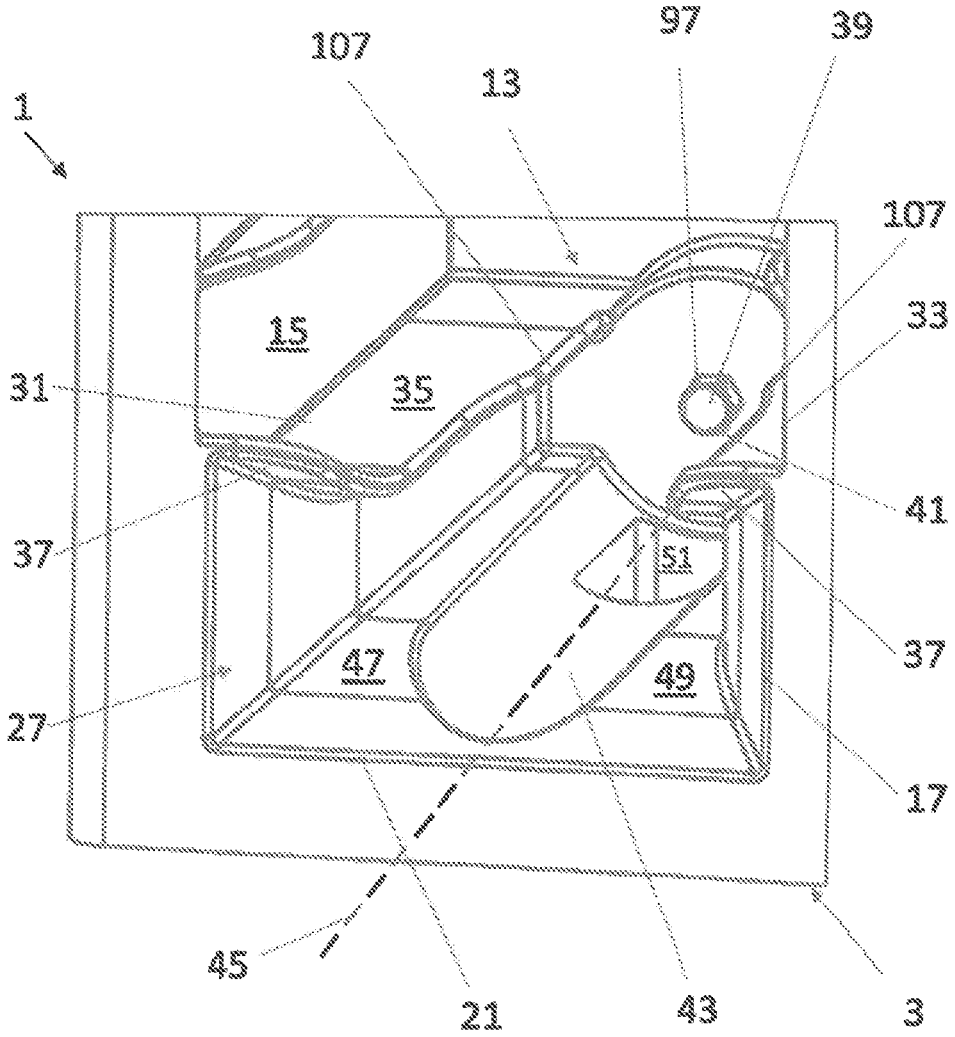
Figure 5:
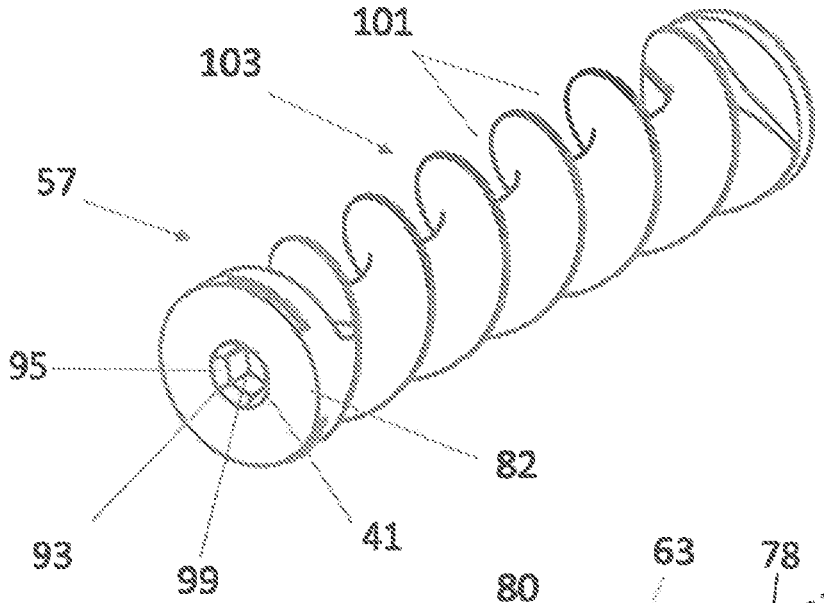
Figure 6:
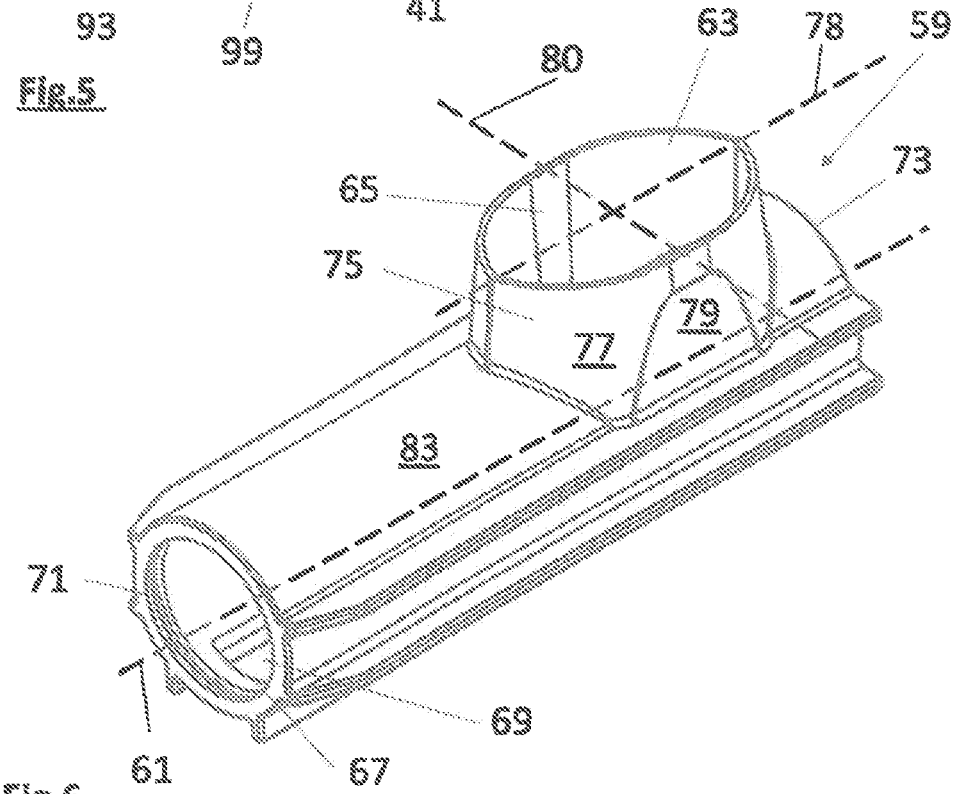
Figure 7:
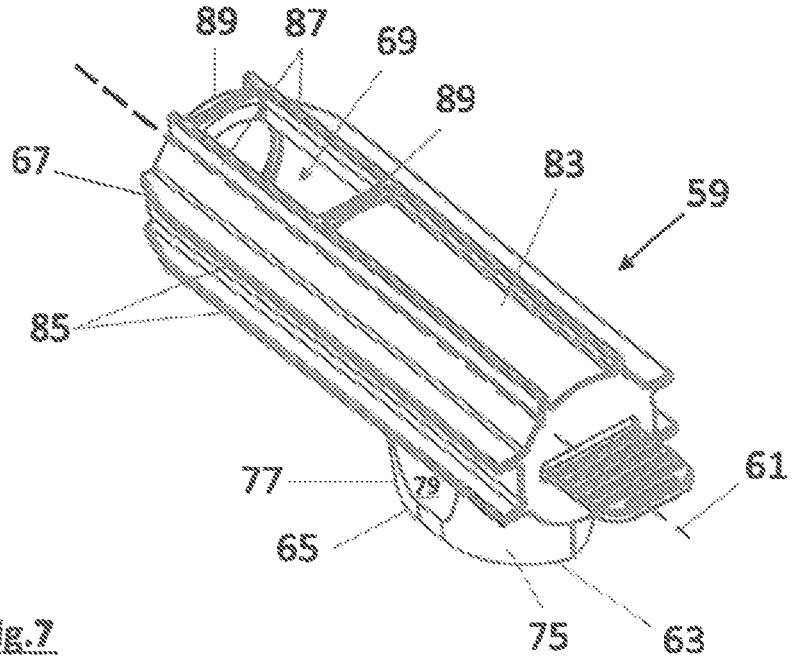
Figure 8:
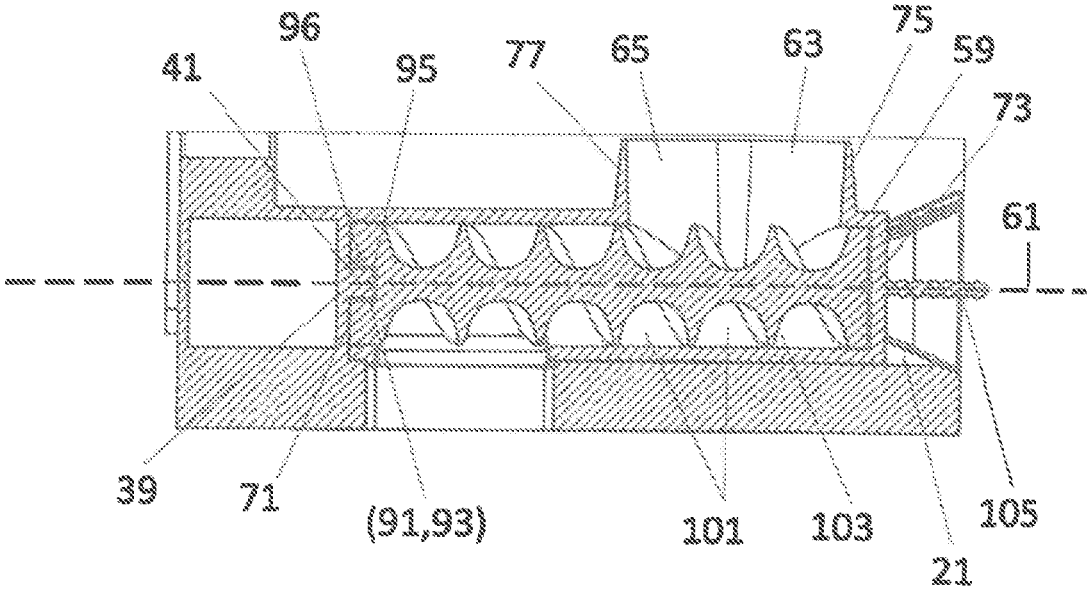
Figure 9:
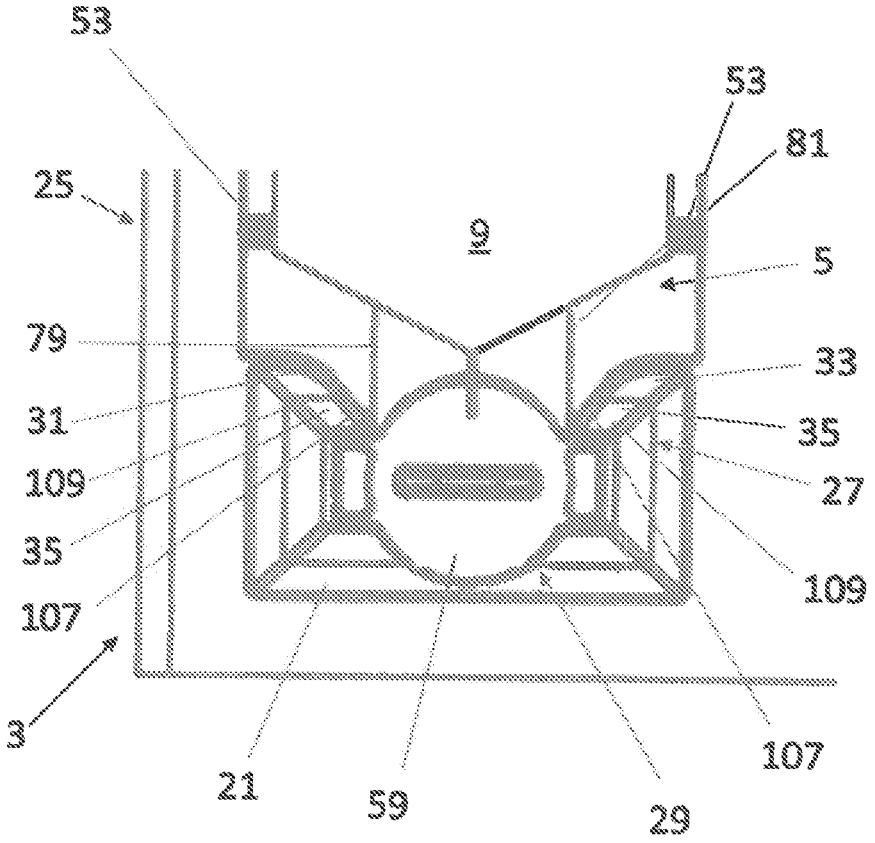
Figure 10:
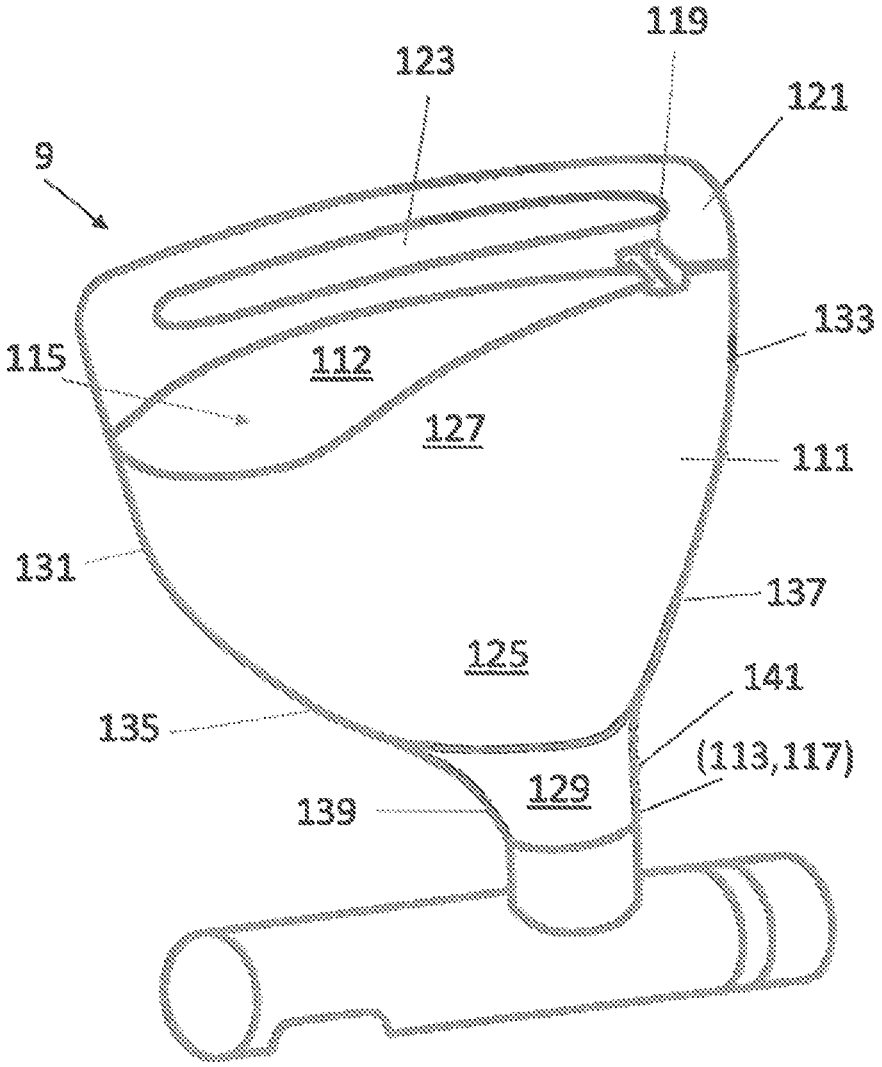
Figure 11:
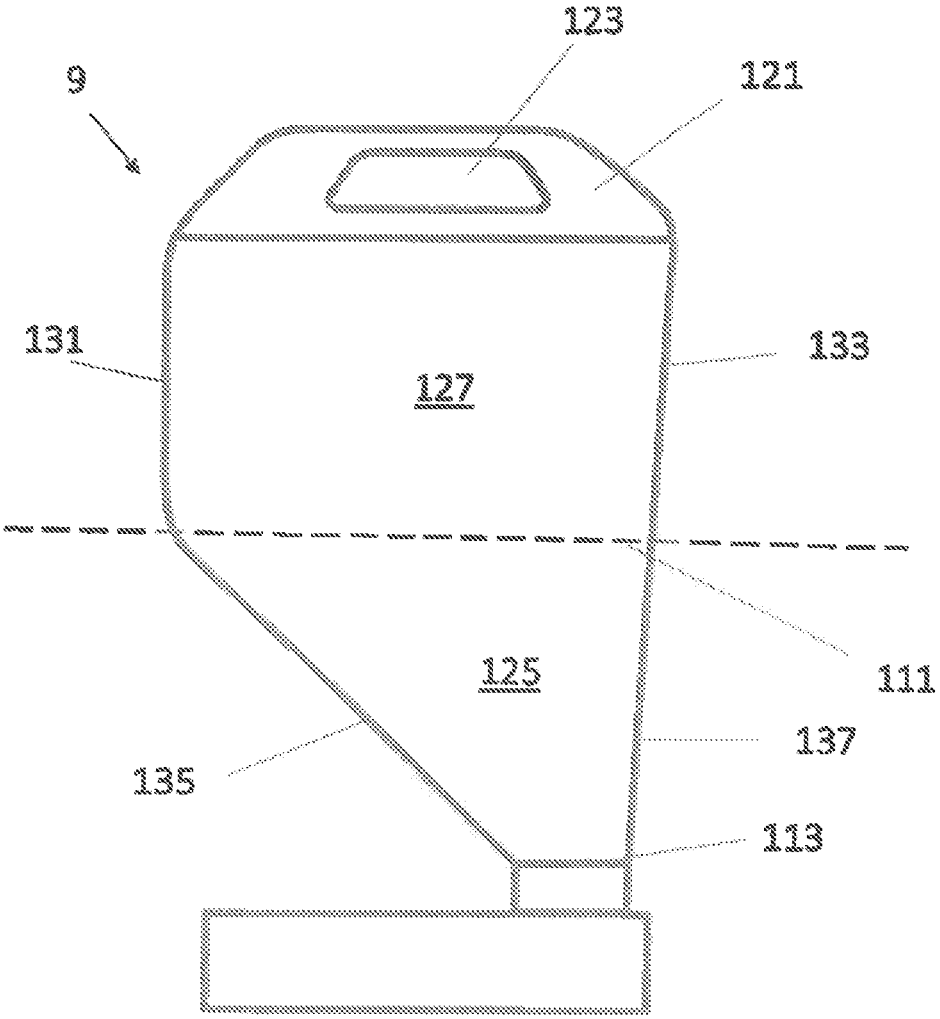
Figure 12:
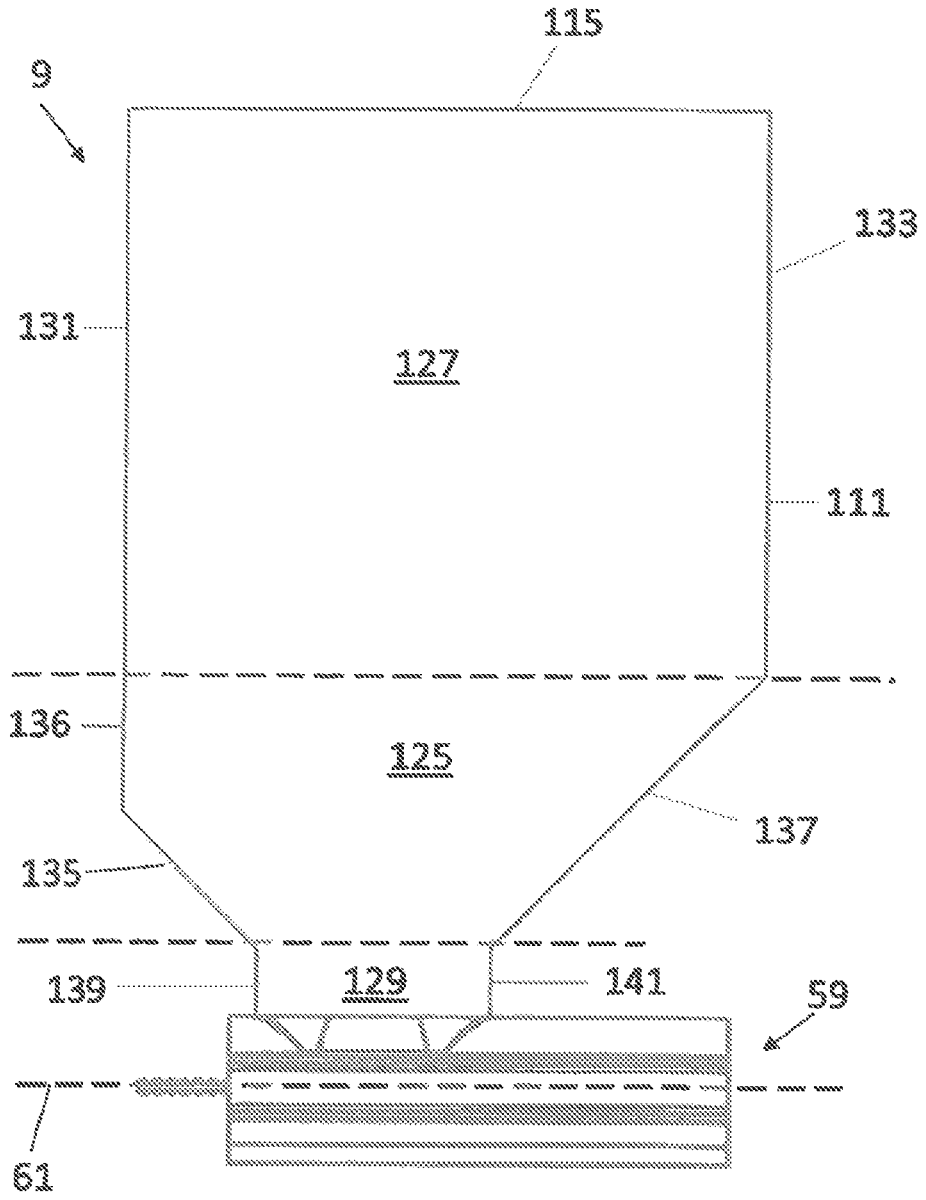
Figure 13:
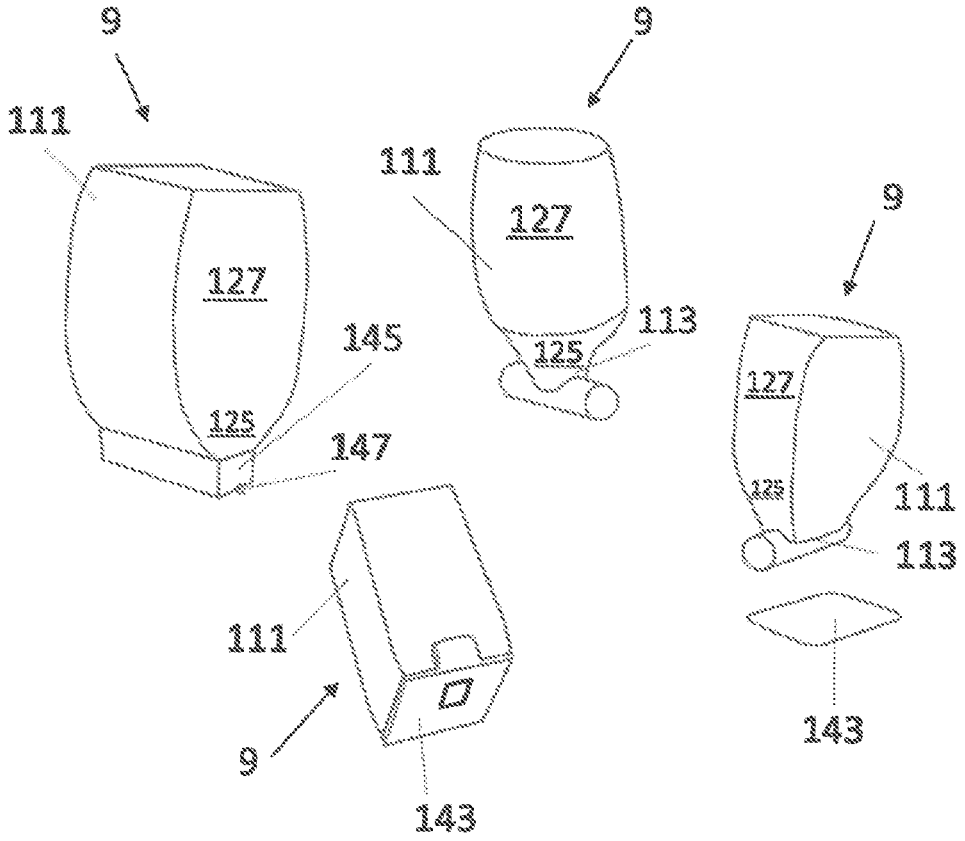
Figure 14:
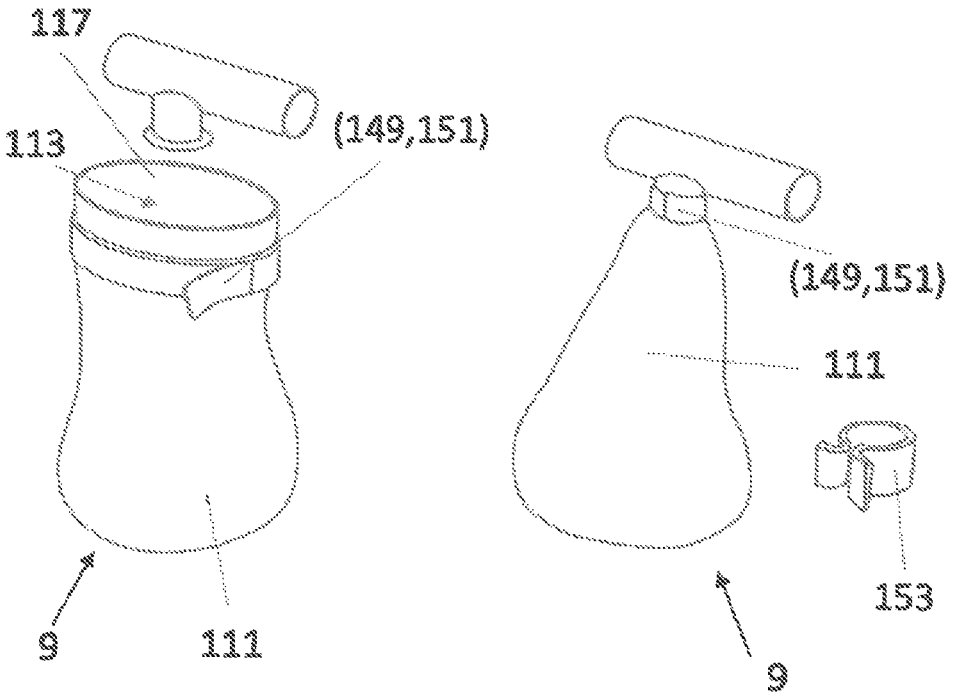
Figures 15A, 15B, 15C:
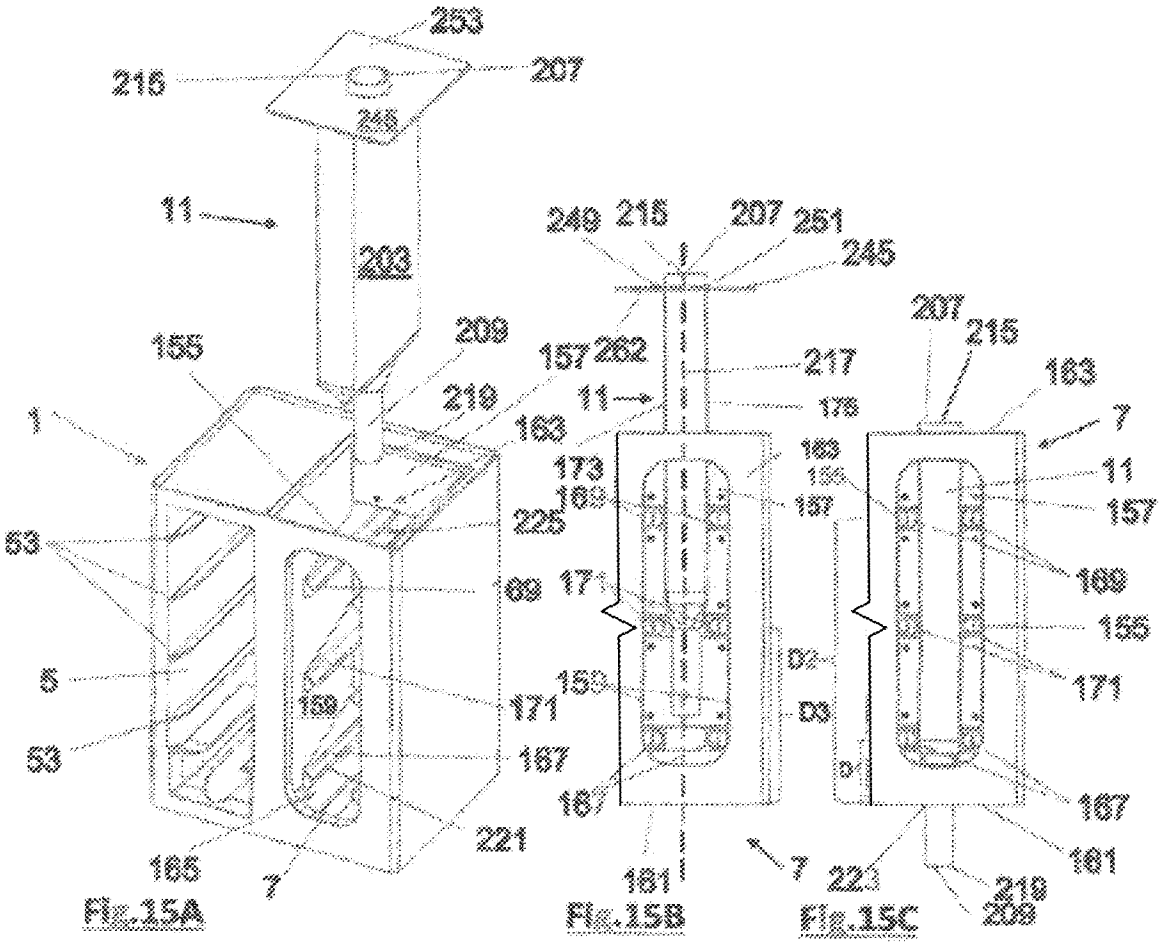
Figure 16:
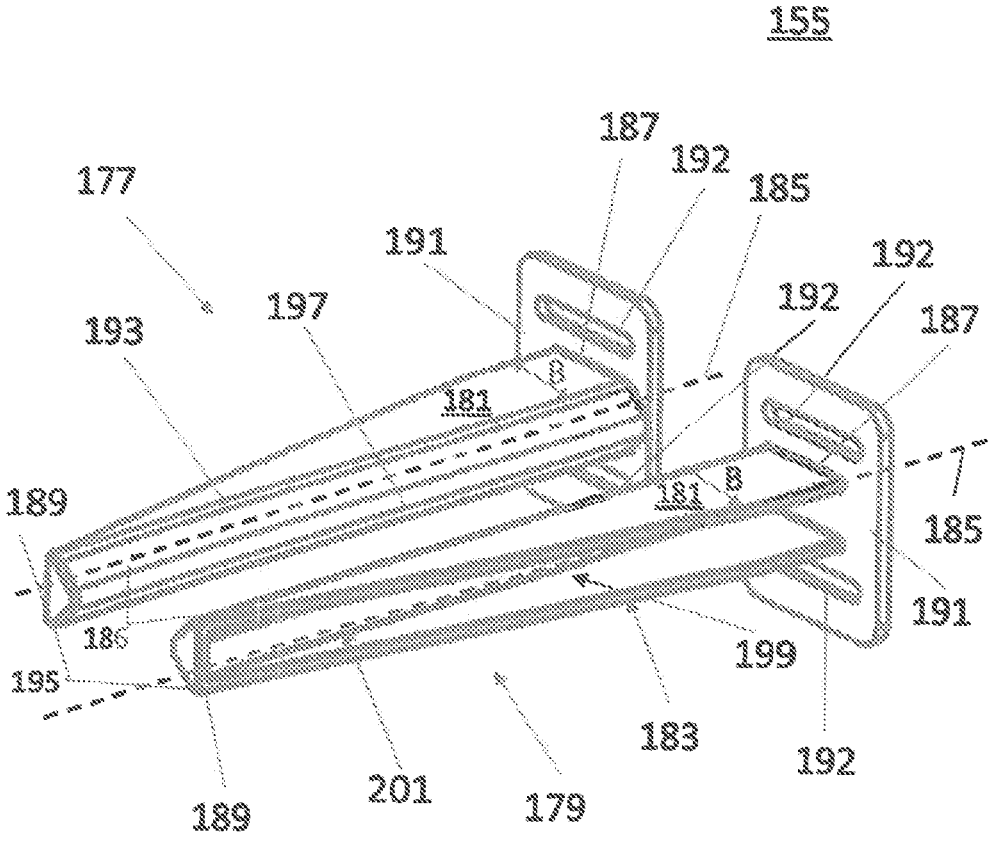
Figures 17A, 17B:
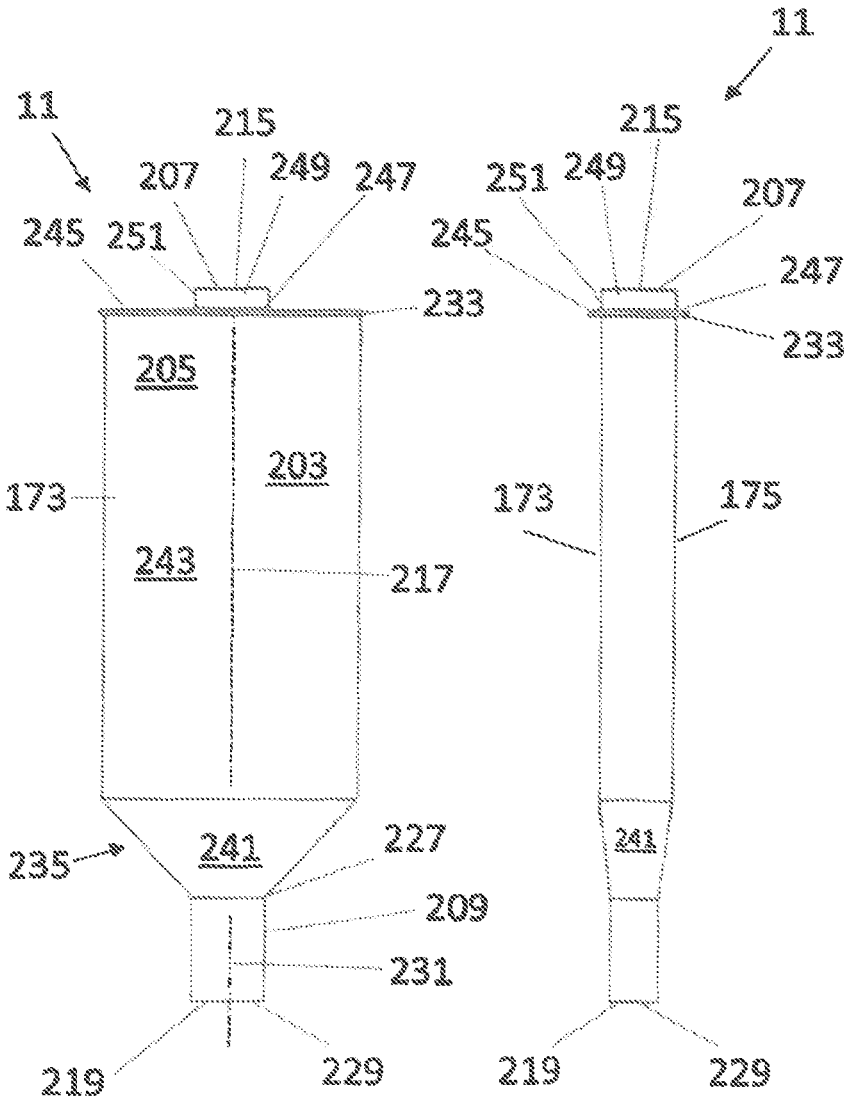
Figure 18:
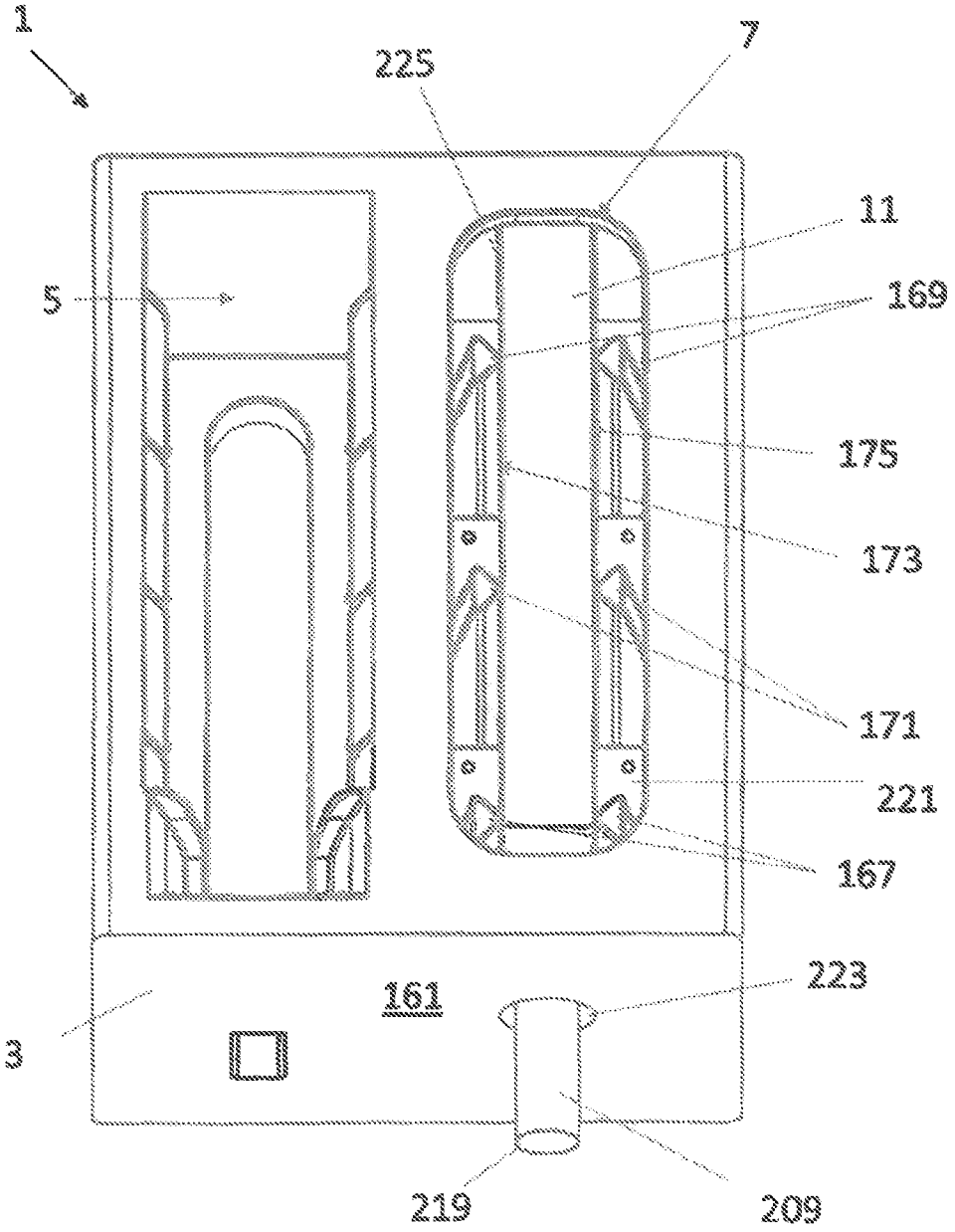
Figure 19:
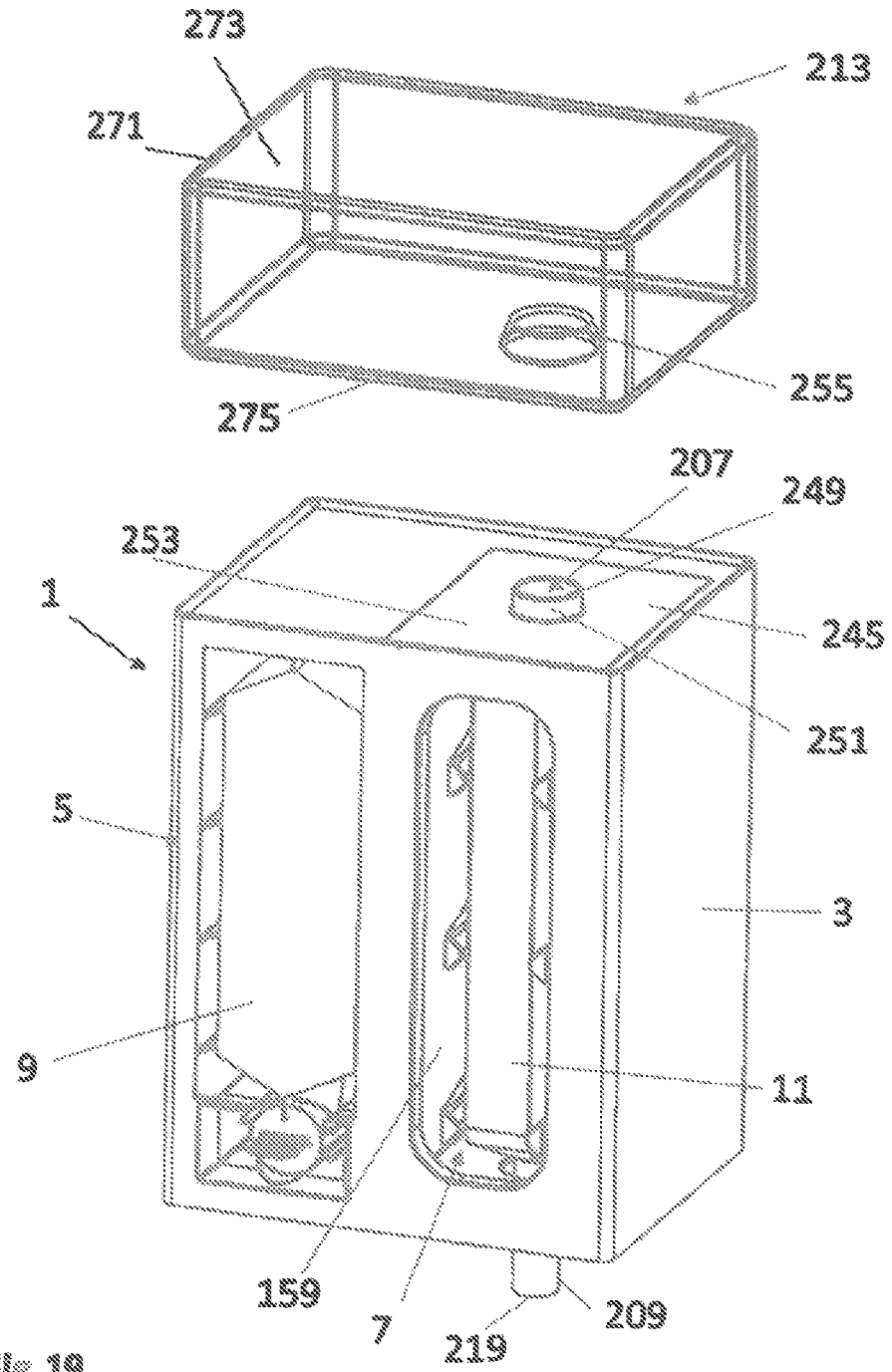
Figure 20:
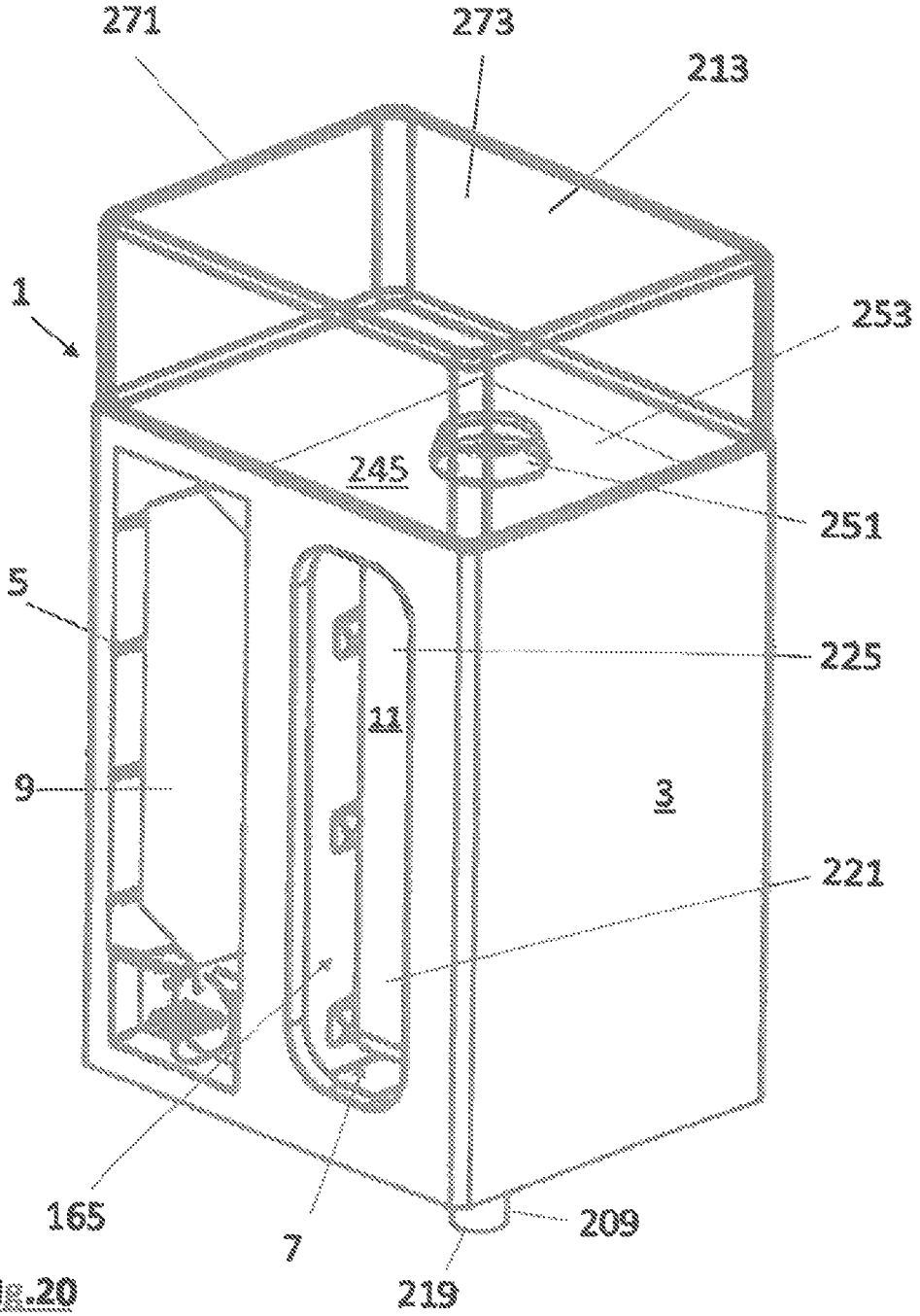
Figure 21:
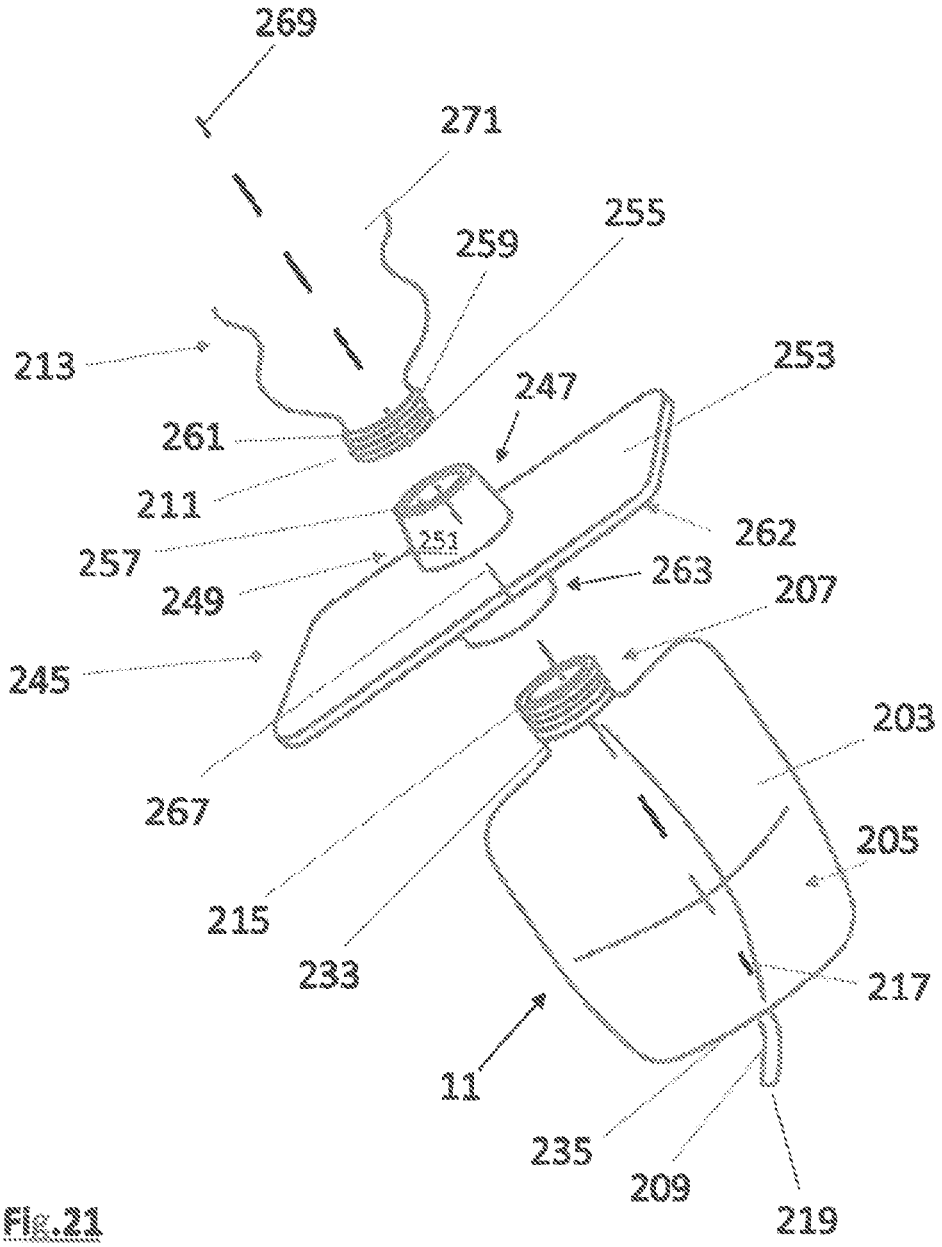
Figure 22:
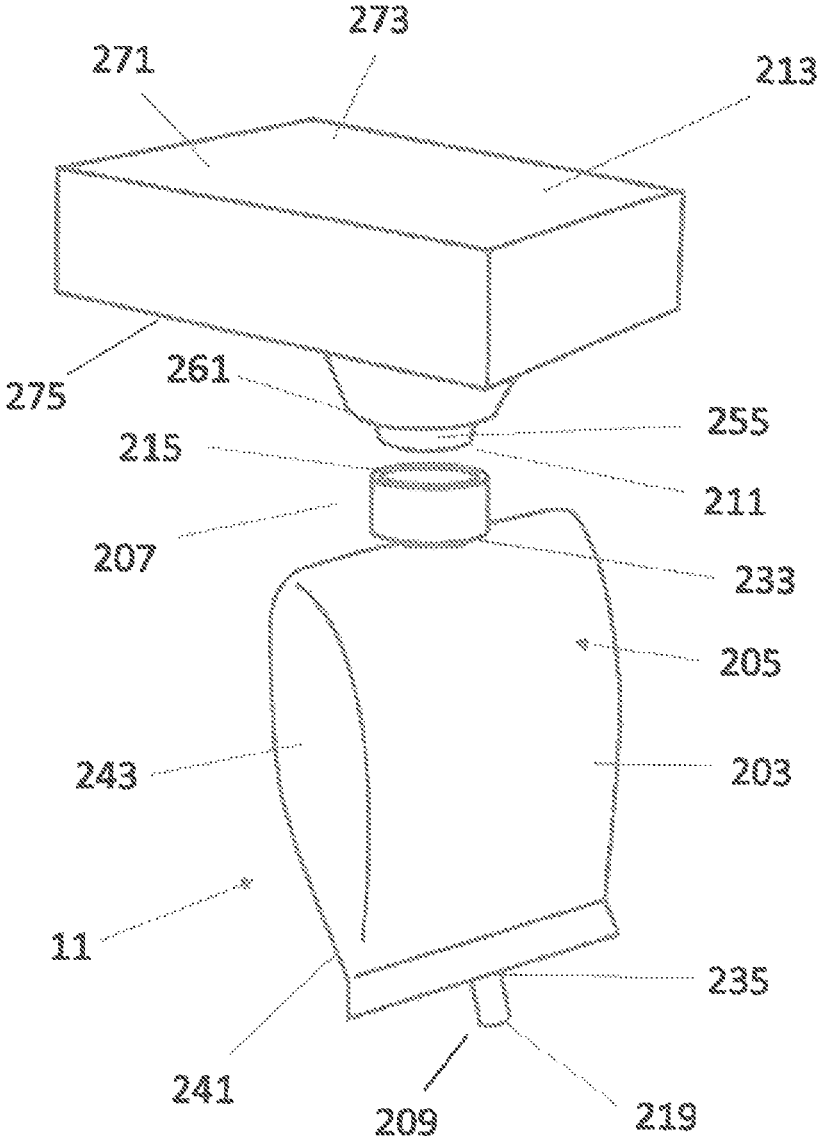
Figure 23A:
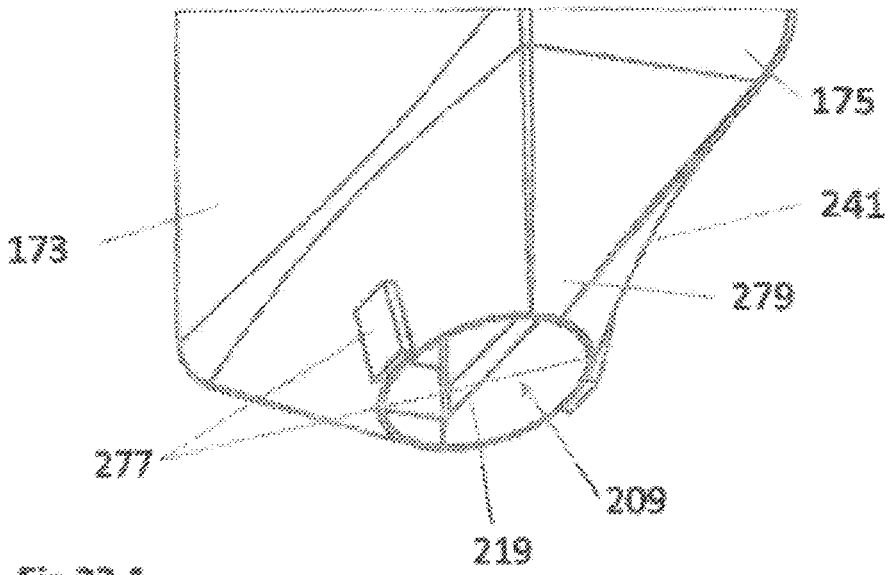
Figure 23B:
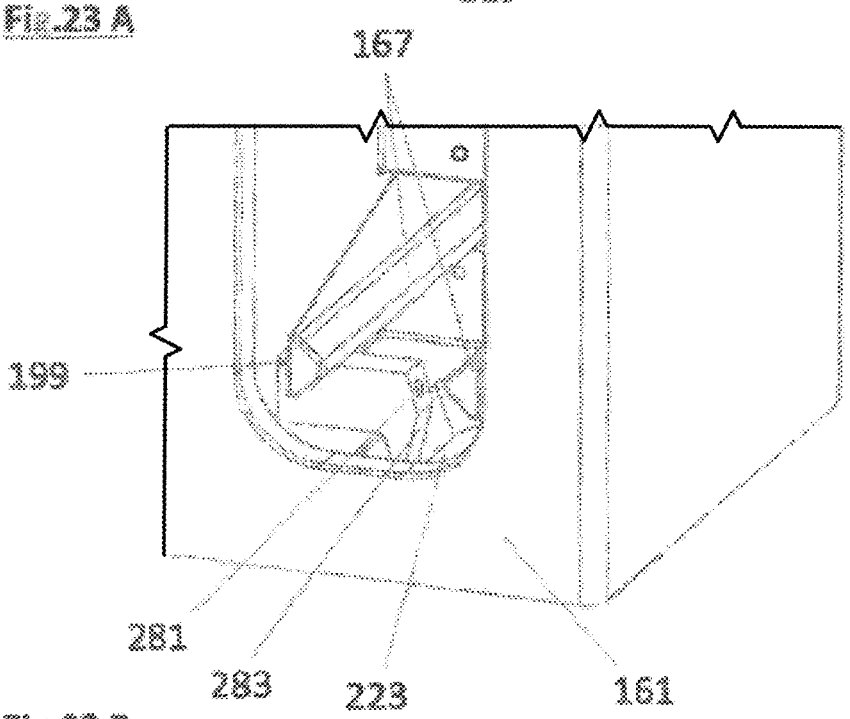
Figure 24:
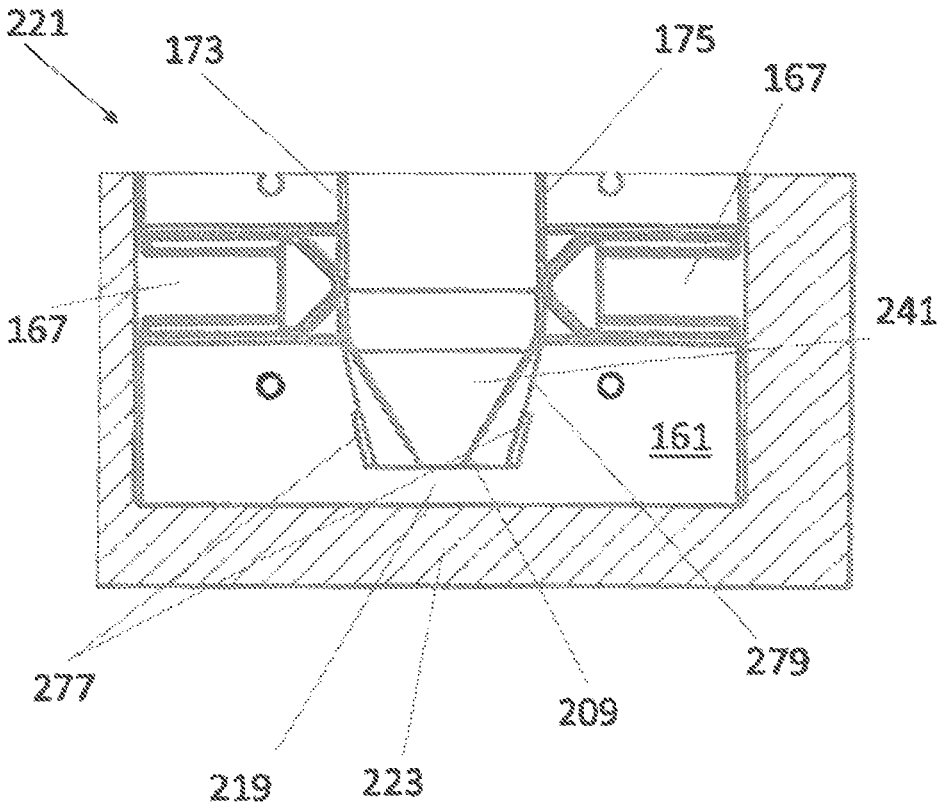
Figure 25B:
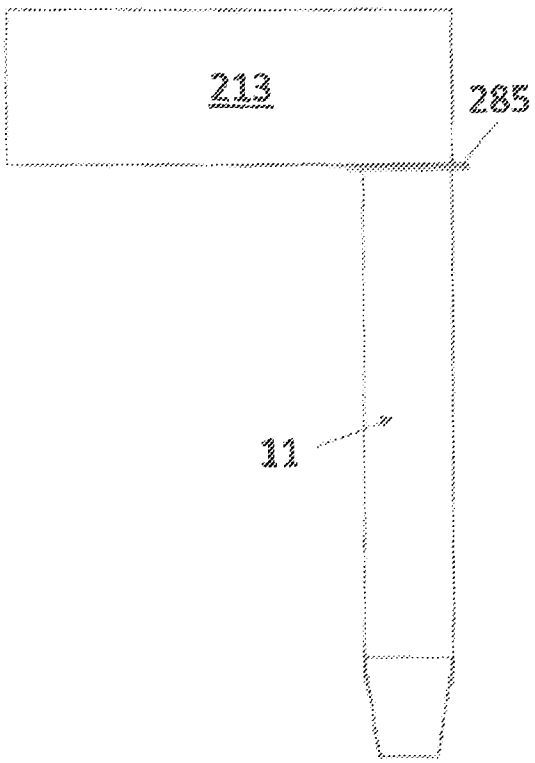
Figure 25A:
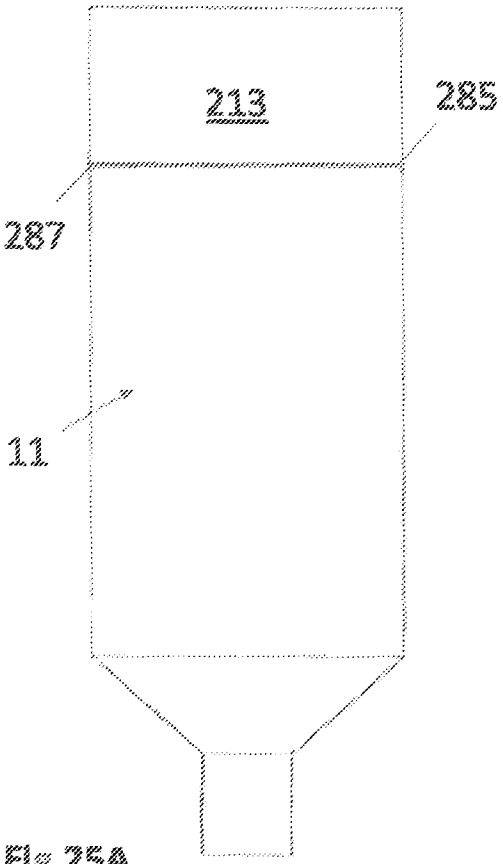
Figure 26:
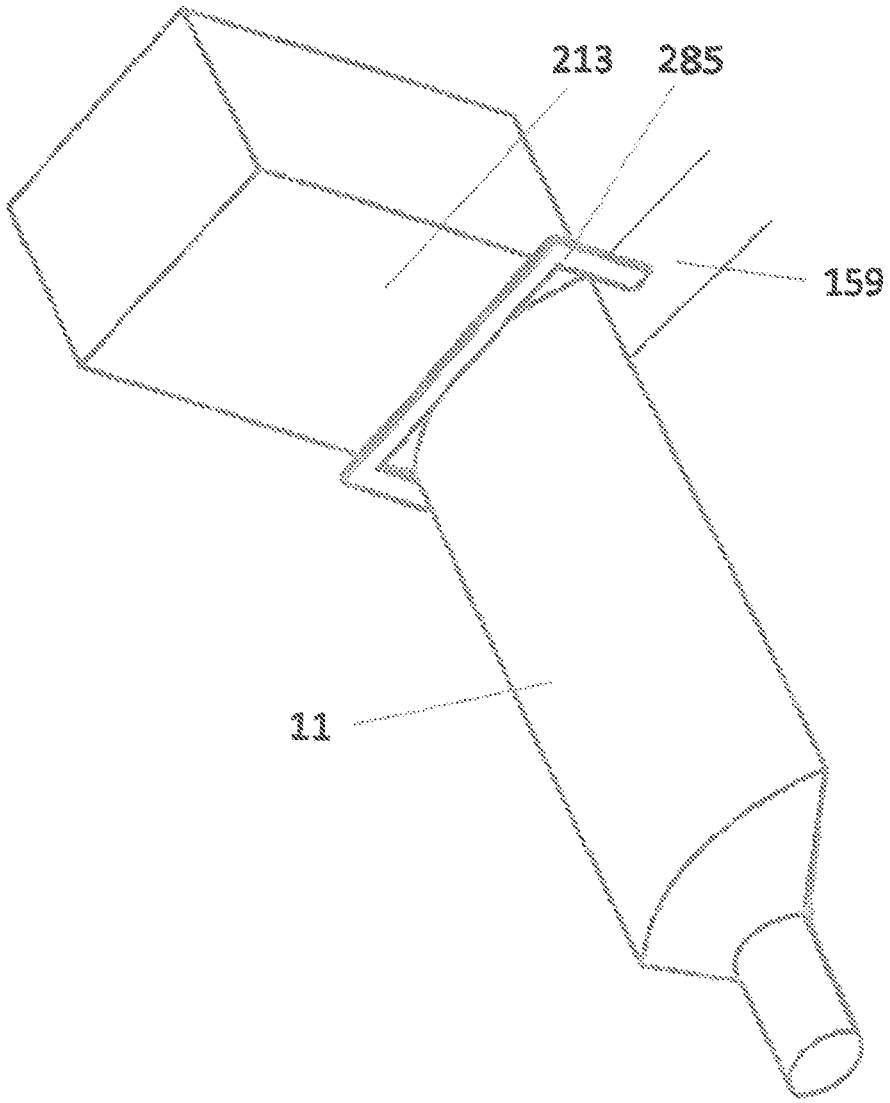
Figure 27:
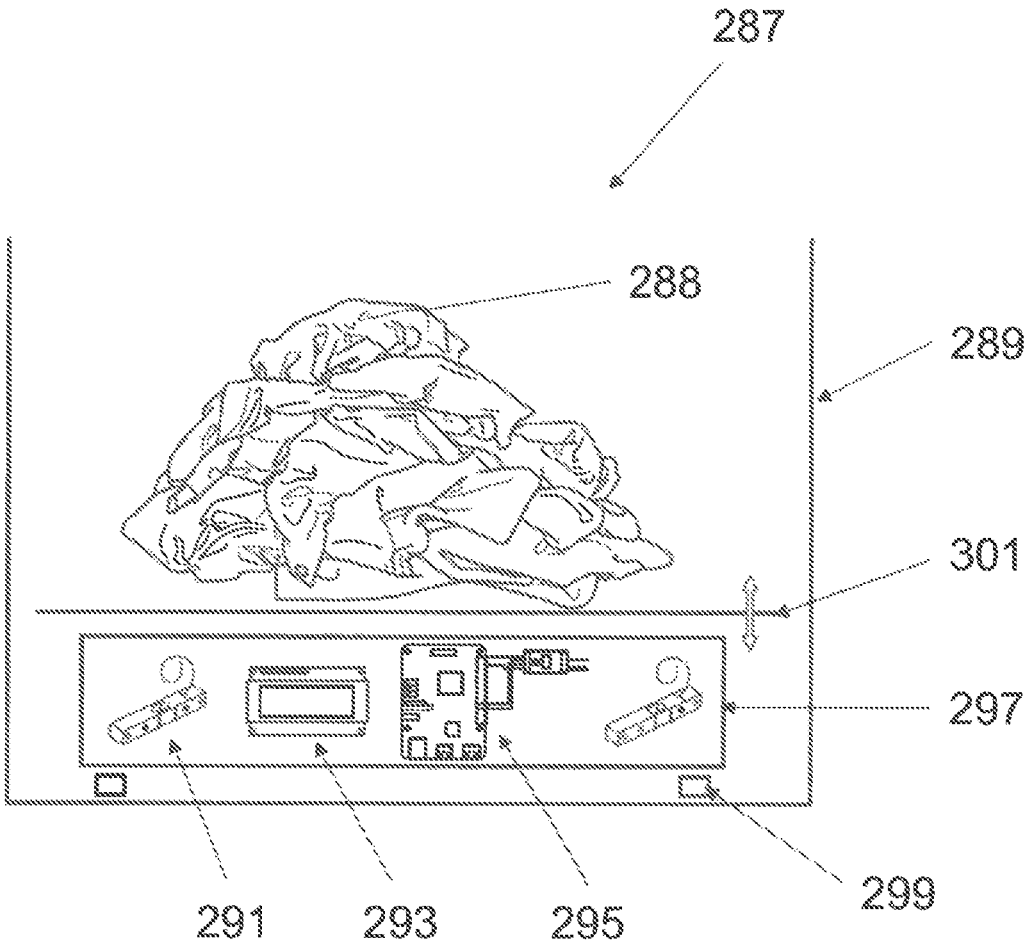
Figure 28:
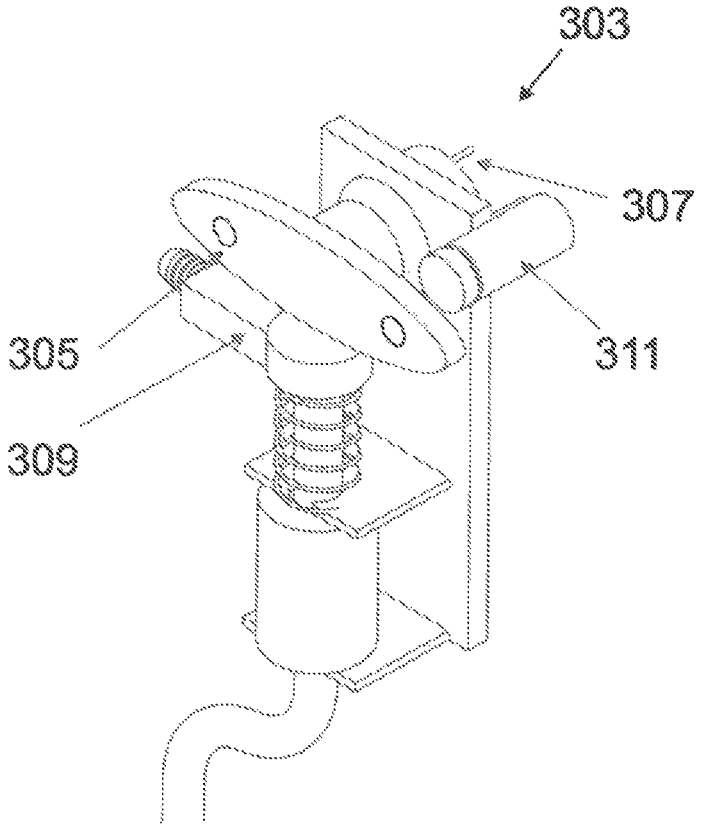
Figure 29:
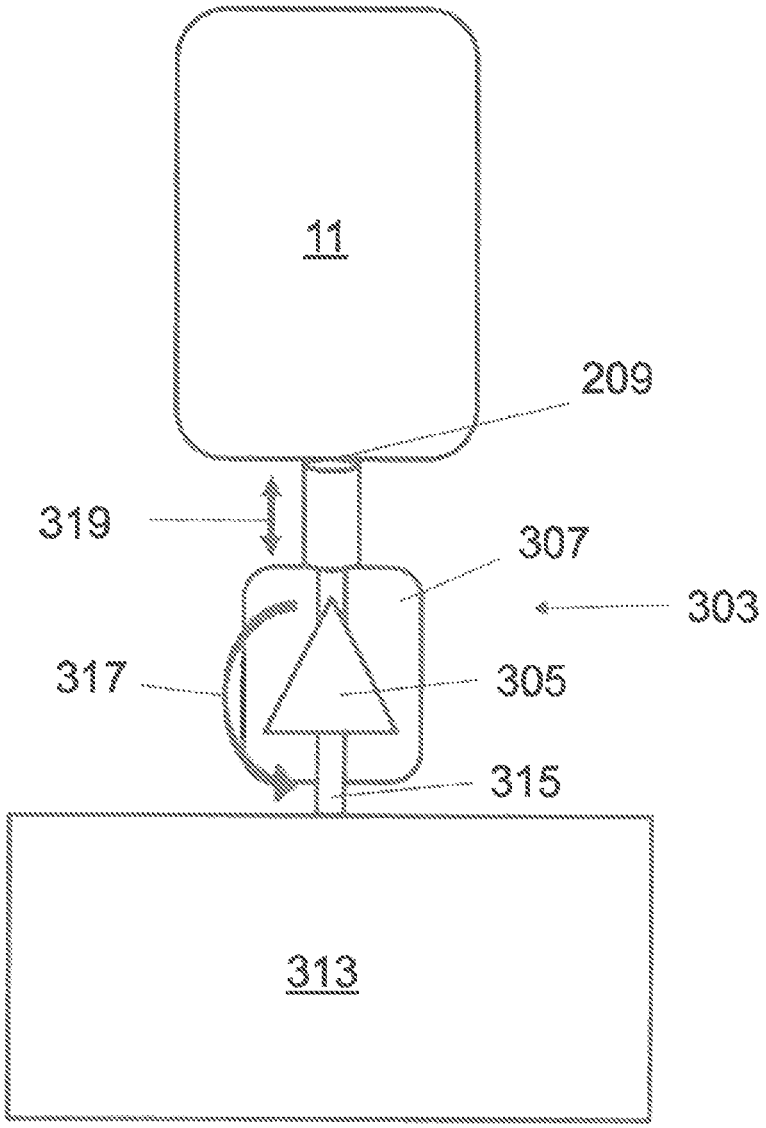
Figure 30C:
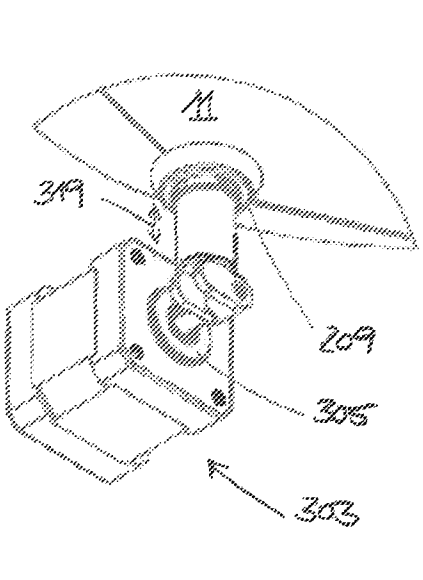
Figure 30B:
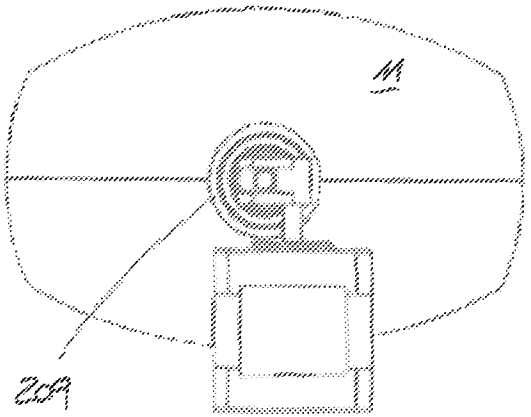
Figure 30A:
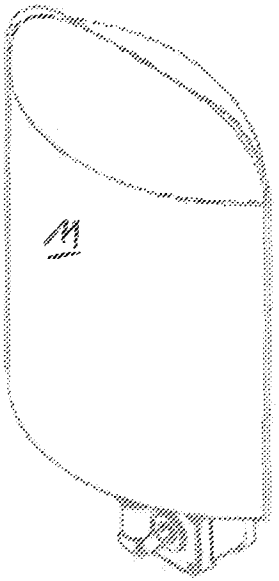

The present invention is explained below with reference only to preferred embodiment drawings, wherein FIG. 1 shows a perspective view of an embodiment of a device according to the invention for dosing detergent, in which a dosing device with a screw conveyor and a screw conveyor housing is accommodated, FIG. 2 shows a front view of the embodiment of FIG. 1, FIG. 3 shows a perspective view of a section of the embodiment of FIG. 1, FIG. 4 shows a perspective view of the dosing device receptacle without the dosing device picked up, FIG. 5 shows a perspective view of the screw conveyor, FIG. 6 shows a perspective view of the screw conveyor housing from above, FIG. 7 shows a perspective view of the screw conveyor housing from below, FIG. 8 shows a sectional view of the dosing device receptacle, wherein the dosing device with the screw conveyor and the screw conveyor housing is received in the dosing device receptacle, FIG. 9 shows a front view of the dosing device receptacle with the dosing device accommodated, FIG. 10 shows a side view of a first embodiment of a container connectable to a dosing device, FIG. 11 shows a side view of a further embodiment of a container connectable to a dosing device, FIG. 12 shows a side view of a further embodiment of a container for holding and dosing powder detergent, FIG. 13 shows a plurality of further embodiments of a container connectable to a dosing device, FIG. 14 shows another embodiment of a container connectable to a dosing device, FIG. 15A shows a perspective view of the detergent dispensing device of FIG. 1, with the second container not yet inserted and received in the second receiving area, FIG. 15B front view of the second receiving area of the device of FIG. 15A shows the second container being inserted into the second receiving area, FIG. 15C shows a front view of the second receiving area of the device of FIG. 15A, wherein the second container is received in the second receiving area, FIG. 16 shows a perspective view of a pair of clamping elements of the second pickup area, FIG. 17A shows a first side view of the second container, FIG. 17B shows a second side view of the second container, FIG. 18 shows a perspective view of the device for dosing detergent from below, FIG. 19 shows a perspective view of the detergent dispensing device, wherein the liquid detergent reservoir is not connected to the second liquid detergent container, FIG. 20 shows a perspective view of the detergent dispensing device, wherein the liquid detergent reservoir is connected to the second container of liquid detergent, FIG. 21 shows a perspective view of an embodiment of the liquid detergent reservoir and the second container, which are connectable to each other by means of a essentially horizontal plate, FIG. 22 shows a perspective view of another embodiment of the liquid detergent reservoir and the second container, wherein no essentially horizontal plate is provided to connect the liquid detergent reservoir and the second container, FIG. 23A shows a perspective view of the outlet of the second container, FIG. 23B shows a perspective view of the lower portion of the second pickup area, FIG. 24 shows a frontal view of the lower area of the second pick-up area with picked-up second container, FIG. 25A shows a first side view of a combination container comprising the second container and the liquid detergent reservoir, FIG. 25B shows a second side view of the combination container of FIG. 25A, FIG. 26 shows a perspective view of the combination container of FIGS. 25A and 25B, which is positioned by means of a positioning and holding device, FIG. 27 shows a schematic drawing of a scale system connected or connectable to a laundry basket, FIG. 28 shows a lifting system for dosing liquid detergent, FIG. 29 shows a schematic drawing of a lifting system connected to the second container, FIG. 30A shows a perspective side view of a second container with a lifting system, FIG. 30B shows a bottom view of the second container shown in FIG. 30A with a lifting system, and FIG. 30C shows a perspective side view of the lifting system connected to the second container of FIG. 30A.

First, with reference to FIGS. 1 to 9, an embodiment example of a device 1 for dosing detergent, in particular powder detergent and/or liquid detergent, is explained.

In this embodiment, the device 1 for dosing detergent comprises a first receiving area 5 designed to receive a first container 9 of powder detergent. Furthermore, the device 1 for dosing detergent comprises a second receiving area 7, which is designed to receive a second container 11 with liquid detergent.

The first receiving area 5 may be connectable to the second receiving area 7, or the first receiving area 5 may be connected to the second receiving area 7. At this point, it is expressly pointed out that FIGS. 1 to 9 describe a conceivable embodiment example. Equally well, the device 1 for dosing detergent may comprise a plurality of first receiving areas 5, the first receiving areas 5 each being designed to receive a first container 9 of powder detergent. Further, the device 1 for dispensing detergent may comprise a plurality of second receiving regions 7, the second receiving regions 7 each being designed to receive a second container 11 of liquid detergent. The individual receiving regions 5, 7 are connectable to one another or may be connected to one another. However, the device 1 for dosing detergent may also comprise only a first receiving area 5 for receiving a first container 9 and not comprise a second receiving area 7 for receiving a second container 11. Alternatively, the device 1 for dosing detergent may comprise only a second receiving area 7 for receiving a second container 11 and not comprise a first receiving area 5 for receiving a first container 9.

The first receiving area 5 is designed to at least partially receive a first container 9 for powder detergent. The first receiving area 5 comprises a rear wall 13, two spaced-apart side walls 15, 17, which are oriented at an angle different from 0° or 180°, in particular transversely to the rear wall 13, an upper limitation 19 and a lower limitation 21, which are oriented at an angle different from 0° or 180°, in particular transversely to the side walls 15, 17. Furthermore, the first receiving area 5 comprises an at least partially open front side 23 opposite the rear wall 13, so that the first receiving area 5 is formed between the side walls 15, 17, the upper and lower limitations 19, 21, the rear wall 13 and the at least partially open front side 23. The upper and lower limitations 19, 21 may be arranged e parallel to each other, and the rear wall 31 may be arranged essentially transversely to the upper and lower limitations 19, 21 such that the upper and lower limitations 19, 21 each extend in a plane oriented perpendicular to the plane in which the rear wall is arranged.

In the figure description, terms such as top, bottom, left, right, front, rear, horizontal, vertical, above, below, etc. refer to the exemplary embodiment of a device 1 for dosing detergent selected in the respective figures. In particular, the terms horizontal and vertical refer to the planes in which the upper limitation 19 and the lower limitation 21 of the device 1 extend.

The first receiving area 5 comprises an upper container receiving area 25 for receiving the first container 9 and a lower dosing device receiving area 27 for receiving a dosing device 29. The container receiving area 25 is preferably disposed above the dosing device receiving area 27.

Furthermore, FIGS. 1 to 3 show the second receiving area 7 in the device 1 for dosing detergent, which is designed to at least partially receive a second container 11 for a liquid detergent (in particular liquid). The second receiving area 7 comprises a rear wall, two side walls spaced apart from one another and oriented at an angle different from 0° or 180°, in particular transversely to the rear wall, a lower limitation oriented at an angle different from 0° or 180°, in particular transversely to the side walls, and an open upper side opposite the lower wall, the second receiving area 7 for receiving the second container 11 being formed between the side walls. The side walls of the second receiving area have one or more, preferably a plurality of, clamping elements 155 extending from a front side of the second receiving area 7 opposite the rear wall to the rear wall and configured to position the second container 11 in the device 1 and/or to dispense the liquid detergent inside the second container and/or to store the liquid detergent inside the second container in a sterile manner. In particular, the clamping elements 155 are configured as clamps, with two of the clamps being arranged opposite each other and in a plane parallel to the lower limitation. The distance of the clamping elements 155 relative to the lower limitation and/or relative to the open upper side is variable. The lower limitation of the second receiving area 7 has a through-hole configured to receive an outlet of the second container 11.

With reference to FIGS. 4 to 14, the first receiving area 5, the first container 9, and the dosing device 29 are further described in more detail.

FIG. 4 shows that the dosing device receiving area 27 comprises an actuating and/or driving device 39 for the dosing device 29. The actuation and/or drive device 39 is disposed in or on the rear wall 13 and/or comprises a coupling member or drive shaft 41 extending essentially away from the rear wall 13. The lower limitation 21 comprises a receptacle 43 for the dosing device 29 extending essentially from the open front 23 to the rear wall 13 essentially along a longitudinal receptacle axis 45. The drive shaft 41 in the rear wall 13 and the receptacle 43 for the dosing device 29 extend in the same plane transverse to the lower limitation 21 and/or essentially perpendicular to the receptacle longitudinal axis 45.

In particular, the receptacle 43 has a cross-section transverse to the receiving longitudinal axis 45 of the receptacle which is concave in shape. In other words, the receiving 43 is embedded as a concave portion in the lower limitation 21. The lower limitation 21 may thus have a surface having a first horizontal surface portion 47 adjoining or near to a first of the side walls 15, 17 and a second horizontal surface portion 49 adjoining or near to the second of the side walls 15, 17, the receptacle 43 being disposed as a concave surface portion between the first and second surface portions 47, 49. A receptacle outlet opening 51 may be disposed on the receiving longitudinal axis 45, particularly adjoining or near to the rear rear wall 13.

A first guide member 31 and a second guide member 33 are disposed between the container receiving area 25 and the dosing device receiving area 27, wherein the guide members 31, 33 extend from the open front 23 to the rear wall 13 and/or wherein the guide members 31, 33 extend away from the side walls 15, 17. The guide elements 31, 32 divide the first receiving area 5 into the upper container receiving area 25 and the lower dosing device receiving area 27, such that the upper container receiving area 25 is limited by the upper limitation 19 and by the two guide elements 31, 33 on opposite sides. The lower dosing device receiving area 27 is limited by the two guide elements 31, 33 and the lower limitation 21 on opposite sides. After the first container 9 and the dosing device 29 have been inserted and/or at least partially received in the first receiving area 5, the first container 9 is arranged between the guide elements 31, 33 and the upper limitation 19 and the dosing device 29 is arranged at least partially between the guide elements 31, 33 and the lower limitation 21. The guide elements 31, 33 are oriented essentially in a plane parallel to the upper limitation 19 and the lower limitation 21 and are inclined upwardly out of the plane toward the open front 23 toward the container receiving area 25. The guide members 31, 33 thus have a essentially parallel portion 35 and an inclined portion 37. The essentially parallel portion 35 extends from the rear wall 13 to the inclined portion 37, and the inclined portion 37 extends from the essentially parallel portion 35 to the open front 23.

One or more side walls 15, 17 in the container receiving area 25 comprise a plurality of ribs 53 which extend away from the one or more side walls 15, 17. In particular, the plurality of ribs 53 extend essentially parallel to the upper limitation 19 and/or lower limitation 21. Preferably, the plurality of ribs 53 extend from the open front 23 to the rear wall 13.

In particular, the plurality of ribs 53 is arranged in pairs on the two side walls 15, 17. In each case, two of the ribs 53 extend as pairs of ribs 55 in a plane essentially transverse to the side walls 15, 17 and/or essentially parallel to the upper or lower limitation 19, 21. The pairs of ribs 55 are regularly arranged at preferably equal distances on the side walls 19, 21 in the container receiving region 25, preferably between the guide elements 31, 33 and the upper limitation 19.

The dosing device 29 is designed for dosing the powder detergent from the first container 9 out of the second container 11. In this regard, the dosing device 29 may be connectable to the first container 9. Thus, the dosing device 29 may be connected to the first container 9 so that, when connected to the first container 9, the dosing device 29 may be inserted or received in the first receiving area 5 by a movement essentially perpendicular to the rear wall 13 of the first receiving area 5, as seen.

The dosing device 29 comprises a screw conveyor 57 and a screw conveyor housing 59, which are shown in FIGS. 5 to 7. As shown in FIG. 8, the screw conveyor 57 may be inserted, preferably in its full length, into the screw conveyor housing 59 and rotatably disposed therein so that the screw conveyor 57 and the screw conveyor housing 59 extend approximately a common screw conveyor longitudinal axis 61. In the following, the features of the screw conveyor 57 and the screw conveyor housing 59 are described in relation to the common longitudinal screw conveyor axis 61, even if the screw conveyor 57 is not inserted into the screw conveyor housing 59, as shown in FIGS. 5 to 7.

The screw conveyor housing 59 comprises an inlet 63 having an inlet opening 35 and/or an outlet 67 having an outlet opening 69. The inlet 63 and the outlet 67 are arranged on opposite sides, as viewed transversely to the screw conveyor longitudinal axis 61, in the screw conveyor housing 59. The screw conveyor housing 59 extends between a first end 71 and an opposite second end 73 along the screw conveyor longitudinal axis 61. The outlet 67 is disposed adjoining or near the first end 71, and the inlet 63 is disposed adjoining or near the second end 73.

In particular, the inlet 63 comprises a flange 75 having a peripheral wall 77, the peripheral wall 77 at least partially surrounding the inlet opening 65 and/or extending essentially in radial direction, away from the screw conveyor housing 59 as viewed along the screw conveyor longitudinal axis 61. As shown in FIG. 6, the peripheral wall 77 extends essentially along a first peripheral wall central longitudinal axis 78. In particular, the peripheral wall central longitudinal axis 78 may have a length of approximately 47 mm. Furthermore, the peripheral wall 77 extends along a second peripheral wall central longitudinal axis 80, which is oriented at an angle different from 0° or 180°, in particular transversely, preferably perpendicularly to the first peripheral wall central longitudinal axis 78, and may in particular have a length of approximately 29 mm.

The flange 75 is configured for connecting the dosing device 29 to the first container 9 and/or for inserting the dosing device 29 into the dosing device receiving portion 27. For example, the peripheral wall 77comprises a first abutment surface 79 and a essentially opposing second abutment surface 81, the first and second abutment surfaces 79, 81 being aligned parallel to each other. These abutment surfaces 79, 81 allow for particularly easy insertion of the dosing device 29 into the dosing device receiving area 27. In particular, during insertion into the dosing device receiving area 27, the abutment surfaces 79, 81 can slide essentially along the guide elements 31, 33 in the first receiving area 5 and/or can essentially abut the lateral guide elements 31, 33 after being received into the dosing device receiving area 27.

In particular, the screw conveyor housing 59 comprises an outer wall 83 having a plurality of ribs or screw conveyor housing ribs 85, the ribs 85 preferably extending in an axial direction at least partially between the first end 71 and the second end 73 of the screw conveyor housing 59. The ribs 85 extend essentially in radial direction, away from the outer wall 83 as viewed from the longitudinal axis 61 of the screw conveyor.

Two of the ribs 85, as a first pair of limiting ribs 87, limit the outlet opening 69 of the screw conveyor housing 59 on opposite sides in the peripheral direction of the outer wall 83. Two more of the ribs 85, as a second pair of limiting ribs 89, limit the outlet opening 69 on opposite sides in the axial direction of the outer wall 83. This embodiment prevents powder detergent from coming into contact with the first receiving area 5, which, unlike the dosing device 29 and the container 9, is not interchangeable.

The screw conveyor 57 comprises a drive end 82 in the direction of the screw conveyor longitudinal axis 61. A coupling device 91 extends from or at the drive end 82 of the screw conveyor 57 essentially along the longitudinal axis 61 of the screw conveyor, the coupling device 91 being configured to interact in a coupling manner, in particular to engage, with the actuating and/or drive device 39 or with the drive shaft 41.

The coupling device 91 may be configured as a essentially cylindrical cavity 93 or receiving, such that after insertion and at least partial reception of the dosing device 29 into the dosing device receiving area 27, the coupling element 41 may be at least partially received in the dosing device receiving area 27 in the (cylindrical) cavity 93. The inner wall 95 of the (cylindrical) cavity 93 preferably comprises an inner profile that is engageable with an outer profile of the outer wall 96 of the coupling element 41. The outer profile of the coupling element 41 has at least one material elevation 97 that can engage or interact with at least one material recess 99 in the inner profile of the cylindrical cavity 93. Thus, the coupling element 91 is configured as a drive shaft so that insertion of the coupling element 41 into the (cylindrical) cavity 93 enables the dosing device 29 to be driven and thus the screw conveyor 57 to rotate.

The screw conveyor 57 is preferably configured as a shaft around which one or more helical flights 101 in the form of flat guide surfaces or sheets or rubber lobes are helically wound, extending transversely away from the screw conveyor longitudinal axis 61 in the form of a worm thread 107.

FIG. 8 shows the dosing device 29 inserted and received by the dosing device receiving area 27 in the first receiving area 5 of the device 1 for dosing detergent. The screw conveyor 57 preferably extends inside the screw conveyor housing 59, wherein the coupling element 41 on the rear wall 13 is inserted into and/or can drive the cylindrical cavity 93 of the screw conveyor 57. Powder detergent introduced into the interior of the screw conveyor housing 59 through the inlet opening 65 may be guided along the one or more helical flights 101 essentially along the screw conveyor longitudinal axis 61 to the outlet 67, and/or exit the interior of the screw conveyor housing 59 through the outlet opening 69. An insertion element or removal element 105 is preferably disposed at the second end 73 of the screw conveyor housing 59.

FIG. 9 shows a front view of the dosing device receiving area 27 with the dosing device 29 inserted. In the state inserted into the dosing device receiving area 27 of the first receiving area 5, the lateral abutment surfaces 79, 81 of the peripheral wall 77 of the dosing device 29 and two of the ribs 85 abut the two guide elements 31, 33. In particular, the abutment surfaces 79, 81 may abut the edges 107 of the guide elements 31, 33 extending away from the side walls 15, 17, and the two ribs may abut the underside 109 of the two guide elements 31, 33 facing the lower limitation 21.

With reference to FIGS. 10 to 14, embodiments of the first container 9 for holding and/or dosing powder detergent are described.

As can be seen from FIG. 10, the first container 9 may comprise a housing 111 having an interior space 112 for receiving powder detergent and an outlet 113 in communication with the interior space 112. The first container 9 is configured to be inserted and/or received, at least in part, in a device 1 for dispensing detergent as previously described in the context of FIGS. 1 to 9.

The outlet 113 is connectable to an inlet of a dosing device 29 comprising a screw conveyor 57 and a screw conveyor housing 59, wherein the screw conveyor 57, preferably in its full length, is inserted into the screw conveyor housing 59 and is rotatably arranged so that the screw conveyor 57 and the screw conveyor housing 59 extend around a common longitudinal axis, the screw conveyor longitudinal axis 61. The outlet 113 of the first container 9 is connectable to the inlet 63 of the screw conveyor housing 59, the screw conveyor housing 59 having an outlet 67 such that a predetermined or predeterminable amount (or dosage) of powder detergent is dispensed through the outlet 67 by actuation of the dosage means 29. The outlet 113 of the first container 9 may be screwed or bonded to the inlet 63 in the screw conveyor housing 59, or the inlet 63 may be, however the screw conveyor housing 59 may also be integral with or fixed to the first container 9.

The first container 9 may comprise an inlet opening 115, the inlet opening 115 preferably being arranged essentially opposite the outlet 113 and/or an outlet opening 117 in the outlet 113. The inlet opening 115 may be closable by means of a closure element 119, preferably by means of a zipper or zipper. The closure element 119, preferably the zipper, is designed to be at least partially inserted into a groove in the first receiving area 5 of the device 1 for dispensing detergent.

Adjoining or near to the closure element 119 is a tab 121 having an inner opening 123. The inner opening 123 can serve as a carrying handle, such that the first container can be carried from one location to another location in a simplified manner.

As can be seen in FIGS. 11 and 12, the first container 9 at least partially comprises a tapered portion 125, wherein the periphery of the first container 9 in the tapered portion 125 reduces or tapers (preferably essentially conically) towards the outlet 113.

The first container 9 may comprise a cross-section transverse to the screw conveyor longitudinal axis 61 of the screw conveyor housing 59 (as viewed when connected to the first container 9), the tapered portion 125 being laterally limited by a first side edge 135 and a second side edge 137. The first lateral edge 135 may extend essentially at an angle different from 0° or 180°, in particular essentially transversely, preferably at an angle less than 90°, more preferably at an angle of approximately 45°, with respect to the plane of the screw conveyor longitudinal axis 61 of the screw conveyor housing 59 (as seen in the connected condition). The second lateral edge 137 may extend at an angle different from 0° or 180°, in particular essentially transversely, preferably at an angle less than 90°, particularly preferably at an angle of approximately 45°, to the plane of the longitudinal conveying screw axis 61 of the conveying screw housing 59. The first side edge 135 and/or the second side edge 137 may each comprise a side edge portion 136 that may extend at an angle of 90° to the plane of the screw conveyor longitudinal axis 61 of the screw conveyor housing 59 (as viewed when connected). The side edge section 136 may extend in the plane of the first side edge 131 or the second side edge 133 of the essentially symmetrical section.

The first container 9 may at least partially comprise a first essentially symmetrical section 127. The periphery of the first container 29 within the first essentially symmetrical section 127 is preferably constant. The first essentially symmetrical section 127 is spaced further from the outlet 113 than the tapered section 125. The first container 9 may have a cross-section transverse to the screw conveyor longitudinal axis 61 of the screw conveyor housing 59 as viewed when connected to the first container 9, wherein the first essentially symmetrical section 127 is laterally limited by a first side edge 131 and a second side edge 133. The first side edge 131 and the second side edge 133 are oriented essentially parallel to each other and/or at an angle different from 0° or 180°, in particular essentially transversely, preferably at an angle of approximately 90°, with respect to the plane of the screw conveyor longitudinal axis 61 of the screw conveyor housing 59 (as seen in the connected state). The first side edge 131 of the first essentially symmetrical section 127 may be coplanar with the first side edge 135 of the tapering section 125 and/or the second side edge 133 of the first essentially symmetrical section 127 may be oriented at an angle different from 0° or 180°, in particular essentially transverse to the second side edge 137 of the tapering section 125.

Adjoining or near to the outlet 113, the first container 9 may comprise a second essentially symmetrical section 129, wherein the periphery of the first container 9 within the second essentially symmetrical section 129 preferably remains essentially the same and essentially corresponds to the periphery of the outlet 113 and/or the periphery of an outlet opening in the outlet 113. The second essentially symmetrical section 129 may serve as an outlet through which the powder detergent may be passed from the interior space 112 of the first container 9. The side edges 139 and 141 of the second essentially symmetrical section 129 may preferably have a length of 10 to 30 mm, particularly preferably a length of 15 mm.

However, it is also conceivable that the side edges 139 and 141 of the second essentially symmetrical section 129 have a length of greater than 30 mm, preferably between 70 and 110 mm, particularly preferably of 90 mm. This can be provided in particular if the dosing is not carried out by means of the dosing device 29 with a screw conveyor 58 and a screw conveyor housing 59, as previously described, however if clamping elements or clamps are provided adjoining or near to the side walls 15, 17 in the first receiving area 5 for dosing the powder washing detergent, which are designed analogously to the clamping elements 155 or clamps described later in connection with the second container 11 and the second receiving area 7.

The first container 9 may comrpise a cross-section transverse to the screw conveyor longitudinal axis 61 of the screw conveyor housing 59 as viewed when connected to the first container 9, the second essentially symmetrical section 129 being laterally limited by a first side edge 139 and a second side edge 141 oriented essentially parallel to each other. The first side edge 139 and the second side edge 141 extend at an angle different from 0° or 180°, in particular essentially transversely, preferably at an angle of approximately 90°, with respect to the plane of the screw conveyor longitudinal axis 61 of the screw conveyor housing 59 (as seen in the connected state). The first side edge 139 of the second essentially symmetrical section 129 may be coplanar with the first side edge 135 of the tapered section 125 and with the first side edge 131 of the first essentially symmetrical section 127.

The tapered section 125 is disposed between the first essentially symmetrical section 127 and the second essentially symmetrical section 129. The second essentially symmetrical section 129 preferably has a periphery that is smaller than the periphery of the first essentially symmetrical section 127, and the second essentially symmetrical section 129 surrounds a volume of the first container 29 that is smaller than a volume surrounding the first essentially symmetrical section 127.

FIG. 13 shows further, conceivable embodiments of the first container 9, which is connectable to the dosing device 29 and/or which is configured to be inserted and received in the previously described device 1 for dosing detergent. The dosing device 29 may comprise a plate 143, which is configured as a stand plate and may be arranged on the screw conveyor housing 59 and/or connectable to the screw conveyor housing 59. This stand plate 143 serves in particular to better position or align the first container 9 and/or to protect it from falling over, in particular when the first container 9 is positioned to receive powder detergent. It is further conceivable that the screw conveyor housing 59 comprises an enclosure 145, wherein the enclosure 145 comprises at least one flat surface 147 serving as a stand plate and/or a stand foot, so that the first container 9 can be better positioned and protected from falling over. However, it is also conceivable that the first container 9 comprises another essentially symmetrical section instead of the tapering section 125. In this case, the first side edges 131, 135, 139 of the three sections may extend in a plane and the second side edges 133, 137, 141 may extend in a plane, the two planes being oriented essentially parallel to each other.

FIG. 14 shows a further embodiment of the first container 9, in which one and the same opening 117 serves to receive the powder detergent into the first container 9 and to remove the powder detergent from the first container 9. In this case, the opening corresponds to the outlet opening 117, so that the first container 9 does not comprise a separately formed inlet or inlet opening. The powder detergent is first received into the first container 9 through the outlet 113 or outlet opening 117, and the outlet 113 is thereafter connected to the dosing device 29. In particular, after receiving the powder detergent, the outlet 117 may be connected to the inlet 63 of the dosing device 29 by means of a connecting element 149, for example an adhesive element in the form of an adhesive strip 151, or a clip 153.

Referring to FIGS. 15A to 24, the second receiving area 7 of the device 1, the second container 9, and the dosing device 29 are described in more detail.

As shown in FIG. 15A, the second receiving area 7 comprises a rear wall 157, two spaced apart side walls 159 oriented transversely to the rear wall 157, a lower limitation 161 oriented transversely to the side walls 159, and an open top 163 opposite the lower limitation 161. The second receiving area 7 for receiving the second container 11 is formed between the side walls 159. Adjoining or near to the side walls 159 is a plurality of clamping members 155 extending at least partially between a front face 159 opposite the rear wall 157 and the rear wall 165 of the second receiving area 7.

The embodiment of the second receiving area 7 shown in FIGS. 15A to 15C comprises three pairs of clamping elements 167, 169, 171 arranged adjoining or near to the side walls 159. Each of the pairs of clamping elements 167, 169, 171 is arranged in a plane essentially parallel to the lower limitation 161 of the second receiving region 7. The clamping elements 155 may be in the form of clamps, each two of the clamps being arranged opposite each other and in the plane parallel to the lower limitation 161 of the second receiving area 7.

A first of the clamping element pairs 167, 169, 171 is arranged as a lower clamping element pair 167 such that the clamping elements of the first, lower clamping element pair 167 have a first distance D1 to the lower limitation 161. A second of the pairs of clamping elements 167, 169, 171 is arranged as an upper pair of clamping elements 169 such that the clamping elements of the second, upper pair of clamping elements 169 have a second distance D2 to the lower limitation 161, which is greater than the first distance D1 to the lower limitation 161. The first, lower pair of clamping elements 167 is arranged adjoining or near to the lower limitation 161 in the second receiving region 7. The second, upper pair of clamping elements 169 is arranged adjoining or near to the open top 163. Further, a third of the clamping element pairs 167, 169, 171 may be arranged as a middle clamping element pair 171 between the first clamping element pair 167 and the second clamping element pair 169 and comprise a third distance D3 from the lower limitation 161 that is greater than the first distance D1 and less than the second distance D2.

The distance or spacing of the clamping elements 155 relative to the lower limitation 161 or relative to the open top 163 is variable. In particular, the third, middle pair of clamping elements 171 is height-adjustable in that the third distance D3 is variable. This enables precise dosing of the desired amount of liquid detergent (in particular amount of liquid) for dosing detergent. However, the first, lower clamping element pair 167 and the second, upper pair clamping elements 169 can also be adjustable in height, so that the first distance D1 and the second distance D2 can be changed.

The second container 11 may be inserted into the second receiving area 7 as shown in FIGS. 15A and 15B, and received by the second receiving area 7 as shown in FIG. 15C. FIG. 15C shows the state of the second container 11 received in the second receiving area 7. The second container 11 is inserted into the second receiving area 7 by a essentially perpendicular movement as viewed from the lower limitation 161.

In the condition received in the second receiving area 7, the second container 11 is laterally held or clamped by three pairs of clamping elements 167, 169, 171. In this regard, the three pairs of clamping elements 167, 169, 171 can assume a first position (see FIG. 15C) and a second position (not shown). In the first position, the three pairs of clamping elements 167, 169, 171 laterally adjoining and/or contact the second container 11 such that the pairs of clamping elements 167, 169, 171 exert pressure on opposing first and second sidewalls 173, 175 of the second container 11. In the second position, the three pairs of clamping elements 167, 169, 171 do not abut and/or contact the second container 11 such that the pairs of clamping elements 167, 169, 171 do not exert pressure on the side walls 173, 175 of the second container 11.

FIG. 16 shows an embodiment of one of the three clamping element pairs 167, 169, 171 and the arrangement of a first clamping element 177 and a second clamping element 179 of one of the clamping element pairs 167, 169, 171 relative to each other. In the position in which the first clamping element 177 and the second clamping element 179 are arranged relative to each other, the individual clamping elements of the three pairs of clamping elements 167, 169, 171 are also arranged relative to each other in the second receiving region 7.

Each of the clamping members 155, 177, 179 comprises a first clamping member surface 181 and a second clamping member surface 183, wherein the clamping member surfaces 181, 183 are arranged on opposite sides of a longitudinal clamping member axis 185, preferably wherein the two clamping member surfaces 181, 183 are connected by means of a third clamping member surface 186, and wherein the third clamping member surface 186 has a essentially conically shaped cross-section transverse to the longitudinal clamping member axis 185.

The first and second clamping element surfaces 181, 183 are arranged essentially parallel to each other and each extend in the direction of the longitudinal clamping element axis 185 between a first end 187 and a second end 189. The first clamping element surface 181 extends in a first plane and the second clamping element surface 183 extends in a second plane, wherein the first plane and the second plane are aligned parallel to each other and/or wherein the longitudinal clamping element axis 185 is arranged in a plane between the first and second planes. The width B of the two clamping element surfaces 181, 183, i.e., the width B of the two clamping element surfaces 181, 183 at an angle different from 0° or 180°, in particular transverse to the longitudinal clamping element axis 185, tapers from the first end 187 toward the second end 189. Furthermore, each of the clamping elements 177, 179 comprises a connecting plate 191 arranged at an angle different from 0° or 180°, in particular transverse to the longitudinal clamping element axis 185. The first clamping element surface 181 has a first end 187 connected to the connecting plate 191, and the second clamping element surface 183 may have a first end 187 connected to the connecting plate 191.

The connecting plate 191 can be used to connect the individual clamping elements 155, 177, 179 to the second receiving area 7, in particular to the rear wall 157 of the second receiving area 7, so that the clamping elements 155, 179, 179 extend essentially transversely to the rear wall 157 at an angle different from 0° or 180°, in particular transversely, so that the second end 189 of the individual clamping element surfaces 181, 183 are spaced from the rear wall 157 and the clamping elements 155, 177, 179 extend adjoining or near to the side walls 173, 175 between the front 165 and the rear wall 157.

The third clamping element surface 186 extends from a first side edge 193 of the first clamping element surface 181 to a first side edge 195 of the second clamping element surface 183. The first side edges 193, 195 extend in the same plane, which extends at an angle different from 0° or 180°, preferably at an angle of 90°, in particular transverse to the longitudinal clamping element axis 185. The third clamping element surface 186 is arranged at an angle of 90° to the first clamping element surface 181 and to the second clamping element surface 183, and respectively at an angle of 90° to the connecting plate 191 and to the rear wall 157 of the second receiving region 7 when the connecting plate 191 is connected to the rear wall 157. Each of the clamping elements 155, 177, 179 of the individual clamping element pairs 167, 169, 171 may thus have a third clamping element surface 186, the third clamping element surfaces 181 of the individual clamping elements 155, 177, 179 of each clamping element pair 167, 169, 171 being aligned parallel to one another when the clamping elements 155, 177, 179 are connected to the rear wall 157 by means of the connecting plate 191. The connecting plate 191 comprises at least one through-hole 192 so that the clamping elements 155, 177, 179 can be connected to the rear wall 157 by means of a connecting element, for example a screw. However, it is also conceivable that the clamping elements 155, 177, 179 are not connected to the rear wall 157 by means of a connecting plate 191, however that the clamping elements 155, 177, 179 are arranged or connectable displaceably to the rear wall 157 and/or to the side walls 159 of the second receiving area 7 by means of a carriage or by means of a rail or guide rail element.

The third clamping element surface 186 may comprise a clamping element edge 197 extending essentially in the direction of the longitudinal clamping element axis 185 and between the first side edge 193 of the first clamping element surface 181 and the first side edge 195 of the second clamping element surface 183. The clamping element edge 197 extends in the same plane as the clamping element longitudinal axis 185.

The clamping elements 155, 177, 179 have an open configuration opposite the third clamping element surface 186 and as viewed transversely to the longitudinal clamping element axis 185. In other words, each of the clamping elements 155, 177, 179 comprises an inner cavity 199 limited by the three clamping element surfaces 181, 183, 186 and comprises an open side 201. However, it is also conceivable that the clamping elements 155, 177, 179 are formed without an inner cavity 199. In the state of the clamping elements 155, 177, 179 connected to the second receiving area 7, for example when the clamping elements 155, 177, 179 are connected to the rear wall 157 by means of the connecting plate 191 or when the clamping elements 155, 177, 179 are connected to the rear wall 157 and/or the side walls 159 by means of a carriage or rail or guide rail element, the open side 201 of the inner cavity 199 faces one of the two side walls 159 of the second receiving area 7. At least one of the clamping element surfaces 181, 183, 186, preferably the third clamping element surface 186, may be configured as a bearing surface, preferably a rubberized bearing surface. Preferably, each of the clamping elements 155, 177, 179 comprises a spring element (not shown). The spring element may be disposed adjacent or contiguous to the first end 187 of the first clamping element surface 181 or the second clamping element surface 183. The clamping elements 155, 177, 179 may be formed of or comprise an elastomer to provide a uniform surface pressure when the second container 11 is held or clamped by the clamping elements 155, 177, 179.

FIGS. 17A and B show a possible embodiment of the second container 11 for receiving and dosing liquid detergent for dosing detergent, which is configured to be inserted and received in a device 1 for dosing detergent. The second container 11 comprises a housing 203 having an interior space 205 for receiving liquid detergent, an inlet 207 in communication with the interior space 205, and an outlet 209 in communication with the interior space 205. The housing 203 may be formed of a flexible material, such as a sheet material. Further, the inlet 207 of the second container 11 is connectable to an outlet 211 or to an outlet opening 255 of a liquid detergent reservoir 213, such that a dosage of the liquid detergent for dispensing detergent is dispensable through the outlet 209 of the second container 11.

The inlet 207 of the second container 11 comprises an inlet opening 215, preferably arranged essentially opposite the outlet 209 of the second container 11 as viewed in the direction of a longitudinal container axis 217 and/or essentially opposite an outlet opening 219 of the outlet 209 of the second container 11 as viewed in the direction of the longitudinal container axis 217.

Thus, the second container 11 comprises an inlet 207 having an inlet opening 215 and an outlet 209 having an outlet opening 219, the outlet 209 being disposed on a side opposite the inlet 207.

When the second container 11 is inserted into the second receiving area 7 by a essentially vertical movement through the open top 163, the second container 11 is received by the second receiving area 7 such that the outlet 209 is disposed in a lower region 221 of the second receiving area 7, adjoining or near to the first, lower pair of clamping members 167 and adjoining or near to the lower limitation 161. Thus, the outlet 209 of the second container 11 can be passed through the through-hole 223 in the lower limitation 161 of the second receiving region 7, preferably by a essentially perpendicular movement to the lower limitation 161 (see FIG. 18). At the same time, the inlet 207 of the second container 11 is arranged in an upper region 225 of the second receiving region 7, adjoining or near to the open top 163 and adjoining or near to the second, upper pair of clamping elements 169.

The outlet 209 of the container 11 is designed for insertion into the through-hole 223 in the lower limitation 161 of the second receiving area 7.

The outlet 209 of the second container 11 may be configured as an elongated member, for example, the outlet 209 may be tubular and extend between a first end 227 and an opposite second end 229 along a longitudinal outlet axis 231. The outlet 209 comprises an outer diameter that is less than the inner diameter of the through-hole 223 in the lower limitation 161 of the second receiving area 7, allowing the outlet 209 of the second container 11 to pass through the through-hole 223 in the lower limitation 161 of the second receiving area 7 when the second container 11 is inserted into the second receiving area 7. The second end 229 of the outlet 209 may lie in a plane that is below the plane of the lower limitation 161 when the second container 11 is received in the second receiving region 7.

The second container 11 extends between an inlet end 233 and an opposite outlet end 235 along the longitudinal container axis 217. Adjoining or near to the inlet end 233 are the inlet opening 215 and the inlet 207. Adjoining or near to outlet end 235 are outlet 209 and outlet opening 219. The outlet longitudinal axis 231 may extend in the same plane as the container longitudinal axis 217, which corresponds essentially to a central longitudinal axis of the second container 11. However, it is also conceivable that the outlet longitudinal axis 231 extends in a plane parallel to the container longitudinal axis 217.

The second container 11 comprises a first sidewall 173 and an opposing second sidewall 175 extending essentially parallel to the plane of the longitudinal container axis 217 between the inlet end 233 and the outlet end 235. The second container 11 comprises a tapered portion 241 at least partially in the lower region adjacent the outlet end 235, wherein the periphery of the second container 11 decreases, preferably essentially conically, in the tapered portion 241 toward the outlet 209. In the tapering section 241, the distance between the first sidewall 173 and the second sidewall 175 decreases towards the outlet 209, preferably essentially conically. This enables the liquid detergent (in particular, the liquid) to be directed almost entirely from the second container 11 through the outlet 209.

The second container 11 comprises a essentially symmetrical portion 243 at least in part, wherein the periphery of the second container 11 remains the same within the essentially symmetrical portion 243, and wherein the essentially symmetrical portion 243 is spaced further from the outlet 209 of the second container 209 than the tapering portion 241.

In the essentially symmetrical section 243, the first sidewall 173 and the second sidewall 175 each extend in a plane parallel to the plane of the longitudinal container axis 217. The essentially symmetrical section 243 extends between the inlet end 233 and the tapered section 241. In the inserted or received condition of the second container 11 in the second receiving region, the clamping elements 155 of each pair of clamping elements 167, 169, 171 abut the sidewalls 173, 175 in the essentially symmetrical section 243 and apply pressure to the sidewalls 173, 175.

Preferably, the distance between the two side walls 173, 175 in the essentially symmetrical section 243 is between approximately 20 mm to 60 mm (e.g., approximately 30 mm) and/or the length of the two side walls 173, 175 175 in the essentially symmetrical section 243 is in the range of approximately 150 mm to 300 mm (e.g., approximately 220 mm).

The distance between the two sidewalls 173, 175 decreases in the tapered section 241 from approximately 20 mm to 60 mm (e.g., approximately 30 mm) toward the second end 229 of the outlet 209 to approximately 10 mm to 50 mm (e.g., approximately 20 mm). Preferably, the distance between the two sidewalls 173, 175 in the outlet (209) is approximately 10 mm to 50 mm (e.g., approximately 20 mm).

As shown in FIGS. 19 and 20, the inlet 207 of the second container 11 is connectable to an outlet 227 of the liquid detergent reservoir 213 so that liquid detergent (in particular liquid) can be fed from the liquid detergent reservoir 213 to the interior of the second container 111 and by means of the clamping elements 155 of the individual pairs of clamping elements 167, 169, 171, the liquid detergent can be dosed in the desired amount necessary for dosing detergent and fed out of the second container 11 through the outlet 209. The inlet 207 of the second container 11 may be firmly connected, for example screwed or bonded, to the outlet 255 of the liquid detergent reservoir 213. However, the liquid detergent reservoir 213 may also be integral with the second container 11.

The second container 11 may comprise a essentialy horizontal plate 245 disposed adjoining or near to the inlet opening 215 and/or adjoining or near to the inlet 207 of the second container 11. The plate 245 is particularly advantageous when the liquid detergent reservoir 213 is not configured as a dimensionally stable container and/or when it is not a combination container 284 as described later with respect to FIGS. 25A, 25B, and 26. Preferably, the plate 245 is connectable to the second container 11, or the plate 245 is ffirmly connected to the second container 11, or the plate 245 is integral with the second container 11. The plate 245 or suspension tab may be firmly or releasably connectable to the upper portion adjacent the inlet end 233 of the second container 11. The plate 245 may be integrally formed with the second container 11. Preferably, the plate 245 has a surface shape essentially corresponding to the surface shape of a cross-section of the second container 11 at an angle different from 0° or 180°, preferably at an angle of 90°, in particular as viewed transversely to the longitudinal container axis 217 of the second container 11. In this case, the surface shape of the plate 245 is, for example, rectangular. The distance between two opposite sides of the plate is preferably equal to or greater than the distance between two opposite side surfaces, for example the distance between the first side wall 173 and the second side wall 175 of the second container 11, when the second container 11 is inserted and accepted in the second receiving area 7 or when it is filled with a liquid detergent or when a liquid detergent is received in the interior space 205 of the second container 11. As shown in FIGS. 19 and 20, when the second container 11 is received in the second receiving region 7, the plate 245 rests against the edges or edge surfaces of the open top 163 so that the plate 245 at least partially covers the open top 163, preferably completely covers the open top 163.

The plate 245 has a through hole 247, the through hole 247 preferably comprising a first flange 249 having a first peripheral wall 251, the first peripheral wall 251 at least partially surrounding the through-hole 247 and extending at an angle different from 0° or 180°, in particular essentially transversely away from a first side 253 of the plate 245. The first flange 249 is configured to connect the plate 245 to the outlet 211 of the liquid detergent reservoir 213 and/or to an outlet opening 255 of the liquid detergent reservoir 213.

FIGS. 19 and 20 show an embodiment in which the first flange 249 may be connectable to the outlet 211 of the liquid detergent reservoir 213, for example, by a plug-in connection. The liquid detergent reservoir 213 is designed as a tank. Accordingly, the outer diameter of the first flange 249 or the first peripheral wall 251 is slightly smaller than the inner diameter of the outlet 211 of the liquid detergent reservoir 213. Thus, the outlet 211 of the liquid detergent reservoir 213 can be easily plugged onto the first flange 249 and thus connected to the first flange 249 so that the liquid detergent can be reliably introduced into the second tank 11.

FIG. 21 shows an embodiment in which the first flange 249 is connectable to the outlet 211 of the liquid detergent reservoir 213 by a threaded connection. In this case, the liquid detergent reservoir 213 is a bottle in which liquid detergent suitable for dosing detergent is accommodated and which can be purchased, for example, in a supermarket. The first peripheral wall 251 of the first flange 249 comprises a first thread 257, wherein the first thread 257 is disposed on the inner side of the first peripheral wall 251 facing the through-hole 247 in the plate 245. The first thread 257 is configured to threadingly engage a second thread 259 on the exterior of a peripheral wall 261 of the outlet 211 of the liquid detergent reservoir 213.

The plate 245 may be connectable to the second container 11, or firmly connected to the second container 11, or integrated with the second container 11. In particular, the plate 245 may be firmly connected to or integrated with the second container 11 with a second side 262 disposed opposite the first side 253, wherein the through-hole 247 of the plate 245 is fluidly connected to the inlet 207 of the second container 11.

As shown in FIG. 21, the through hole 247 may comprise a second flange 263 having a second peripheral wall 265, the second peripheral wall 265 at least partially surrounding the through hole 247 and extending essentially transversely away from the second side 262 of the plate 245. The second flange 263 is configured to connect the plate 245 to the inlet 207 and/or to the inlet port 215 of the container 11.

The second flange 263 and the second peripheral wall 265 are disposed on the second side 262 of the plate 245 such that the second flange 263 and the second peripheral wall 265 at least partially surround the through-hole 247 of the plate 245. The second flange 263 and the second peripheral wall 265 are essentially the same as the first flange 249 and the first peripheral wall 251. The first flange 249 and the second flange 263 surround the same flange central longitudinal axis 267, which extends at an angle different from 0° or 180°, in particular transversely to the plane of the plate 245 and/or through the through opening 247 of the plate 245. Thus, the plate 245 is connectable to the liquid detergent reservoir 213 by means of the first flange 249 and to the inlet 207 of the second container 11 by means of the second flange 263, wherein a liquid detergent reservoir central longitudinal axis 269 of the liquid detergent reservoir 213 and the container longitudinal axis 217 of the second container 11 are in the same straight line with the flange central longitudinal axis 267 when the liquid detergent reservoir 213, the plate 245 and the second container 11 are connected to each other.

FIG. 22 shows an embodiment in which the inlet 207 of the second container 11 is directly connectable to the outlet 211 of the liquid detergent reservoir 213. The liquid detergent reservoir 213 is designed such that a plate 245 is not required. The outlet 211 of the liquid detergent reservoir 213 can be connectable to the inlet 207 of the second container 11 by means of a plug-in connection or by means of a screw connection as previously described. In the embodiment example shown in FIG. 22, the inlet 207 of the second container 11 has the first thread 257 on the inner side of the inlet 207 facing the inlet opening 215, and is screw connectable to the second thread 259 on the outer side of the outlet 211 as seen relative to the outlet opening 255 of the liquid detergent reservoir 213. The liquid detergent reservoir 213 comprises a housing 271 having a top surface 273 and a bottom surface 275, the top surface 273 and the bottom surface 275 being disposed at opposite ends relative to the liquid detergent reservoir central longitudinal axis 269. The outlet 211 of the liquid detergent reservoir 213 is arranged at the underside 275, the underside 275 extending in a essentially horizontal plane, or in a plane at an angle different from 0° or 180°, in particular at an angle of 90°, as viewed transversely to the liquid detergent reservoir central longitudinal axis 269. By virtue of its configuration, the underside 275 performs the function of the plate 245.

As shown in FIGS. 23A and 23B, the second container 11 comprises at least one first magnet 277, wherein the at least one first magnet 277 is preferably disposed on an outer wall 279 of the tapered portion 241 of the second container 11, and wherein the at least one first magnet 277 is connectable to at least one second magnet 281 adjoining or near to the through hole 223 in the lower limitation 161 of the second receiving region 7. The at least one second magnet 281 is disposed on an inner wall 283 of the through hole 223. The at least one first magnet 277 may comprise a first magnetic plate and a second magnetic plate arranged on opposite sides at an angle different from 0° or 180°, in particular transverse to the longitudinal axis 217 of the container. The at least one second magnet 281 may comprise a first magnetic contact and a second magnetic contact disposed on opposite sides of the through hole 223 on the inner wall thereof. As shown in FIG. 24, the second container 11 can be correctly received or placed in the second receiving area 7 by the magnets 277, 281 so that the liquid detergent can be fed out of the outlet 209 of the second container 11 for dosing detergent without liquid detergent reaching the housing of the second receiving area 7. Alternatively to the first magnet 277 or the second magnet 281, a metal element (or a metal plate or a metal strip) may be provided in each case.

FIGS. 25A and 25B illustrate a combination container 284, wherein the second container 11 and the liquid detergent reservoir 213 are connected together. The second container 11 and the liquid detergent reservoir 213 may be integrally connected together as a unit, with the liquid detergent reservoir 213 and/or the second container 11 being filled with liquid detergent. In this regard, it is also conceivable that only the liquid detergent reservoir 213 is filled with liquid detergent and the second container 11 or the dispensing area is folded in and attached to the liquid detergent reservoir 213. The liquid detergent reservoir filled with liquid detergent, for example a bottle of a commercially available detergent, may be separated from the second container 11 or from the dosing bag by a clip or by an adhesive strip However, it is also conceivable that the second container 11 and the liquid detergent reservoir 213 are initially manufactured separately and then connected together as previously described, for example by bonding, and filled with liquid detergent. The combination container 284 may also comprise a positioning and holding device 285, which are provided as an alternative to the previously described connecting plate 191 and serve a essentially similar purpose. Preferably, the positioning and retaining device 285 is formed as a clamp or a C-clamp or a C-retaining element having a C-shape. This C-clamp is arranged between the second container 11 and the liquid detergent reservoir 213, preferably at the point where the second container 11 is connected to the liquid detergent reservoir 213. The C-clamp or C-retaining element may be attached, preferably glued, for example to the bottom of the liquid detergent reservoir 213 or to the top of the second container 11.

As FIG. 26 shows, the combination container 284 can be positioned and held by means of the positioning and holding device 285 against one of the side walls 159 of the second receiving area 7, preferably in an upper region of the second receiving area 7. However, it is also conceivable that a lid with an opening is provided (not shown), by means of which the open upper side 163 of the second receiving area 7 can be closed or covered, so that the combination container 284 can be positioned and held on the lid by means of the positioning and holding device 285. In this regard, the positioning and holding device 285 may be arranged around the opening on the lid such that the positioning and holding device 285 surrounds the opening, and the second bag 11 is arranged below the lid and the liquid detergent reservoir 213 is arranged above the lid when the combination container 284 is inserted into the second receiving area 7. The positioning and retaining device 285 prevents the combination container 284, when inserted into the second receiving area 7, from sliding downwardly toward the lower limitation 161 while the liquid detergent is being emptied. Thus, it is ensured that the second container 11 can empty completely.

The previously described device 1 for dosing the detergent can be controllable or adjustable via mobile app. For example, the mobile app may be installed on a user's smartphone so that dosing can be performed by the user at the touch of a button. The dosage then depends on various laundry-specific parameters, such as the type, volume, weight and/or degree of soiling of the laundry. These laundry-specific parameters can be determined by the same mobile app, so that once the laundry-specific parameters have been determined, dosing can be easily initiated by the user. Here, the degree of soiling can be determined either via a camera in a smart device, for example a smartphone, or via a camera that is integrated in or can be coupled with a laundry basket, or via manual setting, for example by means of a button on the device. The hardness level of the water can be preset, for example in the app, and can thus be done depending on the location or geographic position of the washing machine or the device. The weight of the laundry can be determined by augmented reality or by scales.

The mobile app comprises a warning system that is designed to alert the user to a separation of laundry. In other words, if the smartphone camera detects items of laundry that should not be washed together, for example, the user is made aware of this. This can be done by a warning signal issued by the smartphone. However, it is also conceivable that a corresponding message can appear on the smartphone screen.

The mobile app can be designed to order detergent online manually or automatically. The device comprises at least one sensor by means of which the fill level of the first container and/or the second container can be detected. This is then transmitted to the app via the control unit, so that new detergent can be ordered online, for example automatically.

The weight of the laundry can be determined by a scale, for example a hanging scale or a platform scale. The scale can be connected or connectable to a laundry basket, preferably the scale is connected or connectable as a platform scale to the bottom of the laundry basket. However, it is also conceivable that the scale is integrated in a washing machine.

FIG. 27 shows an embodiment of a scale 287 connected to a laundry basket 289. The scale 287 is connected or connectable to the bottom of the laundry basket 289, so that the laundry 288 that is gradually placed in the laundry basket 289 can be measured in a simple manner. The scale 287 comprises at least one weighing cell 291, a display element 293 and/or a control element 295, which are integrated in a box 297. The box 297 is connectable or connected to the laundry basket 289, in particular to the bottom thereof, by at least two connecting elements 299. The scale 287 may further comprise a camera element (not shown) and/or a support plate 301. Thus, the scale 287 can be used to easily measure or select the weight of the laundry 288 acting on the carrier plate. At the same time, the type or material of the laundry items can be determined by means of the camera element. These laundry-specific characteristics are then transmitted by means of the control element to the app, which in turn is in communication with the control unit of the device 1 for dosing detergent. In this way, the device 1 can dose the detergent as a function of these determined values.

FIG. 28 shows a lifting system 303 for dosing liquid detergent. The at least one, second receptacle area 7 can be designed to receive this lifting system, so that the second receptacle area 7 comprises the lifting system 393 as an alternative to the clamping elements 155 or pairs of clamping elements 167, 169, 171. The lifting system 303 comprises a piston pump by means of which the liquid detergent can be dosed and is coupled to the second container 11 (not shown). The lifting system 3003 further comprises a rotating plate 305, which is driven by means of a motor 307 and can exert a pressure on a piston 309. The piston 309 is deflected or moved by the rotating plate 305, and this deflection or movement enables the liquid detergent to be pumped from the second container 11 and properly dispensed. The lifting system further comprises a sensor 311, by means of which the level of the liquid detergent in the second container 11 can be determined.

FIG. 29 shows a schematic drawing of a lifting system 303 connected to the second container 11. In the example shown in FIG. 29, the lifting system 303 is ffirmly connected to the second container 11 in that the lifting system 303 is connected, for example glued or welded, to the opening of the second container 11, for example the outlet 209 of the second container 11. The lifting system 303 is connected or connectable to a container or cup or to the detergent chamber 313 of a commercial washing machine, for example via a hose system 315. Thus, the detergent correctly dosed by means of the lifting system 303 can be filled into the container or cup or directly into the detergent chamber 313 of a commercial washing machine. The container or cup or the detergent chamber 313 is arranged in the direction of gravity below the lifting system 303 connected to the second container 11. Thereby, the lifting system 303 is arranged or positioned between the container or cup or detergent chamber 313 and the second container 11 in the direction of gravity. Thus, the detergent can be easily gravity fed from the second container 11 towards the lifting system 303 and pumped from the second container 11 into the container or cup or detergent chamber 313. The lifting system 303 comprises a piston 309 and a rotating plate 305, which is configured as an eccentric. The eccentric is mounted on a shaft, the center of which lies outside the shaft axis. In the example from FIG. 29, the piston 309 is arranged above the eccentric and its shaft axis in the direction of gravity. The eccentric is connected to the motor 307. In this way, a rotational movement 317 of the eccentric can be converted in an advantageous manner into a translational movement 319 of the piston or into the piston stroke.

FIGS. 30A to 30C show a the previously described second container 11 connected to the previously described lifting system 303.

By means of the previously described device 1 for dosing detergent, the following method can be carried out, the method comprising the following step: Dosing the detergent by means of the dosing device (29), wherein the dosing device (29) comprises a dosing setting for dosing detergent which depends on a determined weight of a laundry to be washed. Further, the method comprises the step of determining or ascertaining the weight of the laundry by means of a scale, for example a hanging scale or a platform scale. The determination or ascertainment of the weight of the laundry may be performed using a scale 287 connected or connectable to a laundry basket 289, preferably the scale 287 is a platform scale connected or connectable to the bottom of the laundry basket 289. The dosage setting for dosing detergent may further depend on a hardness level of a tap water available for washing the laundry and/or on a degree of soiling of the laundry to be washed and/or on a drum size of a washing machine.

The system as previously described comprises a device 1 for dosing detergent, in particular powder detergent and/or liquid detergent, a first container 9 for receiving and dosing powder detergent and a second container 11 for receiving and dosing liquid detergent, so that the detergent can be dosed by means of this system. For this purpose, the first container 9 is designed for receiving and dosing powder detergent and for receiving and interacting with the device 1 for dosing detergent. The second container 11 is designed for receiving and dosing liquid detergent and for receiving and interacting with the device 1. The device 1 comprises the first receiving area 5 designed to receive the first container 9 and to receive and drive the dosing device 29 connectable to the container 9. By driving the dosing device 29 by the actuating and/or driving device 39, which is arranged in the dosing device receiving area 27 within the first receiving area 5, the powder detergent and/or the liquid detergent can be dosed correctly. Furthermore, the device 1 comprises the second receiving area 7 designed to receive the second container 11. By means of the clamping elements 155, which are arranged in the second receiving area 7, the liquid detergent can be correctly dosed. With the device 1, the powder detergent from the first container 9 and the liquid detergent from the second container 11 can be correctly dosed and filled into a container or cup or directly into one of the detergent chambers of a washing machine. The device 1 thus enables a simplified and correct dosing of detergent.

LIST OF REFERENCE SIGNS

1 device
3 housing
5 first receiving area
7 second receiving area
9 first container
11 second container
13 rear wall
15 side wall
17 side wall
19 upper limitation
21 bottom limitation
23 open front
25 container receiving area
27 dosing device pickup area
29 dosing device
31 guide element
33 guide element
35 essentially parallel area of the guide elements
37 inclined area of the guiding elements
39 actuating and/or driving device
41 coupling element or drive shaft
43 holder for a dosing device
45 longitudinal axis
47 first horizontal surface section
49 second horizontal surface section
51 receptacle outlet opening
53 plurality of ribs
55 pair of ribs
57 screw conveyor
59 screw conveyor housing
61 screw conveyor longitudinal axis
63 inlet of the screw conveyor housing
65 inlet opening
67 outlet of the screw conveyor housing
69 outlet opening
71 first end of the screw conveyor housing
73 second end of the screw conveyor housing
75 flange
77 peripheral wall
78 first peripheral wall central longitudinal axis
79 first contact surface
80 second peripheral wall center longitudinal axis
81 second contact surface
82 drive end of the screw conveyor
83 outer wall of the screw conveyor housing
85 plurality of ribs
87 first pair of limiting ribs 87
89 second pair of limiting ribs
91 coupling device
93 cylindrical cavity
95 inner wall of the cylindrical cavity
96 outer wall of the coupling element
97 at least one material elevation
99 at least one material recess
101 helically wound flights
103 screw thread
105 insertion element or removal element
107 edges of the guide elements
109 bottom
111 housing of the first container
112 interior space of the first container
113 outlet
115 inlet opening of the first container
117 outlet opening
119 closure element
121 tab
123 inner opening
125 tapered section
127 first essentially symmetrical section
129 second essentially symmetrical section
131 first side edge of the first essentially symmetrical section
133 second side edge of first essentially symmetrical section
135 side edge of the tapered section
137 second side edge of the tapered section
139 first side edge of the second essentially symmetrical section
141 second side edge of second essentially symmetrical section
143 plate
145 cover
147 flat surface
149 connecting element
151 adhesive strip
153 clip
155 Clamping elements of the side walls of the second receiving area
157 rear wall of the second exposure area
159 side walls
161 lower limitiation
163 open top
165 front
167 first, lower pair of clamping elements
169 second, upper pair of clamping elements
171 Third, middle pair of clamping elements
D1 first distance
D2 second distance
D3 third distance

173 first side wall of the second container
175 second side wall of the second container
177 first clamping element
179 second clamping element
181 first clamping element surface
183 second clamping element surface
185 clamping element longitudinal axis
186 third clamping element surface
187 first end of the clamping element surfaces
189 second end of the clamping element surfaces
B width of the clamping element surfaces
191 connecting plate
192 through hole
193 first side edge of the first clamping element surface
195 first side edge of second clamping element surface
197 clamping element edge
199 inner cavity
201 open side of the cavity
203 housing of the second container
205 interior space
207 inlet of the second container
209 Outlet of the second container
211 Liquid detergent reservoir outlet
213 Liquid detergent reservoir
215 Inlet opening of the second tank
217 Container longitudinal axis
219 Outlet opening of the second tank
221 lower area of the second recording area
223 through-hole in the lower limitation
225 Upper area of the second exposure area
227 first end of the outlet of the second container
229 second end of the outlet of the second container
231 longitudinal outlet axis
233 inlet end
235 outlet end
241 tapering section of the second container
243 essentially symmetrical section of the second container
245 essentially horizontal plate
247 through hole of the plate
249 first flange of the plate
251 first peripheral wall of the plate
253 first side of the plate
255 outlet opening of the liquid detergent reservoir
257 first thread
259 second thread
261 peripheral wall of the outlet of the liquid detergent reservoir
262 second side of the plate
263 second flange of the plate
265 second peripheral wall of the plate
267 flange center longitudinal axis
269 liquid detergent reservoir central longitudinal axis
271 housing liquid detergent reservoir
273 top of the liquid detergent reservoir
275 bottom of the liquid detergent reservoir
277 at least a first magnet
279 outer wall of the tapering section
281 at least a second magnet
283 inner wall of the through hole
284 combination container or combination bag
285 positioning and holding device
287 scale
289 laundry basket
291 weighing cell
293 display element
295 control element
297 box
299 connecting element
301 support plate
303 lifting system
305 rotating plate
307 motor
309 piston
311 sensor
313 detergent chamber
315 hose system
317 rotatory movement of the eccentric
319 translational movement of the piston

The invention claimed is:

1. A device for dispensing a medium, the device comprising:

a housing comprising a first receiving area that is configured to receive a first container for storing the medium; and a first dosing device configured to dose the medium, wherein:

the first dosing device comprises a dosing device housing and a metering device disposed in the dosing device housing, the first receiving area comprises a dosing device receiving area for receiving the first dosing device, an actuating and/or drive device for the first dosing device is arranged in the dosing device receiving area external to the dosing device housing, wherein the actuating and/or drive device is configured to operatively align with, detachably connect to, and drive the metering device when the first dosing device is disposed within the first receiving area, the first container and the first dosing device are:

connected or connectable to each other to form a functional disposable unit for containing and dosing the medium;

each selectively or together replaceable; and designed as at least one disposable article, the first container is pre-filled with the medium, the first dosing device and/or the first container comprises at least one closure or flap element configured to selectively close the first dosing device and/or the first container, and the first dosing device and/or the first container comprises contact surfaces configured to slide along respective guide elements of the housing when the functional disposable unit is received in the first receiving area so that the guide elements position the first dosing device in a defined coupling position with the actuating and/or drive device.

2. The device of claim 1, wherein the medium is a powder.

3. The device of claim 1, wherein the device comprises a grinder for grinding the medium.

4. The device of claim 1, wherein the housing comprises a second receiving area that is configured to receive a second container.

5. The device of claim 4, wherein the second container is configured for storing a liquid medium.

6. The device of claim 4, wherein the second container is interchangeable and designed as a disposable article.

7. The device of claim 4, wherein the second container is pre-filled with a liquid medium.

8. The device of claim 4, wherein the second receiving area comprises at least two clamping elements for clamping the second container in the device.

9. The device of claim 8, wherein the at least two clamping elements selectively cooperate to enclose or deliver a dose of the medium.

10. The device of claim 9, wherein the at least two clamping elements comprise:

a first pair of clamping elements disposed adjacent an outlet of the second container so that the first pair of clamping elements can selectively prevent the medium from exiting the second container through the second container's outlet; and a second pair of clamping elements disposed adjacent an inlet of the second container so that the second pair of clamping elements can selectively prevent the medium from entering the second container through the second container's inlet.

11. The device of claim 10, wherein the at least two clamping elements further comprise:

a third pair of clamping elements, disposed between the first and second pairs of clamping elements, that is arranged to selectively apply pressure to side walls of the second container to selectively dispense a dosage of the medium from the second container while:

the first pair of clamping elements is arranged to prevent the medium from exiting the second container through the second container's outlet in a closed position of the first pair of clamping elements; and the second pair of clamping elements is arranged to prevent the medium from entering the second container through the second container's inlet in a closed position of the second pair of clamping elements.

12. The device of claim 10, wherein the first pair of clamping elements is adapted to selectively seal the second container in a sterile manner so that no bacteria or germs can enter the second container's outlet opening.

13. The device of claim 4, wherein the at least one second receiving area is configured to receive a lifting system for dosing liquid detergent.

14. The device of claim 4, wherein the second container comprises a positioning and holding element designed to position and hold the second container in the second receiving area.

15. The device of claim 1, wherein the first dosing device comprises a conveyor and a conveyor housing and the conveyor housing comprises an inlet with an inlet opening and an outlet with an outlet opening.

16. The device of claim 1, wherein the first dosing device comprises a screw conveyor and a screw conveyor housing, the screw conveyor and the screw conveyor housing extending around a common screw conveyor longitudinal axis, and the screw conveyor housing comprises an inlet with an inlet opening and an outlet with an outlet opening.

17. The device of claim 1, wherein the first dosing device is integrated into the first container.

* * * * *